US012553295B2

(12) United States Patent
Newport et al.

(10) Patent No.: US 12,553,295 B2
(45) Date of Patent: Feb. 17, 2026

(54) COUPLING MEMBER FOR USE WITH A CONNECTION

(71) Applicant: Halliburton Energy Services, Inc., Houston, TX (US)

(72) Inventors: Casey Laine Newport, Tulsa, OK (US); Grant Walker Buchman, Tulsa, OK (US); Daniel Steven McWherter, Tulsa, OK (US); David McManus, Tulsa, OK (US); Joshua Wayne Webster, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/753,067

(22) Filed: Jun. 25, 2024

(65) Prior Publication Data

US 2025/0389162 A1 Dec. 25, 2025

(51) Int. Cl.
*E21B 17/046* (2006.01)

(52) U.S. Cl.
CPC ..... *E21B 17/046* (2013.01)

(58) Field of Classification Search
CPC ..... E21B 17/046; E21B 17/0465
See application file for complete search history.

(56) References Cited

U.S. PATENT DOCUMENTS 92,289 A * 7/1869 Dunning ..... F16G 11/04 403/314
1,183,681 A * 5/1916 Schipper ..... F16B 3/00 403/318
2,230,275 A * 2/1941 Thowless ..... E21B 17/046 279/78
4,437,517 A 3/1984 Bianchi et al.
4,460,201 A * 7/1984 McGugan ..... E21B 17/046 285/365
5,086,843 A 2/1992 Mims et al.
2010/0232887 A1 9/2010 Parsons et al.
2018/0371847 A1 12/2018 Loviknes et al.
2020/0325735 A1 10/2020 Steiner et al.

FOREIGN PATENT DOCUMENTS

EP 2915949 * 9/2015 ..... E21B 17/046

OTHER PUBLICATIONS

EP2915949 (Year: 2015).*

* cited by examiner

*Primary Examiner* — Cathleen R Hutchins
(74) *Attorney, Agent, or Firm* — John Wustenberg; Parker Justiss, P.C.

(57) ABSTRACT

Provided in one example is a coupling member, a downhole tool, and a well system. The coupling member, in one aspect, includes an axial tension member portion, and a first shear member portion, the first shear member portion having a first shear member shoulder extending from a first end of the axial tension member portion, the first shear member shoulder configured to engage with an opposing head member shoulder to axially fix the axial tension member portion relative to the head member. The coupling member, according to one aspect, includes a second shear member portion, the second shear member portion have a second shear member shoulder extending from a second opposing end of the axial tension member portion, the second shear member shoulder configured to engage with an opposing base member shoulder to axially fix the axial tension member portion relative to the base member.

22 Claims, 61 Drawing Sheets

400

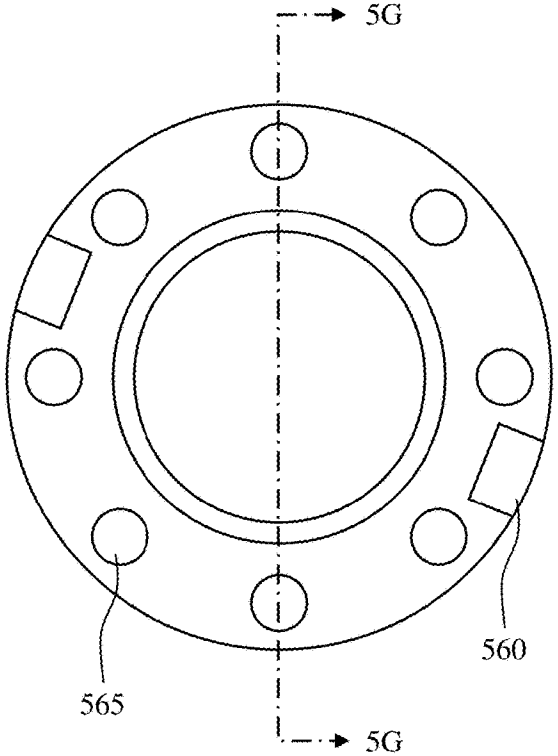
FIG. 5F
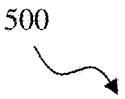

600

700

700

700

COUPLING MEMBER FOR USE WITH A CONNECTION

BACKGROUND

Fluid, such as gas, oil or water, is often located in subterranean formations. In many such situations, the fluid must be pumped to the earth's surface so that it can be collected, separated, refined, distributed and/or sold. Pump assemblies, such as electric submersible pumps, are often used to lift well fluid to the earth's surface. Pump assemblies are also used in water well applications, and numerous surface industrial applications ranging from nuclear, petrochemicals, process, city, etc.

BRIEF DESCRIPTION

Reference is now made to the following descriptions taken in conjunction with the accompanying drawings, in which:

FIGS. 5A through 5J illustrate various different views of a downhole tool designed, manufactured and/or operated according to one or more embodiments of the disclosure;

Figure 8A:
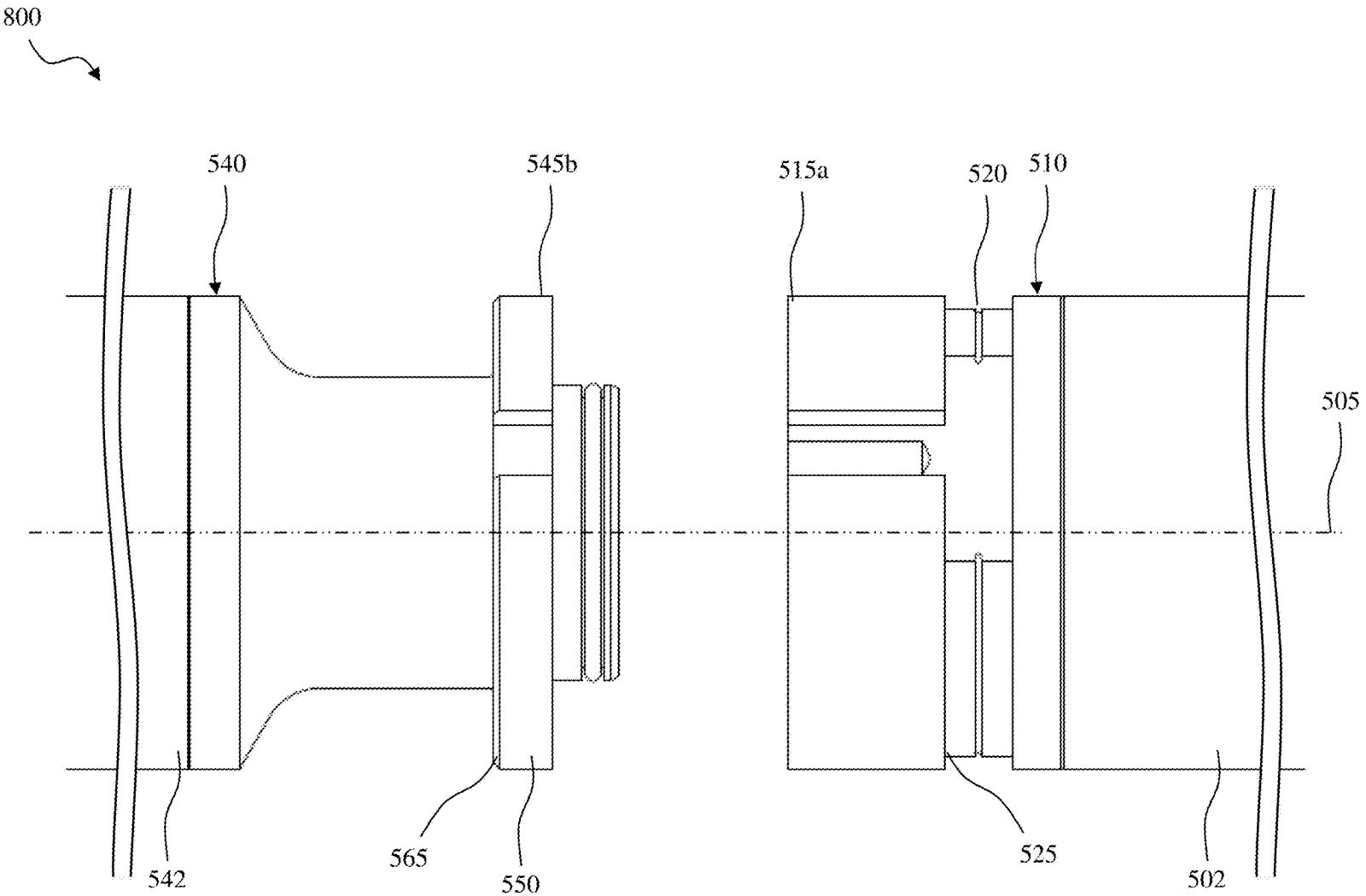

FIGS. 7A through 7J illustrate various different views of a downhole tool designed, manufactured and/or operated according to one or more alternative embodiments of the disclosure; and FIGS. 8A through 80 illustrate various different views of a downhole tool designed, manufactured and/or operated according to one or more alternative embodiments of the disclosure at various different states of installation.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Furthermore, unless otherwise specified, use of the terms "up," "upper," "upward," "uphole," "upstream," or other like terms shall be construed as generally toward the surface of the subterranean formation; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Additionally, unless otherwise specified, use of the term "subterranean formation" shall be construed as encompassing both areas below exposed earth and areas below earth covered by water such as ocean or fresh water.

Various values and/or ranges are explicitly disclosed in certain embodiments herein. However, values/ranges from any lower limit may be combined with any upper limit to recite a range not explicitly recited. Similarly, values/ranges from any lower limit may be combined with any other lower limit to recite a range not explicitly recited. In the same way, values/ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited. Similarly, an individual value disclosed herein may be combined with another individual value or range disclosed herein to form another range.

The term "substantially XYZ," as used herein, means that it is within 10 percent of perfectly XYZ. The term "significantly XYZ," as used herein, means that it is within 5 percent of perfectly XYZ. The term "ideally XYZ," as used herein, means that it is within 1 percent of perfectly XYZ. The monicker "XYZ" could refer to parallel, perpendicular, alignment, or other relative features disclosed herein.

The present disclosure is based, at least in part, on the recognition that flanged connections experience many difficulties, particularly when being place downhole within a wellbore, many times thousands of feet below the earth's surface. The present disclosure has recognized that flanged connections associated with downhole pump assemblies experience considerable issues. For example, during operation of the downhole pump assembly, considerable stress may develop in the threaded fasteners keeping the flanged connection together. These threaded fasteners at the flanged connection must handle all of the weight of the equipment there below, while also handling the static and dynamic axial downforces from the column of the fluid moving to the earth's surface above it. Failed fasteners often lead to costly fishing jobs, as well as unproductive downtime for producers.

With the foregoing recognition in mind, the present disclosure has developed an improved coupling member for use with a flanged connection. This coupling member, in at least one embodiment, provides a redundant coupling to the one or more threaded fasteners typically used in flanged connections. In yet another embodiment, the coupling member provides a primary coupling, if not only coupling, of the connection, whether of a flanged connection or not. Accordingly, if the one or more threaded fasteners were to shear or otherwise break, the coupling member would advantageously prevent the downhole portion of the threaded connection from sliding downhole, and thus advantageously prevent the aforementioned fishing job and/or unproductive downtime.

In at least one embodiment, the coupling member includes an axial tension member portion, a first shear member portion, and a second shear member portion. In this one embodiment, the axial tension member portion is configured to span a first axial slot in a head member of a connection and a second axial slot in a base member of the connection. Further to this one embodiment, the first shear member portion has a first shear member shoulder extending from a first end of the axial tension member portion, the first shear member shoulder configured to engage with an opposing head member shoulder to axially fix the axial tension member portion relative to the head member. Similarly, the second shear member portion has a second shear member shoulder extending from a second opposing end of the axial tension member portion, the second shear member shoulder configured to engage with an opposing base member shoulder to axially fix the axial tension member portion relative to the base member, the axial tension member portion, the first shear member portion. As will be discussed below, in at least one embodiment, the connection is a flanged connection, and further wherein the axial tension member portion is configured to span the first axial slot in the head member of the flanged connection and the second axial slot in a flange of the base member of the flanged connection. Thus, when in place, the coupling member could provide a redundant coupling for the connection (e.g., flanged connection).

The embodiments disclosed below will primarily be discussed as part of a flanged connection. It should be noted however, that a flanged connection is not required to remain within the scope of the disclosure. In fact, any type of connection may be used, for example if there is a first radial groove in the head member portion and a second radial groove in the base member portion. Thus, in at least one embodiment, the connection is a threaded connection, as opposed to a flanged connection.

Figure 1:
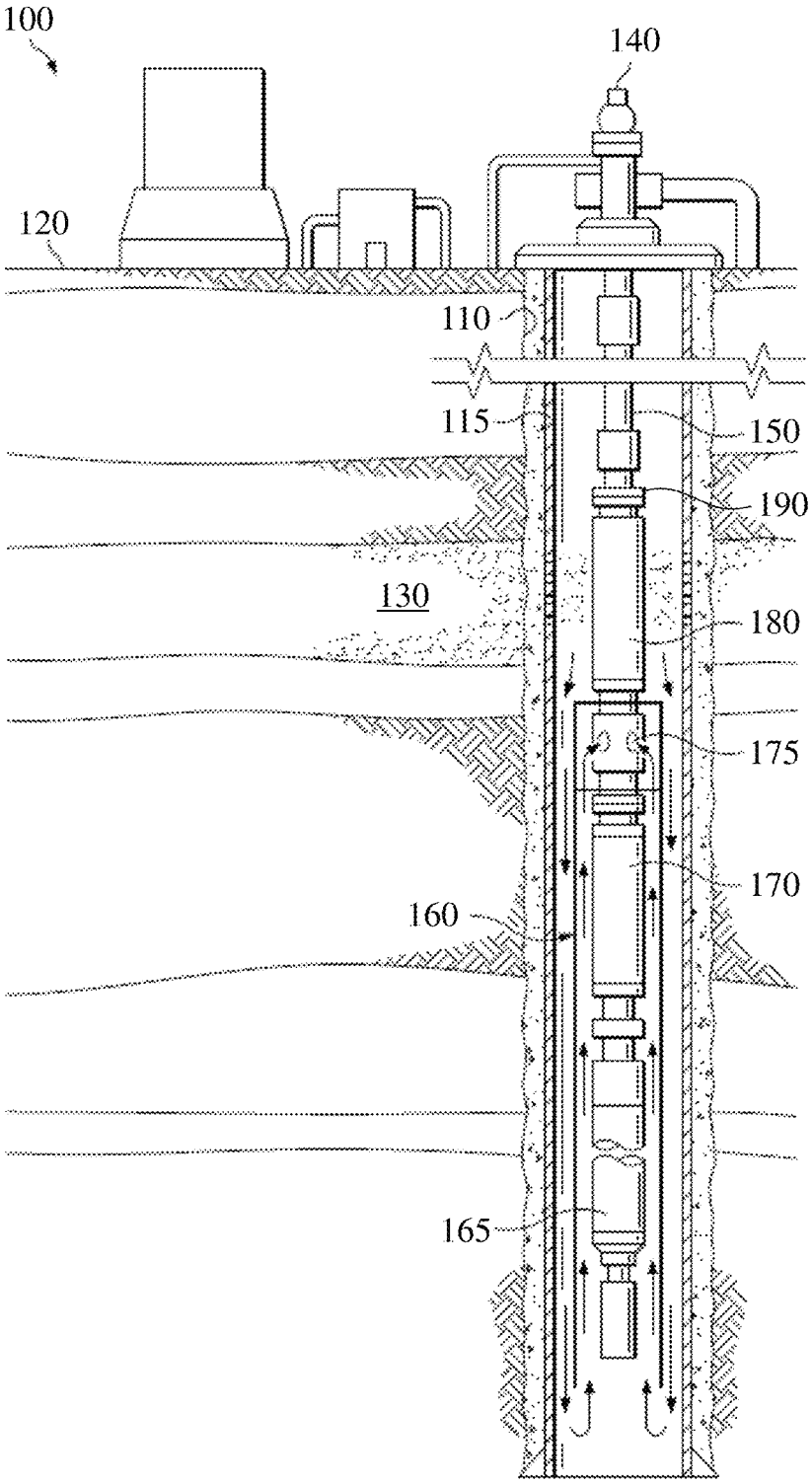
FIG. 1 illustrates a cross-sectional view of a well system designed, manufactured, and operated according to one or more examples of the disclosure.

FIG. 1 illustrates a cross-sectional view of a well system 100 designed, manufactured, and/or operated according to one or more examples of the disclosure. As depicted, the well system 100 includes a wellbore 110 extending from the earth's surface 120 and penetrating one or more subterranean formations 130 for the purpose of recovering fluid (e.g., hydrocarbons) therefrom. The subterranean formation 130 may be located below exposed earth, as shown, as well as areas below earth covered by water, such as ocean or fresh water.

The wellbore 110 may be drilled into the subterranean formation 130 using any suitable drilling technique. In the example illustrated in FIG. 1, the wellbore 110 extends substantially vertically away from the earth's surface 120. In alternative operating environments, all or portions of a wellbore 110 may be vertical, deviated at any suitable angle, horizontal, and/or curved. The wellbore 110 may be a new wellbore, an existing wellbore, a straight wellbore, an extended reach wellbore, a sidetracked wellbore, a multilateral wellbore, or any other type of wellbore for drilling and completing one or more production zones. In one or more examples, the wellbore 110 includes wellbore casing 115, which may be cemented into place in the wellbore 110. In other examples, all or a portion of the wellbore 110 is uncased or partially cased.

The well system 100 of FIG. 1 additionally includes a wellhead 140, in this embodiment positioned at the earth's surface, as well as a wellbore conveyance 150 extending from the wellhead 140 into the one or more subterranean formations 130. The example shown in FIG. 1 illustrates the wellbore conveyance 150 in the form of production tubing disposed in the wellbore 110. It should be understood that the wellbore conveyance 150 is equally applicable to any type of wellbore conveyance being inserted into a wellbore 110, including as non-limiting examples pipe, casing, liners, jointed tubing, coiled tubing, etc., Further, the wellbore conveyance 150 may operate in any of the wellbore orientations (e.g., vertical, deviated, horizontal, and/or curved) and/or types described herein.

Coupled to the wellbore conveyance 150, in the example illustrated in FIG. 1, is a pump assembly 160. The pump assembly 160, in this embodiment, is an electric submersible pump assembly employed to help raise fluid (e.g., hydrocarbons) from deep within the wellbore 110 to the wellhead 140 at the earth's surface 120. The pump assembly 160, in the illustrated embodiment, includes a rotary actuator 165. The rotary actuator 165 can be any direct and indirect driver including but not limited to an electric motor, a turbine, a hydraulic motor, a gearbox, belt driven actuator, chain driven actuator, or any other mechanism for providing rotary motion to the pump. The rotary actuator 165, in this embodiment, is an electric motor. For example, the electric motor might be the deepest component of the pump assembly 160 (e.g., other than downhole sensors). The rotary actuator 165 may be a two-pole, three-phase squirrel cage induction motor, in one embodiment. Other rotary actuators, however, are within the scope of the disclosure. For example, any rotary actuator 165 capable of imparting rotational motion (e.g., on the shaft of the centrifugal pump) could be used.

Uphole of the rotary actuator 165, in the embodiment of FIG. 1, is a seal section 170. The seal section 170, in this embodiment, carries the thrust of a centrifugal pump 180, and equalizes pressure to the rotary actuator 165. One or more intakes 175 may be uphole of the seal section 170, and serve as the intakes for well fluid into the pump assembly 160. The intakes 175 may include intake ports and/or one or more slotted or perforated screens.

The centrifugal pump 180, in accordance with the disclosure, includes one or more stages, each stage including an impeller that is attached to and configured to rotate with a central shaft driven by the rotary actuator 165, as well as a stationary diffuser. In operation, as the central shaft turns, and thus the impeller turns, vanes on the impeller impart velocity to the wellbore fluid (e.g., crude oil). As the wellbore fluid is carried to the outermost portion of the impeller vanes, it is transferred to the adjoining stationary diffuser. The diffuser transforms the fluid velocity into hydraulic head, or pressure. In turn, the diffuser guides the fluid upward into the impeller of the next stage, and ultimately up the conveyance 150 to the wellhead 140 located at the earth's surface. The centrifugal pump 180 may include any number of stages and remain within the disclosure. In some multistage centrifugal pumps, the diffusers are bolted together and not housed in a housing. In some pumps diffuser is replaced with volute and or casing. Volute or casing can be in one or more pieces.

The well system 100, in the embodiment of FIG. 1, additionally includes one or more flanged connections 190 designed, manufactured and or operated according to one or more embodiments of the disclosure. In the embodiment of FIG. 1, the flanged connection 190 is configured to couple the conveyance 150 and the pump assembly 160. In yet another embodiment, the flanged connection 190 is configured to couple a bolt-on discharge to a pump, a pump to another pump, a pump to an intake, a pump to a gas separator, a pump intake to a seal, a gas separator to a seal, a seal to a motor, etc. Notwithstanding, a flanged connection according to the disclosure may exist anywhere within the wellbore 110, and thus unless otherwise required is not limited for use with a pump assembly 160.

Figure 2A:
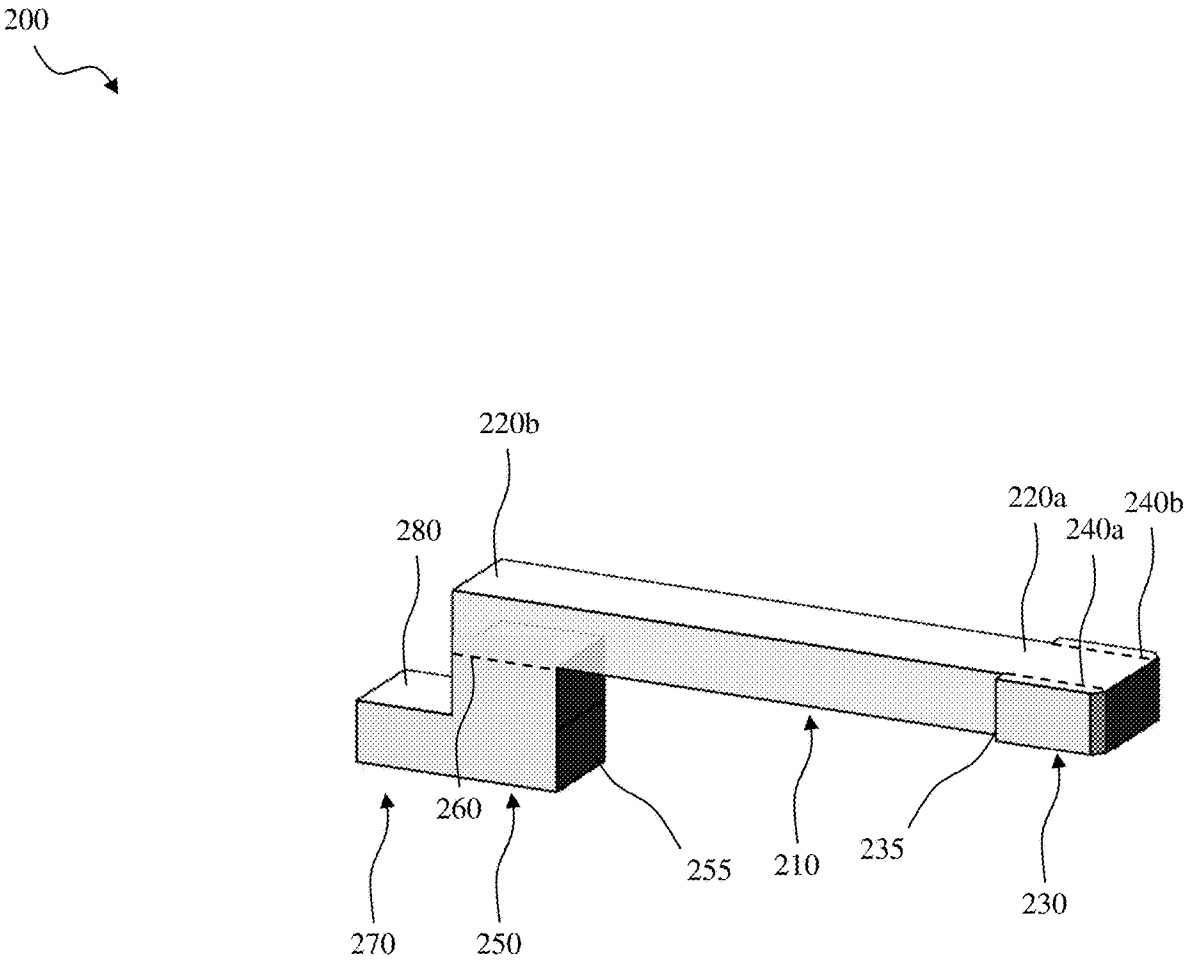
FIGS. 2A through 2E illustrate various different views of a coupling member designed, manufactured and/or operated according to one or more embodiments of the disclosure.
Figure 2B:
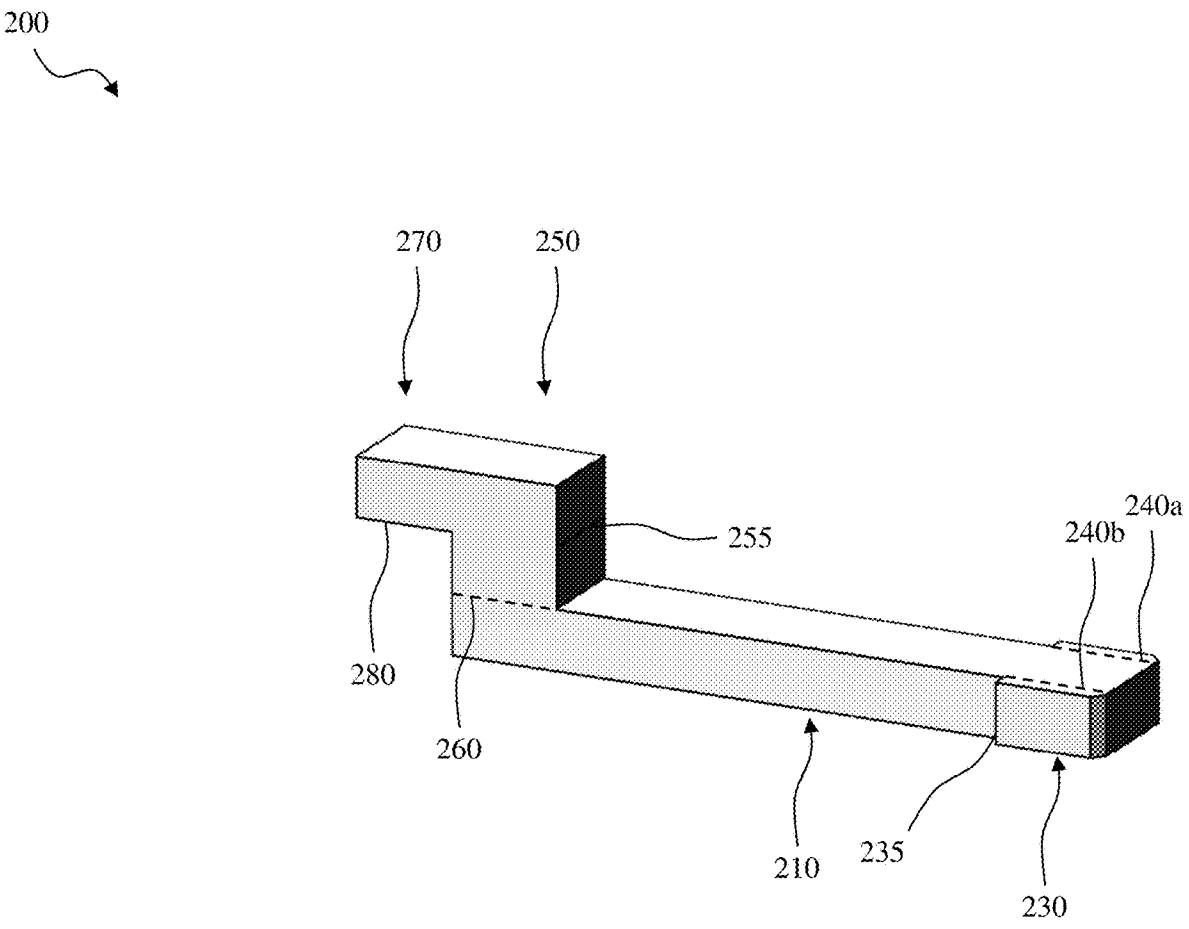
Figure 2C:
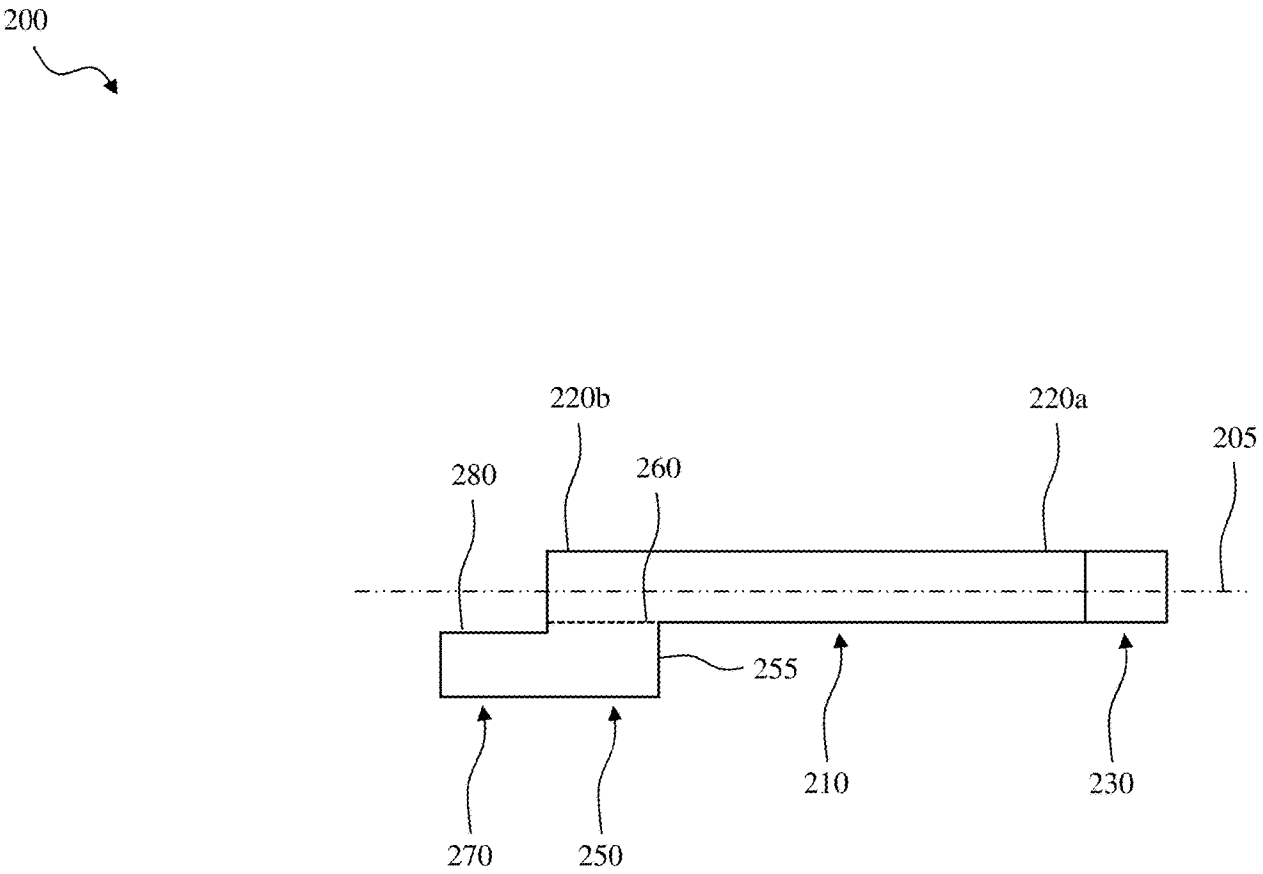
Figure 2D:
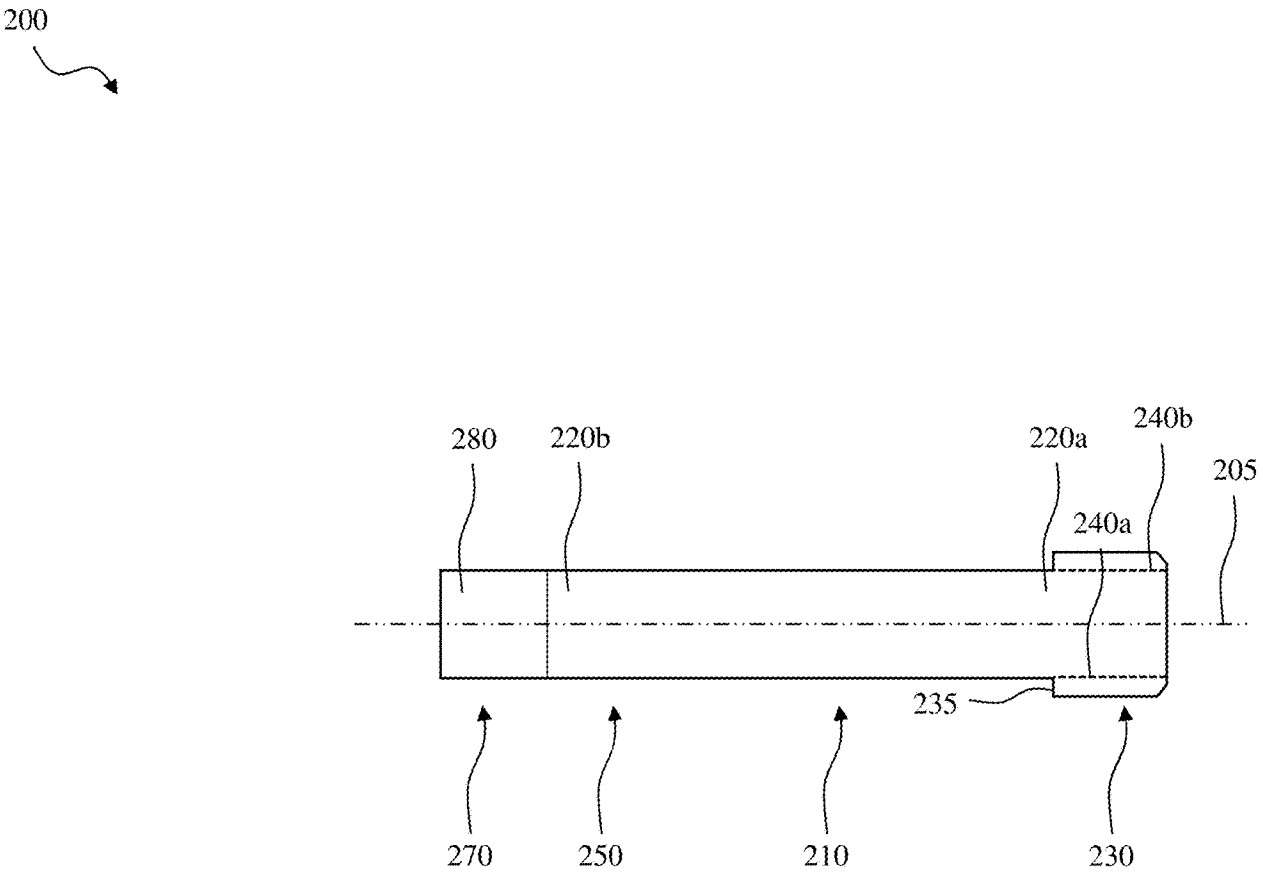
Figure 2E:
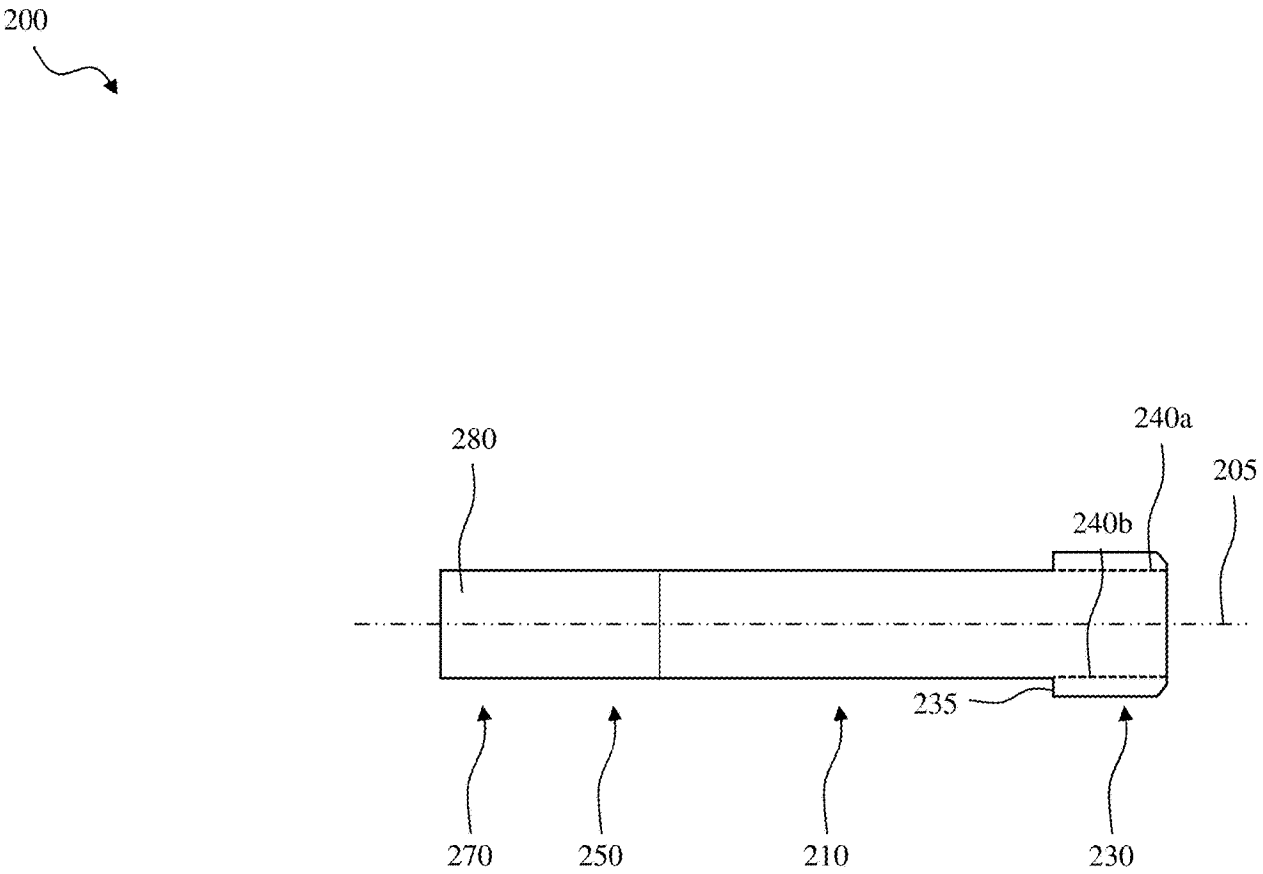

FIGS. 2A through 2E illustrate various different views of a coupling member 200 designed, manufactured and/or operated according to one or more embodiments of the disclosure. FIG. 2A illustrates a top perspective view of the coupling member 200, whereas FIG. 2B illustrates a bottom perspective view of the coupling member 200. Similarly, FIG. 2C illustrates a side view of the coupling member 200, whereas FIGS. 2D and 2E illustrate top and bottom views, respectively, of the coupling member 200.

The coupling member 200, in the illustrated embodiment, includes an axial tension member portion 210. The axial tension member portion 210, in at least one embodiment (e.g., as will be discussed in detail below) is configured to span a first axial slot in a head member of a flanged connection (e.g., of a pump assembly) and a second axial slot in a flange of a base member of the flanged connection (e.g., of the pump assembly). The term "axial slot," as used herein, means that the axial slot is substantially parallel with a longitudinal axis of the flanged connection. In certain embodiments, the axial slot is significantly parallel with the longitudinal axis, if not ideally parallel with the longitudinal axis, if not perfectly parallel with the longitudinal axis.

The coupling member 200, in the illustrated embodiment, further includes a first shear member portion 230. The first shear member portion 230, in the illustrated embodiment, has a first shear member shoulder 235 extending from a first end 220*a* of the axial tension member portion 210. In the illustrated embodiment, the first shear member shoulder 235 is configured to engage with an opposing head member shoulder to axially fix the axial tension member portion 210 relative to the head member. In the illustrated embodiment of FIGS. 2A through 2E, the first shear member portion 230 is T-shaped to create two first shear planes 240*a*, 240*b*. Nevertheless, in yet another embodiment, the first shear member portion 230 might be L-shaped to create one first shear plane (e.g., such as a single first shear plane 240*a* or 240*b*).

The coupling member 200, in the illustrated embodiment, further includes a second shear member portion 250. The second shear member portion 250, in the illustrated embodiment, has a second shear member shoulder 255 extending from a second opposing end 220*b* of the axial tension member portion 210. In the illustrated embodiment, the second shear member shoulder 255 is configured to engage with an opposing base member shoulder to axially fix the axial tension member portion 210 relative to the base member. In the illustrated embodiment of FIGS. 2A through 2E, the second shear member portion 250 creates a second shear plane 260.

The coupling member 200 may be configured in a number of different ways, but in the embodiment of FIGS. 2A through 2E, the first shear plane 240 (e.g., two first shear planes 240*a*, 240*b*) and the second shear plane 260 are substantially parallel with a longitudinal axis 205 of the axial tension member portion 210. In yet other embodiments, the first shear plane 240 (e.g., two first shear planes 240*a*, 240*b*) and the second shear plane 260 are significantly parallel, if not ideally parallel, if not perfectly parallel. Further to the embodiment of FIGS. 2A through 2E, the first shear plane 240 (e.g., two first shear planes 240*a*, 240*b*) and the second shear plane 260 are substantially perpendicular to one another. Nevertheless, as discussed in detail below (e.g., with regard to FIGS. 4A through 4E), other embodiments exist wherein the first shear plane 240 (e.g., two first shear planes 240*a*, 240*b*) and the second shear plane 260 are substantially parallel with one another.

The coupling member 200, in the illustrated embodiment, further includes a coupling member retention mechanism 270 coupled to one of the axial tension member portion 210, the first shear member portion 230, or the second shear member portion length 250. In at least one embodiment, the coupling member retention mechanism 270 is configured to fix the axial tension member portion 210 in the first axial slot of the head member and the second axial slot of the base member. In the embodiment of FIGS. 2A through 2E, the coupling member retention mechanism 270 is a lip member 280 extending from the second shear member portion 250. In this embodiment, the lip member 280 extends from the second shear member portion 250 in a directly substantially parallel with the longitudinal axis 205 of the axial tension member portion 210. Further to this embodiment, the lip member 280 is configured to engage with and be held in place by a retaining clamp (not shown) associated with the flanged connection, together fixing the axial tension member portion 210 in the first axial slot of the head member and the second axial slot of the base member.

As will be discussed in greater detail below, other embodiments exist wherein the coupling member retention mechanism 270 is an opening extending through the axial tension member portion 210, the first shear member portion 230, or the second shear member portion 250. In at least this one embodiment, a fastener may extend through the opening (e.g., in one embodiment an opening extending through a thickness (t) of the first shear member portion 230) and into the head member or base member. In this embodiment, the fastener fixes the axial tension member portion 210 in the first axial slot and the second axial slot.

The coupling member 200 of FIGS. 2A through 2E, in at least one embodiment, is a solid metal coupling member. For example, in at least one embodiment, the coupling member 200 is milled from a single piece of metal rod (e.g., Inconel steel rod, stainless steel rod, etc.), for example a 2.54 cm (e.g., 1 inch) diameter piece of circular metal rod stock. Nevertheless, other embodiments may exist wherein the coupling member 200 comprises a non-metal material.

Ultimately, the coupling member 200 may be used to carry the axial load in tension and shear from one portion of a flanged connection (e.g., head member) to another portion of the flanged connection (e.g., base member) in the event that the primary fasteners break. In certain embodiments, multiple of the coupling members 200 (e.g., two or more, three or more, four or more, five or more, six or more, etc.) may be used with a single flanged connection to provide additional security. For example, if two coupling members 200 were used, they might be offset from one another by 180 degrees. Whereas, if three coupling members 200 were used, they might be offset from one another by 120 degrees, and so on.

Figure 3A:
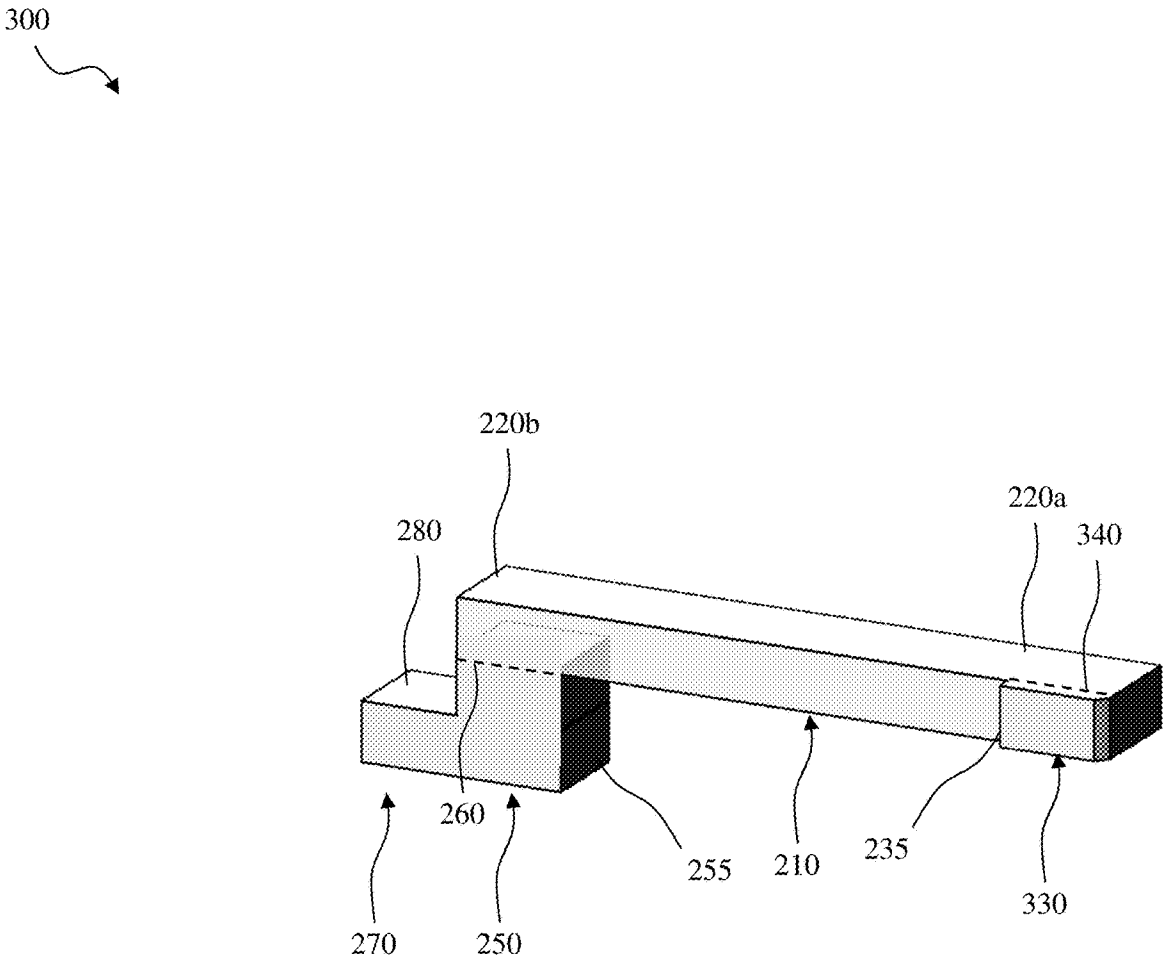
FIGS. 3A through 3E illustrate various different views of a coupling member designed, manufactured and/or operated according to one or more alternative embodiments of the disclosure.
Figure 3B:
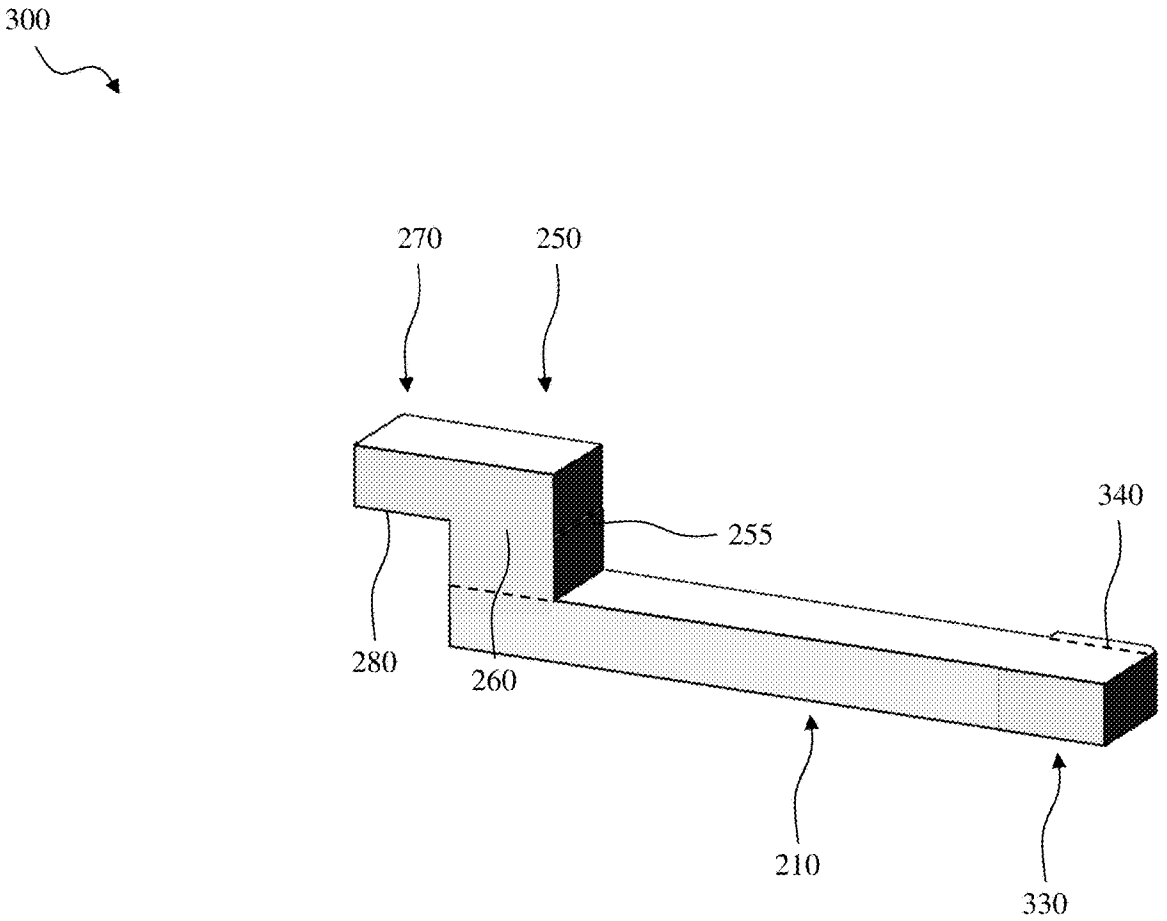
Figure 3C:
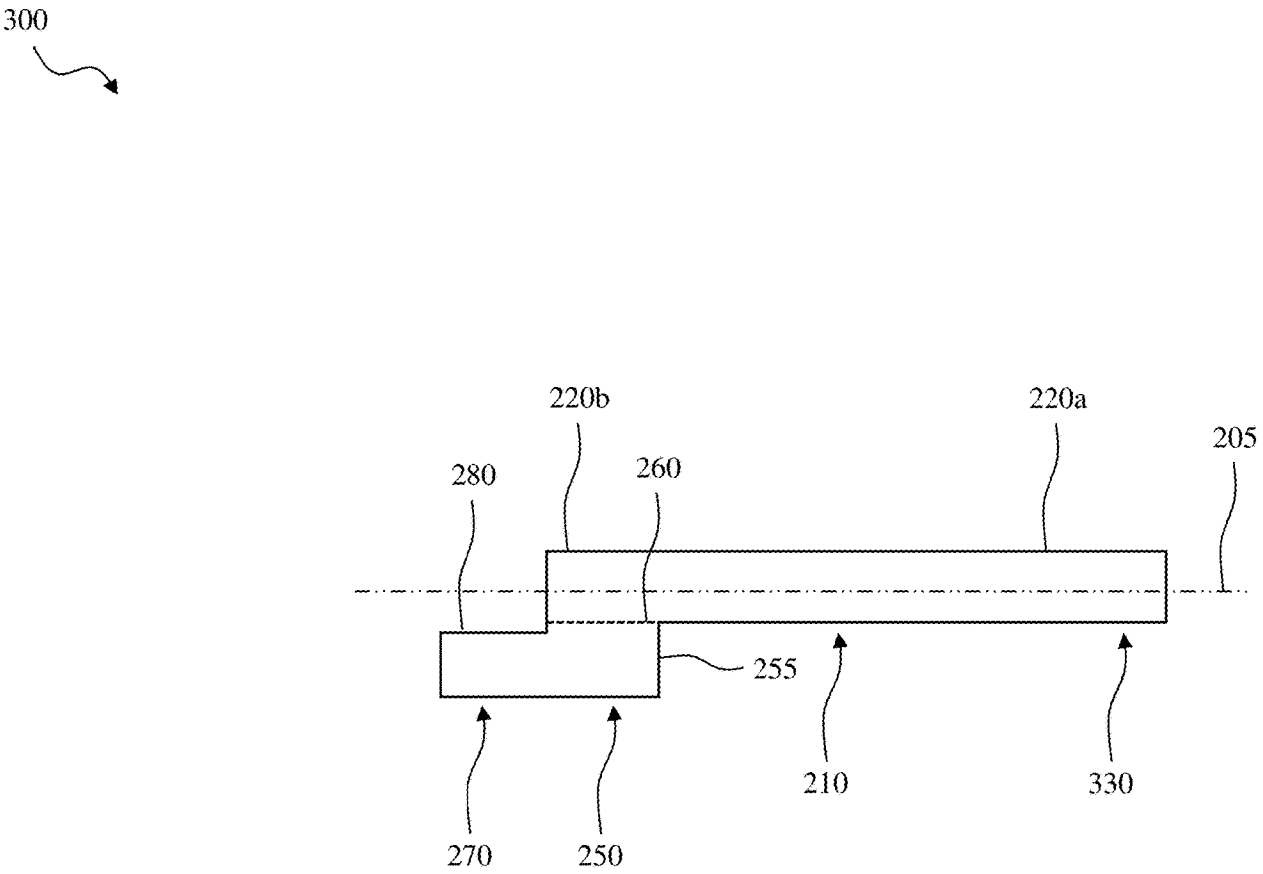
Figure 3D:
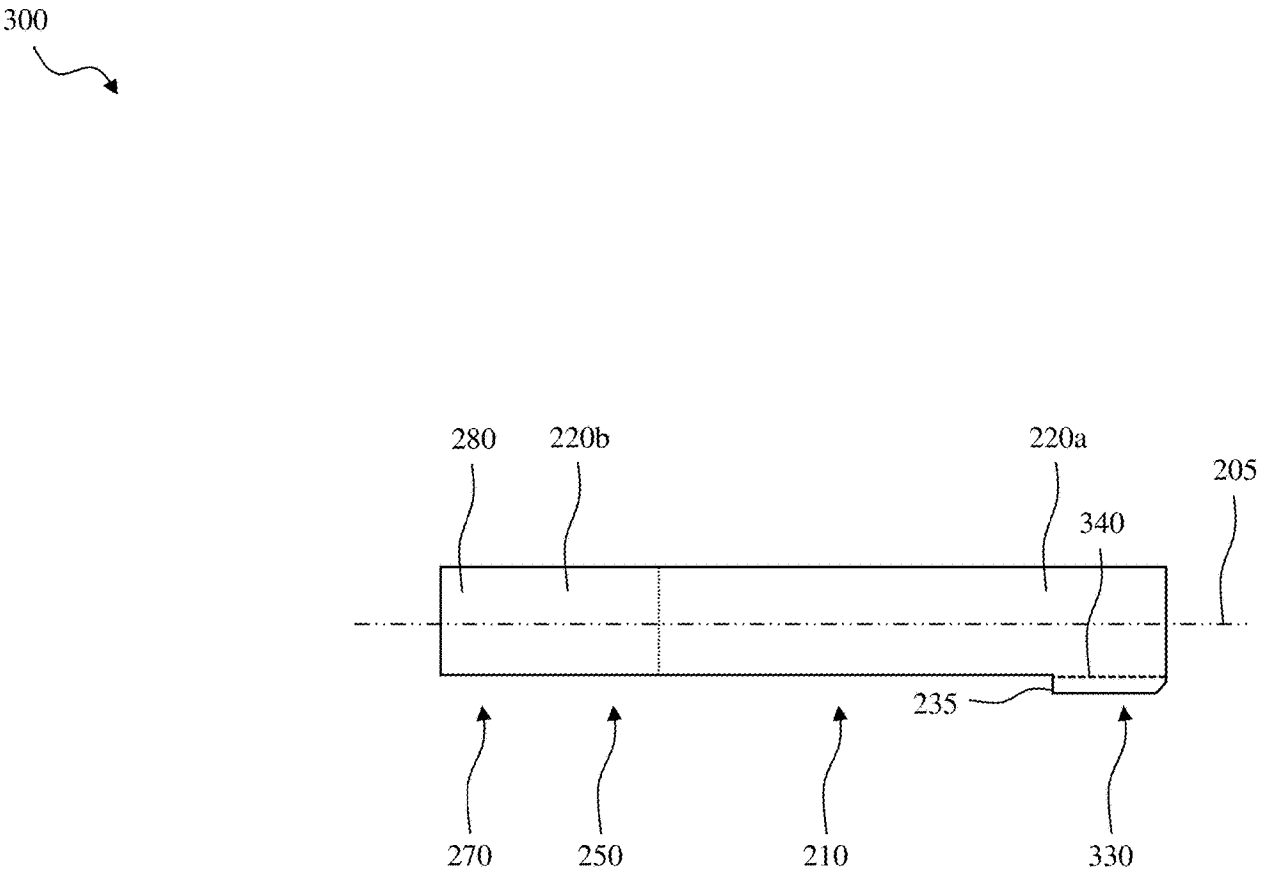
Figure 3E:
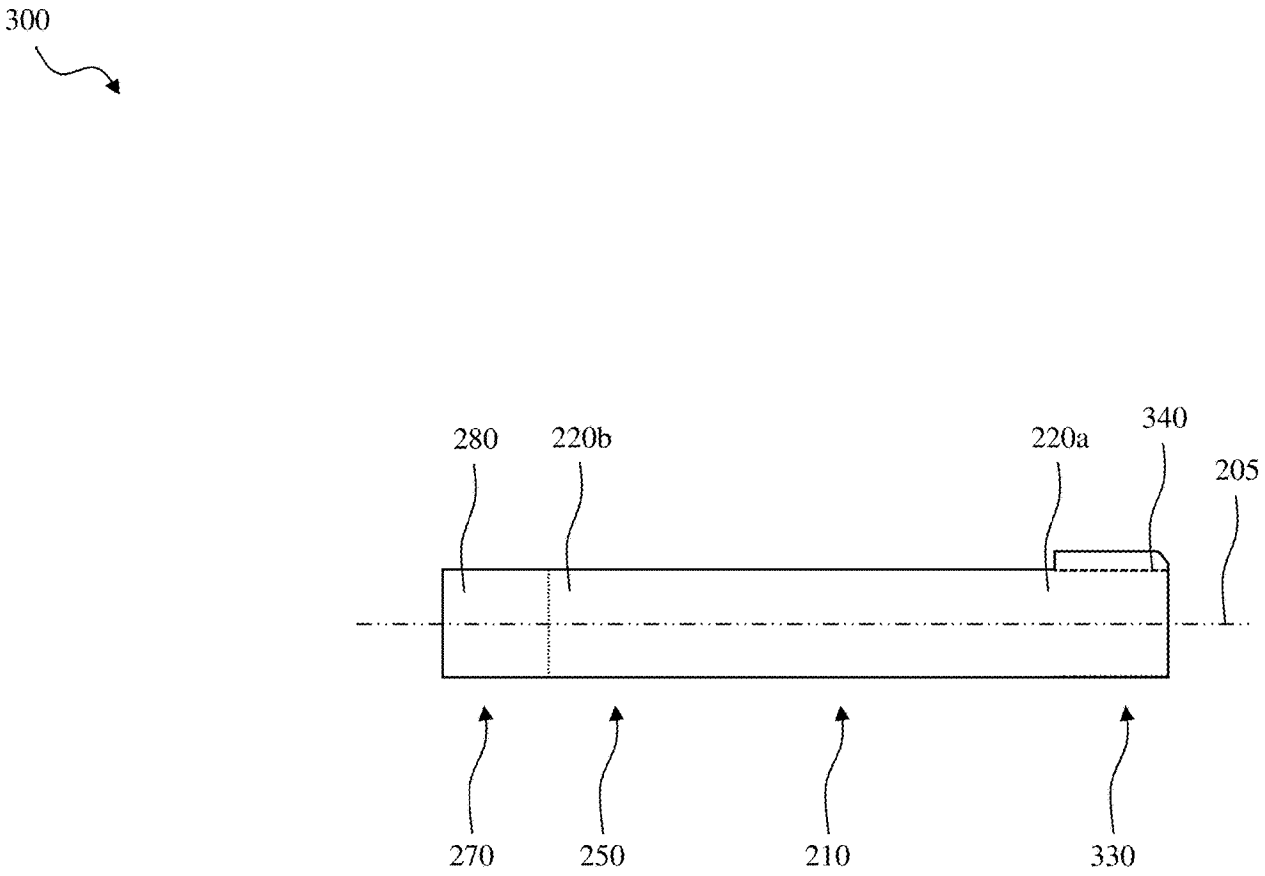

FIGS. 3A through 3E illustrate various different views of a coupling member 300 designed, manufactured and/or operated according to one or more alternative embodiments of the disclosure. FIG. 3A illustrates a top perspective view of the coupling member 300, whereas FIG. 3B illustrates a bottom perspective view of the coupling member 300. Similarly, FIG. 3C illustrates a side view of the coupling member 300, whereas FIGS. 3D and 3E illustrate top and bottom views, respectively, of the coupling member 300.

The coupling member 300 of FIGS. 3A through 3E is similar in many respects to the coupling member 200 of FIGS. 2A through 2E. Accordingly, like reference numbers have been used to indicate similar, if not identical, features. The coupling member 300 differs, for the most part, from the coupling member 200, in that the first shear member portion 330 is L-shaped to create one first shear plane 340, as opposed to T-shaped to create two shear planes.

Figure 4A:
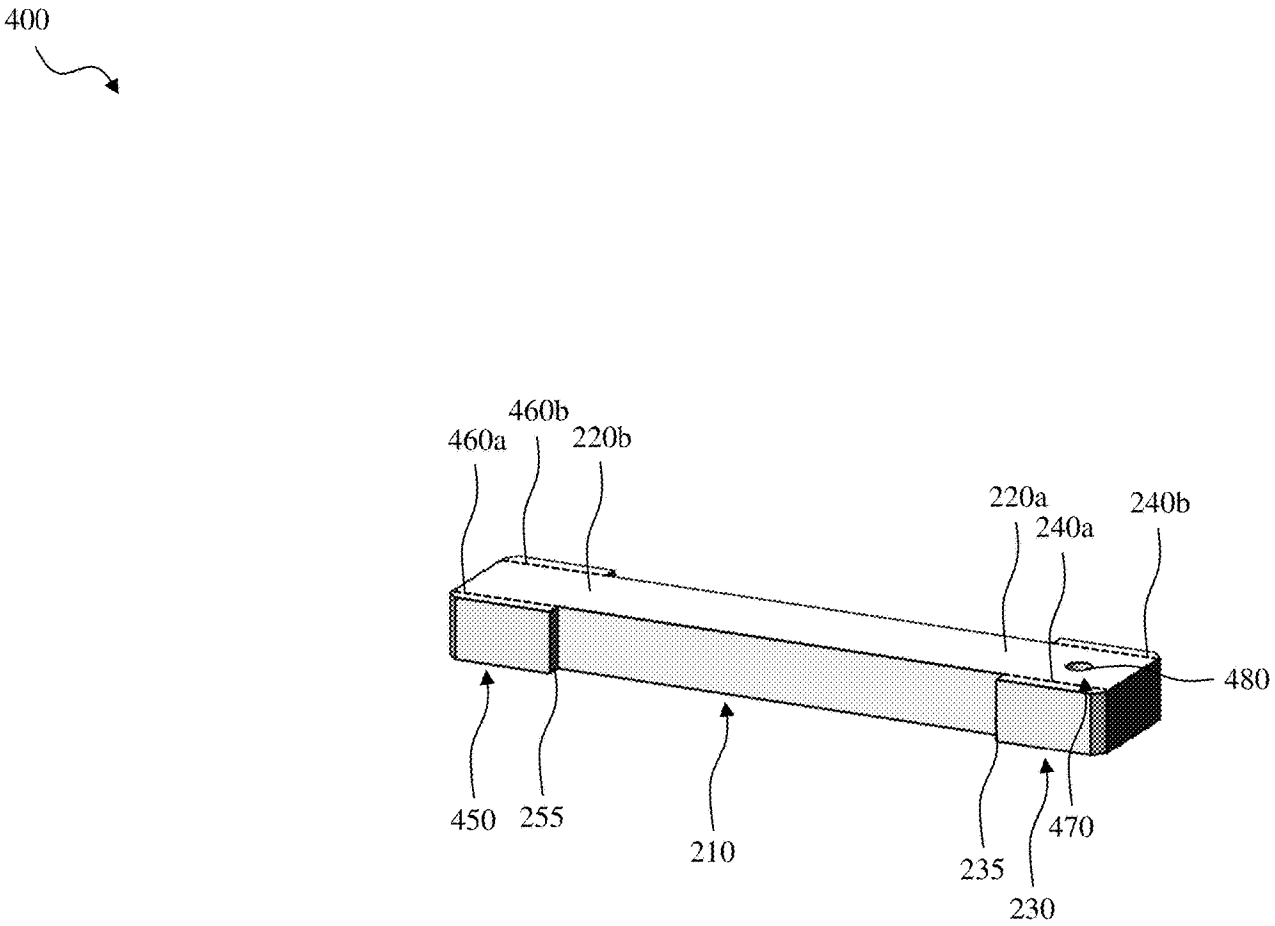
FIGS. 4A through 4E illustrate various different views of a coupling member designed, manufactured and/or operated according to one or more alternative embodiments of the disclosure.
Figure 4B:
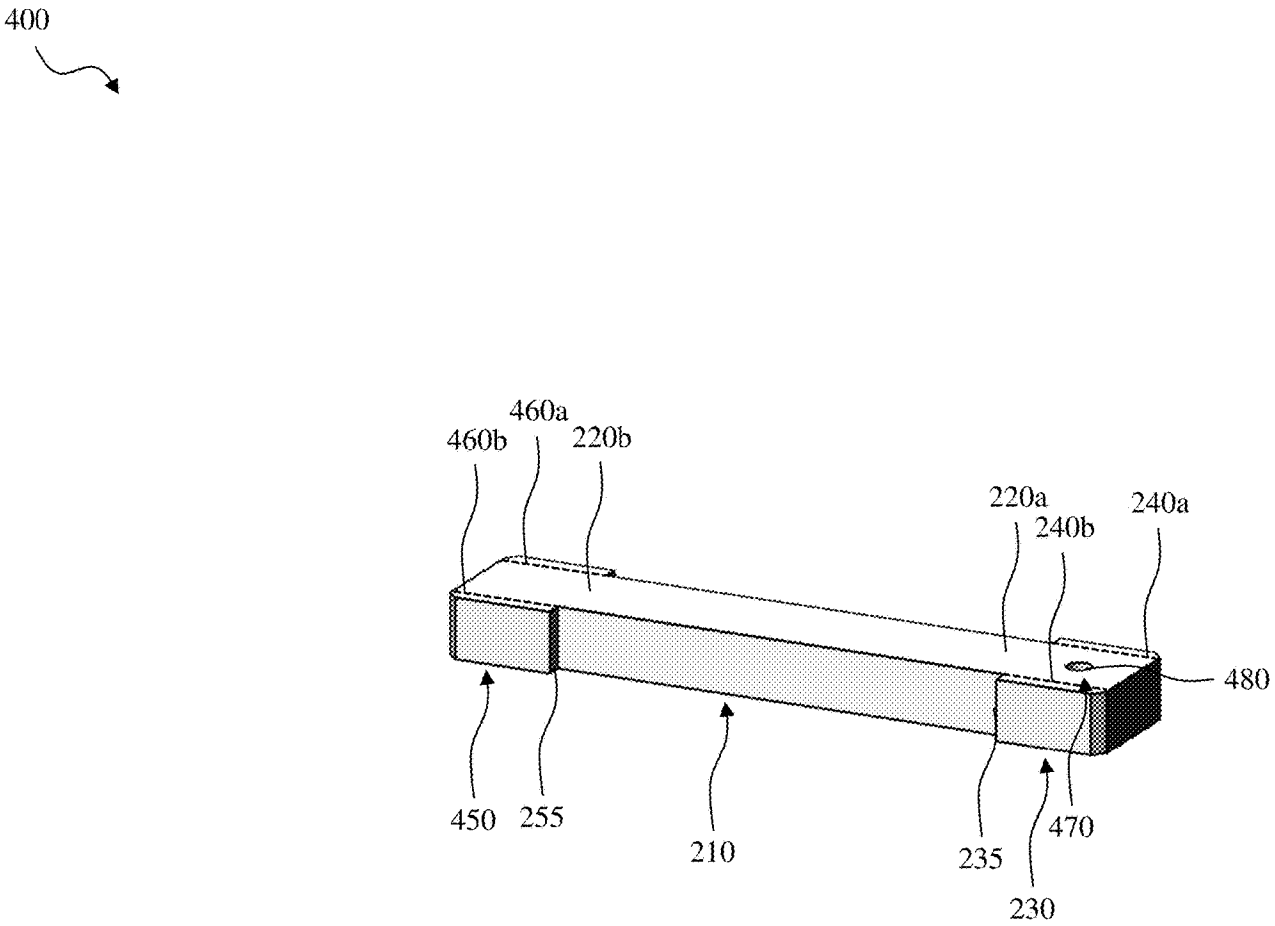
Figure 4C:
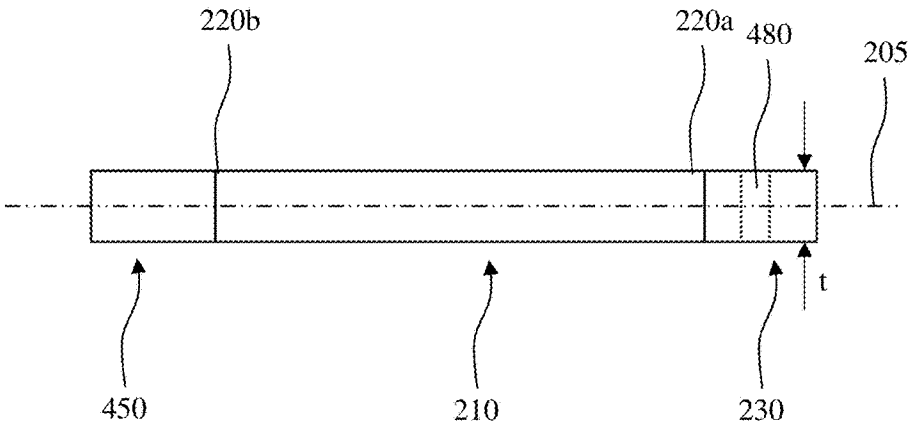
Figure 4D:
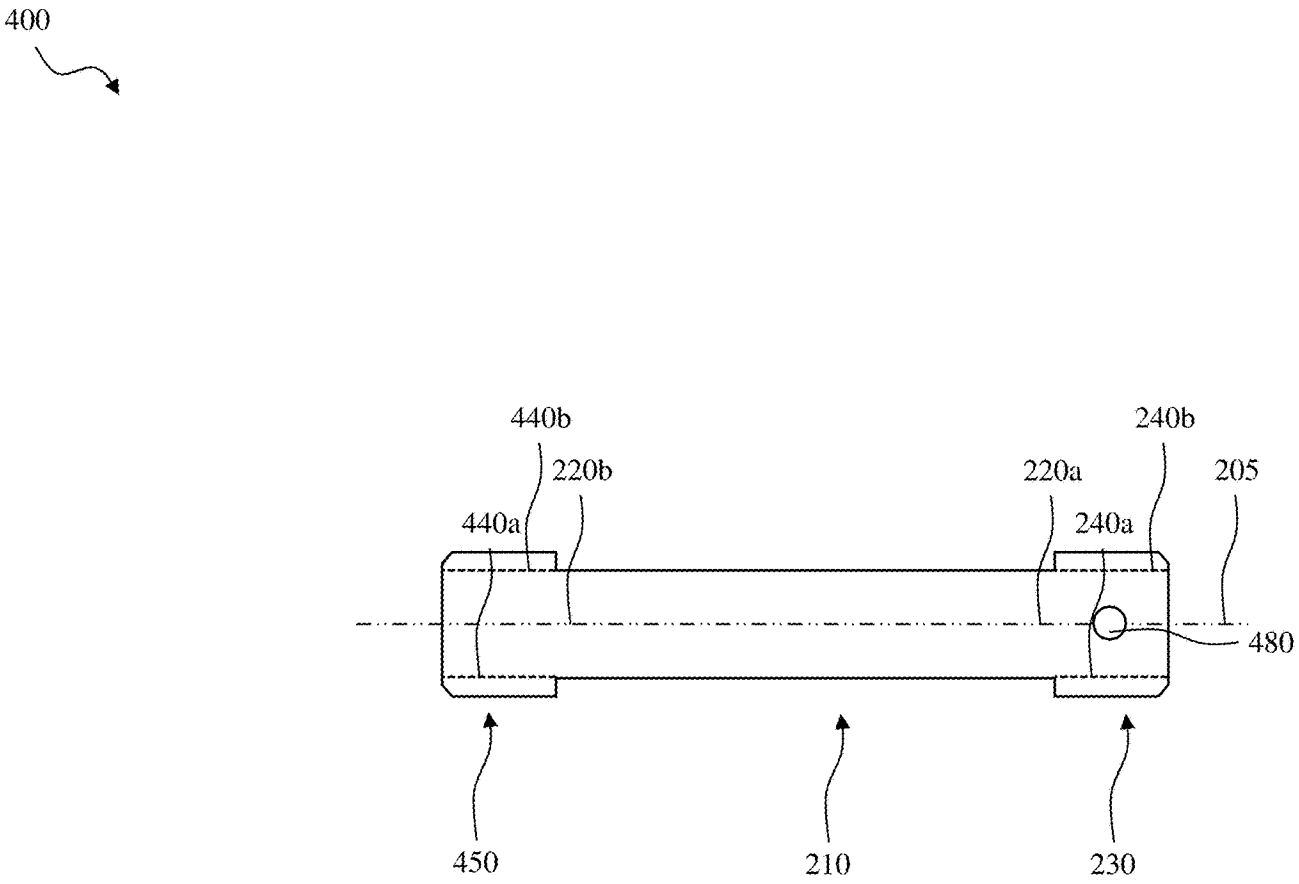
Figure 4E:
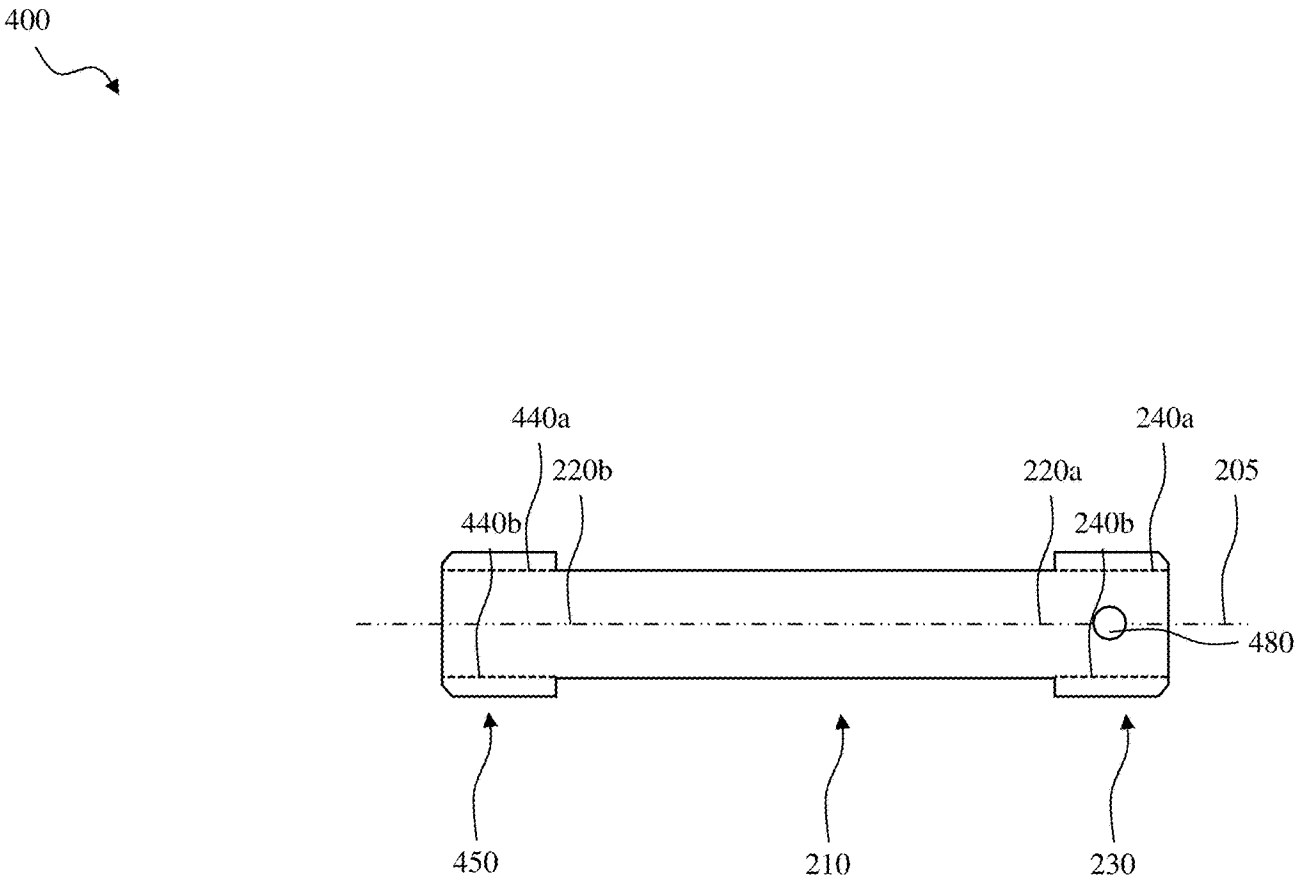

FIGS. 4A through 4E illustrate various different views of a coupling member 400 designed, manufactured and/or operated according to one or more alternative embodiments of the disclosure. FIG. 4A illustrates a top perspective view of the coupling member 400, whereas FIG. 4B illustrates a bottom perspective view of the coupling member 400. Similarly, FIG. 4C illustrates a side view of the coupling member 400, whereas FIGS. 4D and 4E illustrate top and bottom views, respectively, of the coupling member 400.

The coupling member 400 of FIGS. 4A through 4E is similar in many respects to the coupling member 200 of FIGS. 2A through 2E. Accordingly, like reference numbers have been used to indicate similar, if not identical, features. The coupling member 400 differs, for the most part, from the coupling member 200, in that its second shear member portion 450 is shaped substantially similar to its first shear member portion 230. Accordingly, in the illustrated embodiment the second shear member portion 450 forms a second shear plane 460 (e.g., second shear plane portion 460*a* and second shear plane portion 460*b*). In at least this one embodiment, the first shear plane 240 and the second shear plane 460 are substantially parallel with one another. Further to this embodiment, the coupling member 400 is substantially flat, if not significantly flat, if not ideally flat, if not perfectly flat.

The coupling member 400 additionally differs from the coupling member 200, in that the coupling member 400 employs an opening 480 as its coupling member retention mechanism 470. While the opening 480 may be formed in any of the axial tension member portion 210, first shear member portion 230 or second shear member portion 450, the embodiment of FIGS. 4A through 4E employs the opening 480 extending through a thickness (t) of the first shear member portion 230.

Figure 5A:
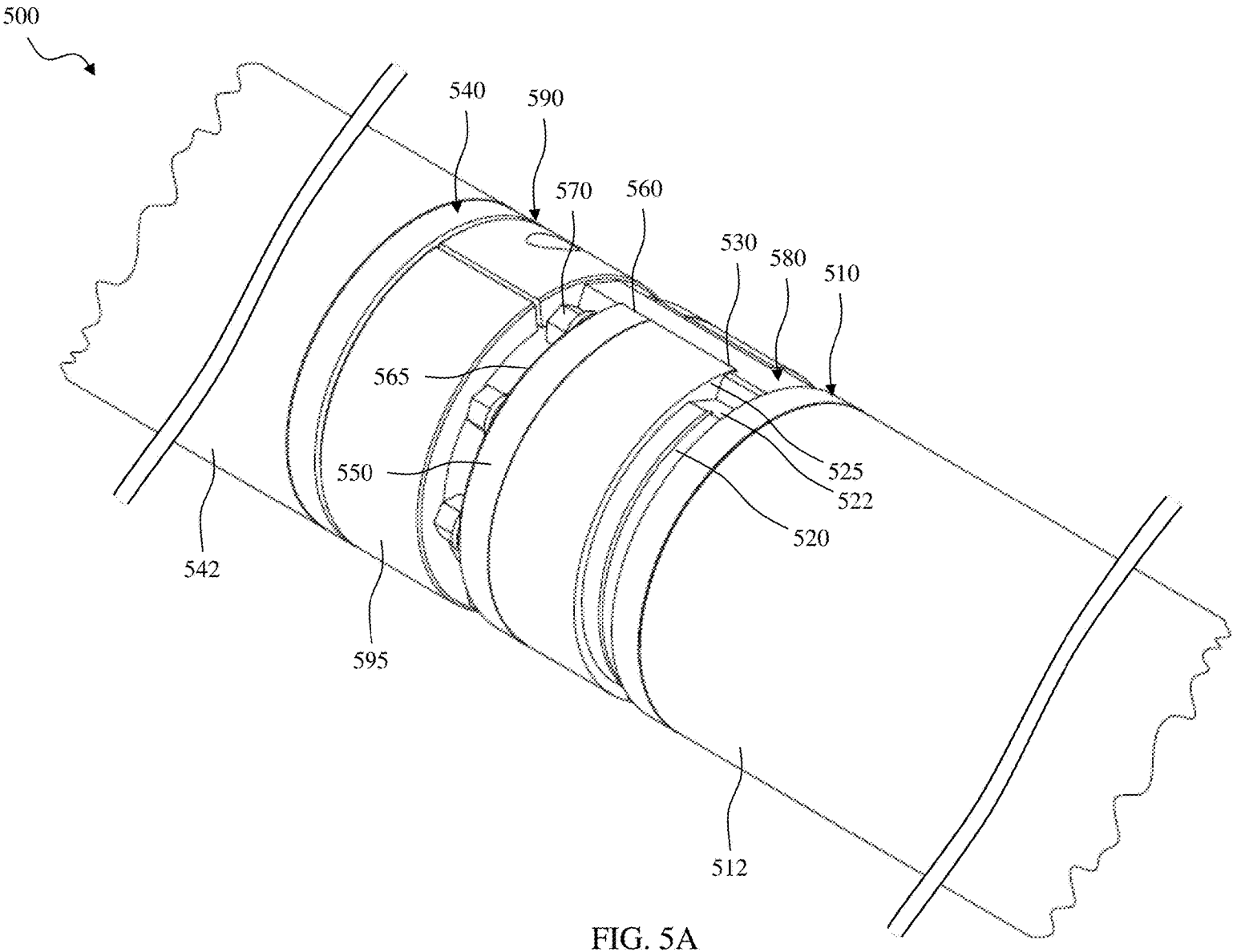
Figure 5B:
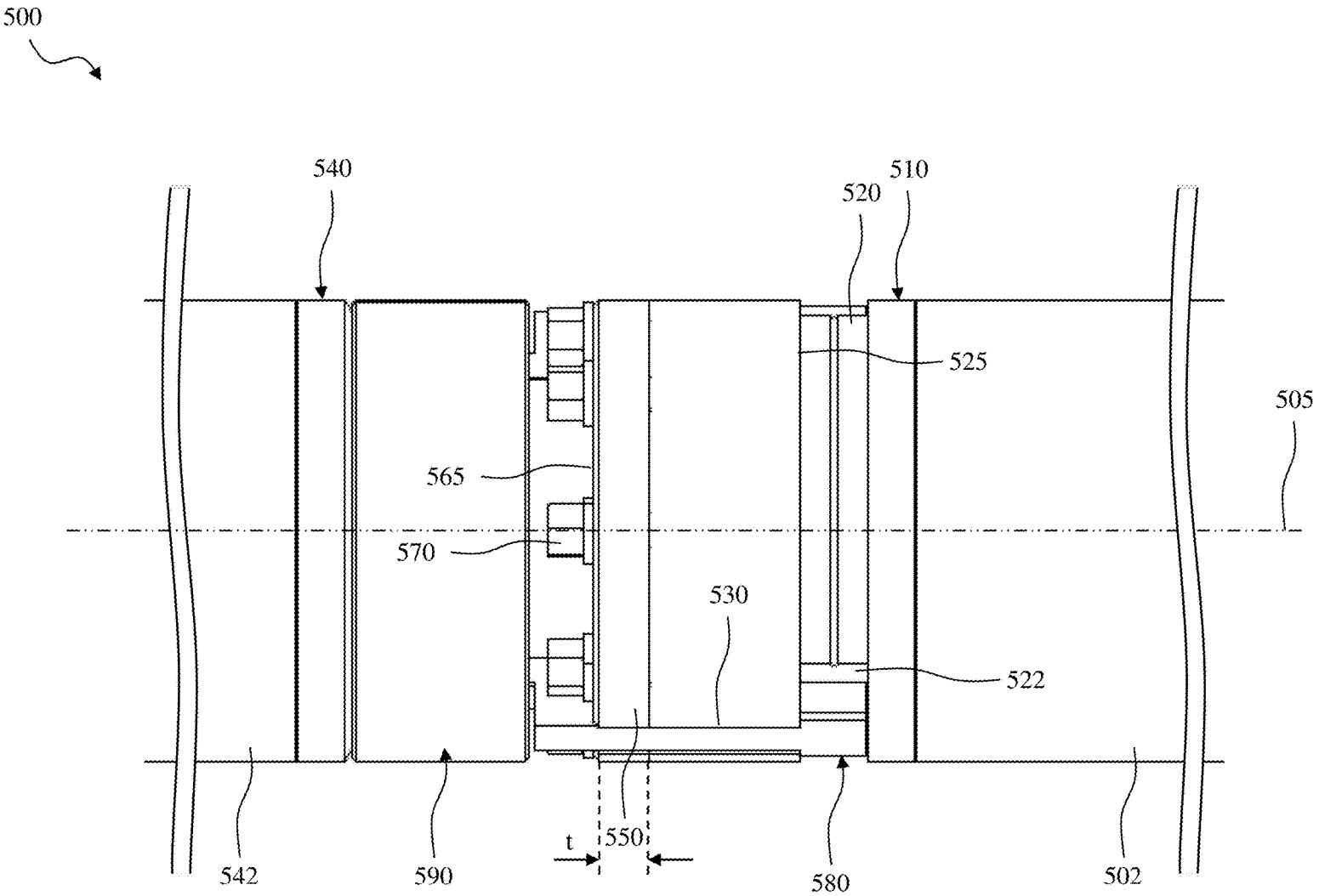
Figure 5C:
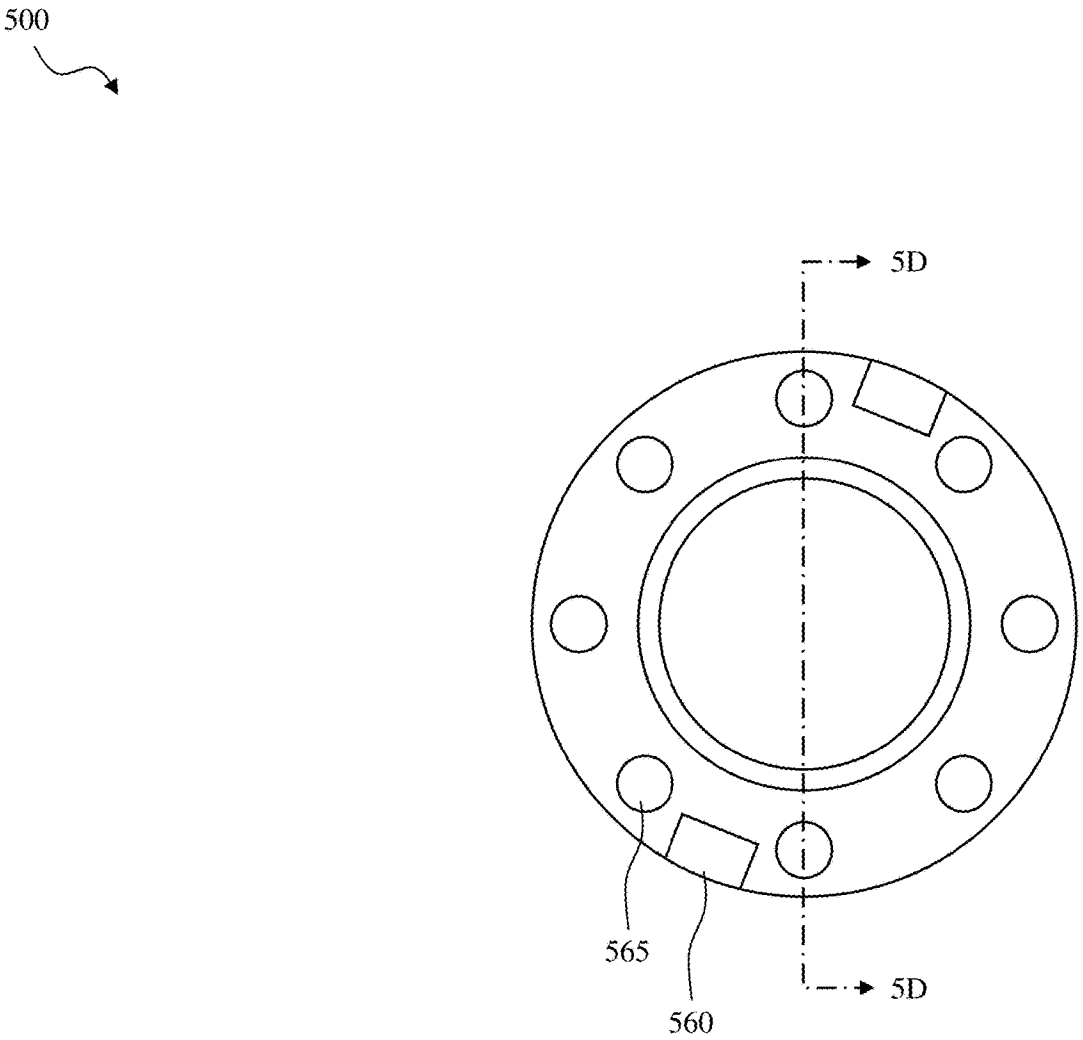
Figure 5D:
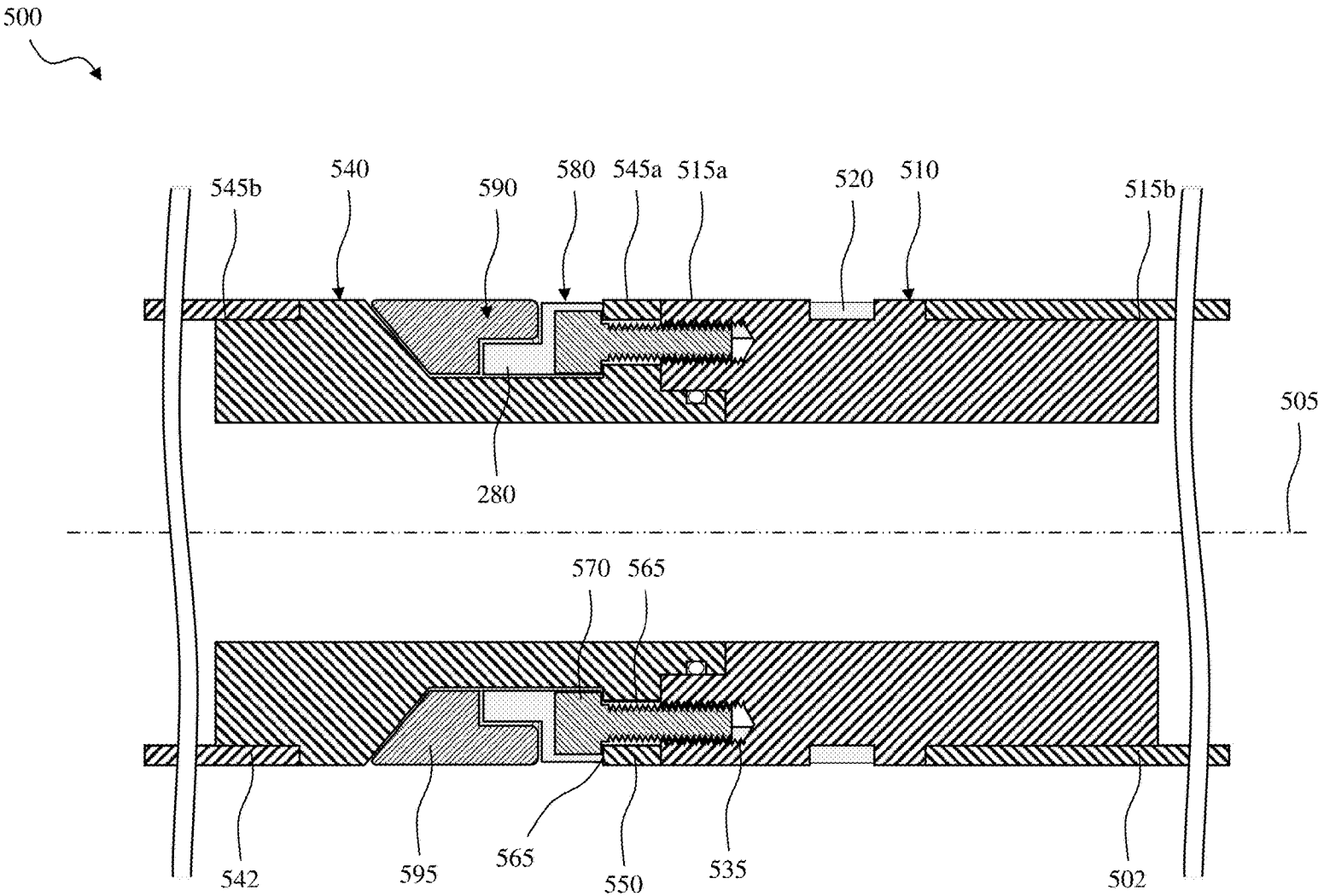
Figure 5E:
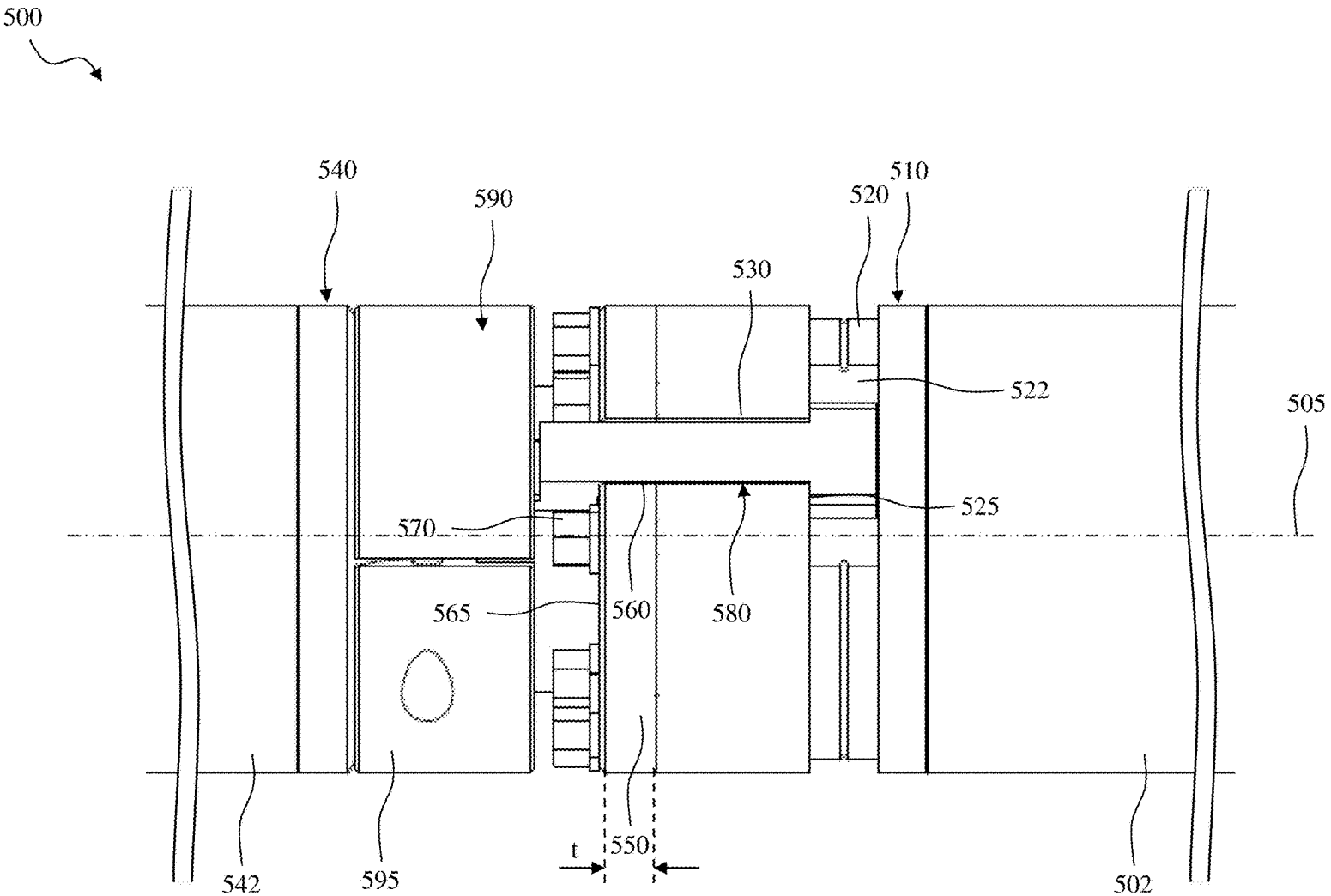
Figure 5G:
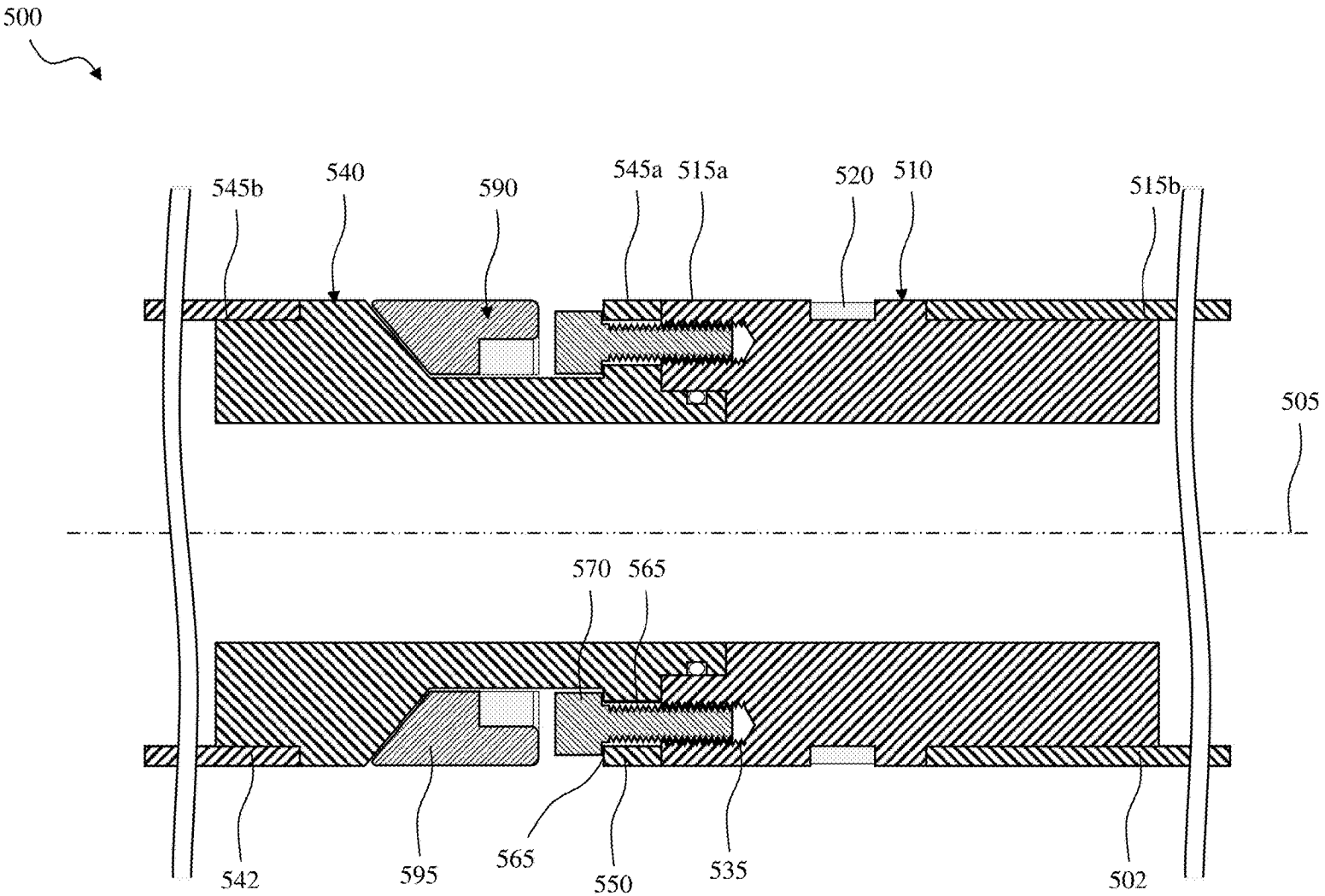
Figure 5H:
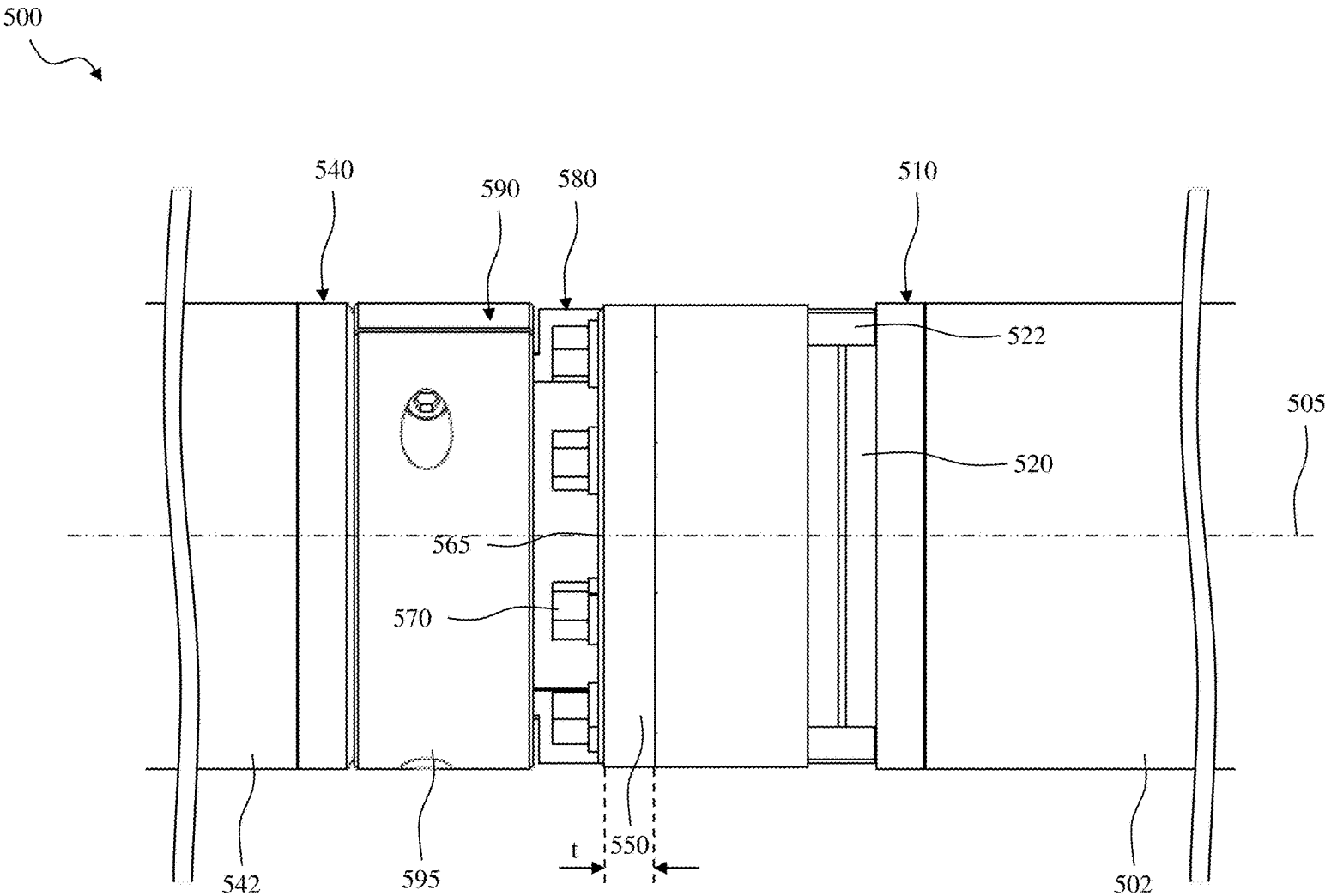
Figure 5I:
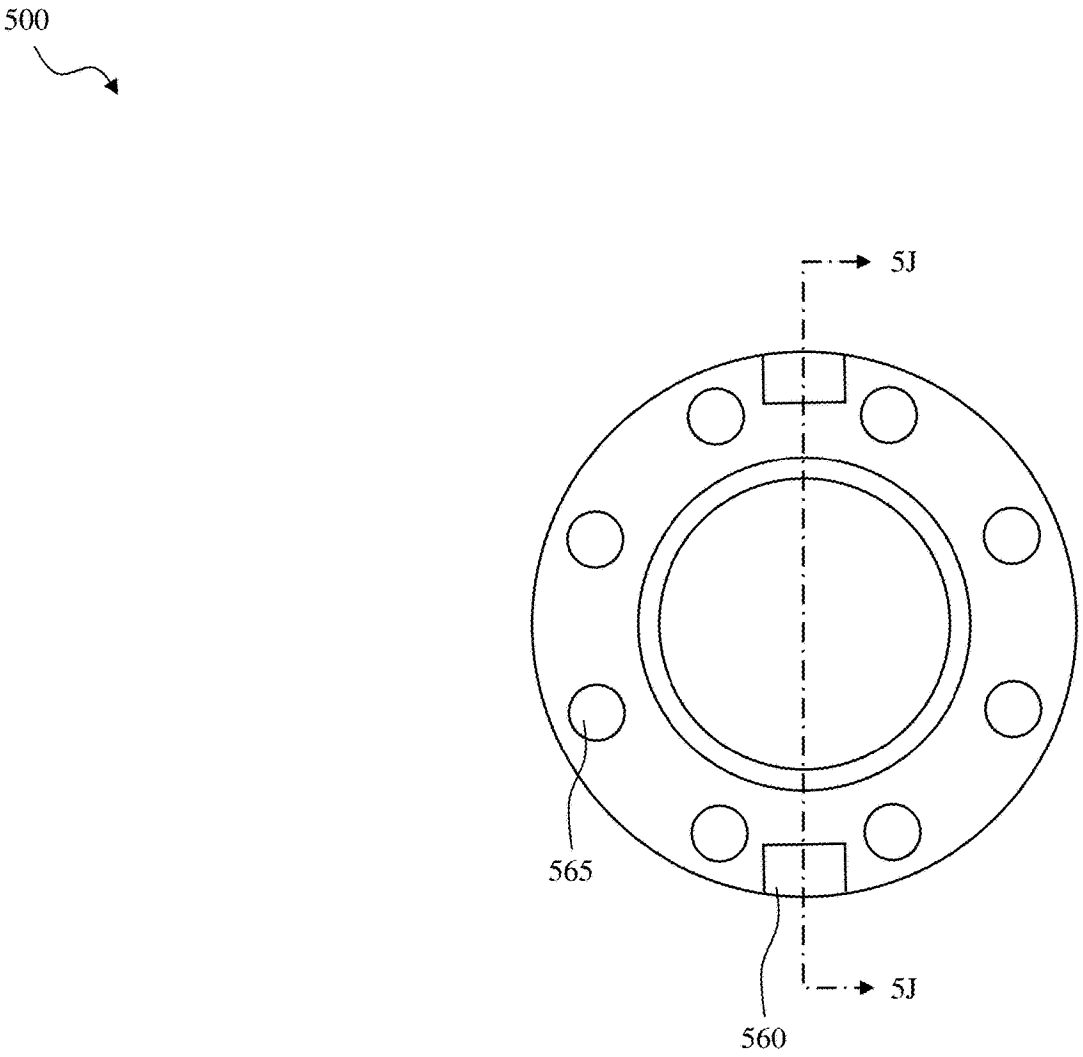
Figure 5J:
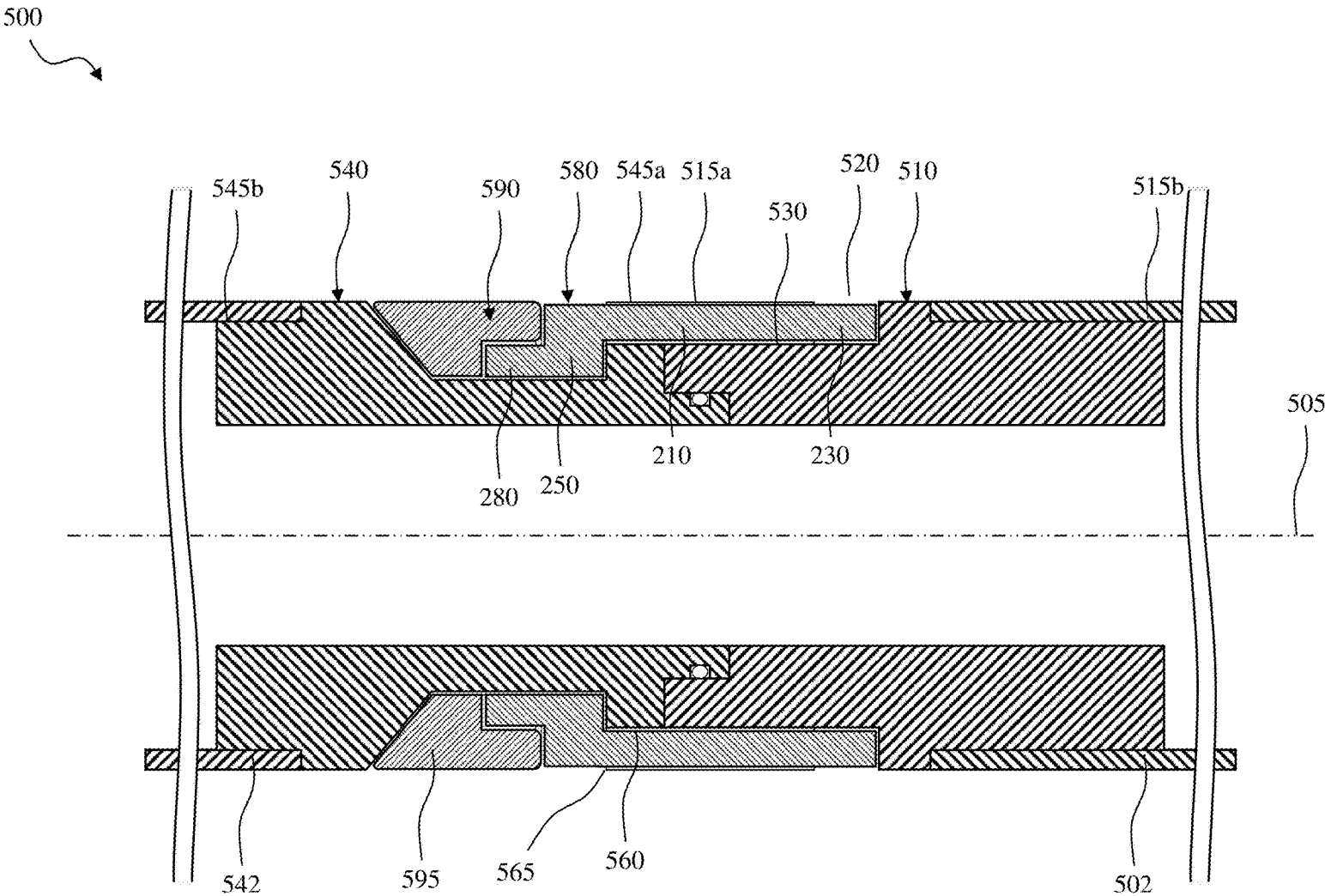
Figure 6A:
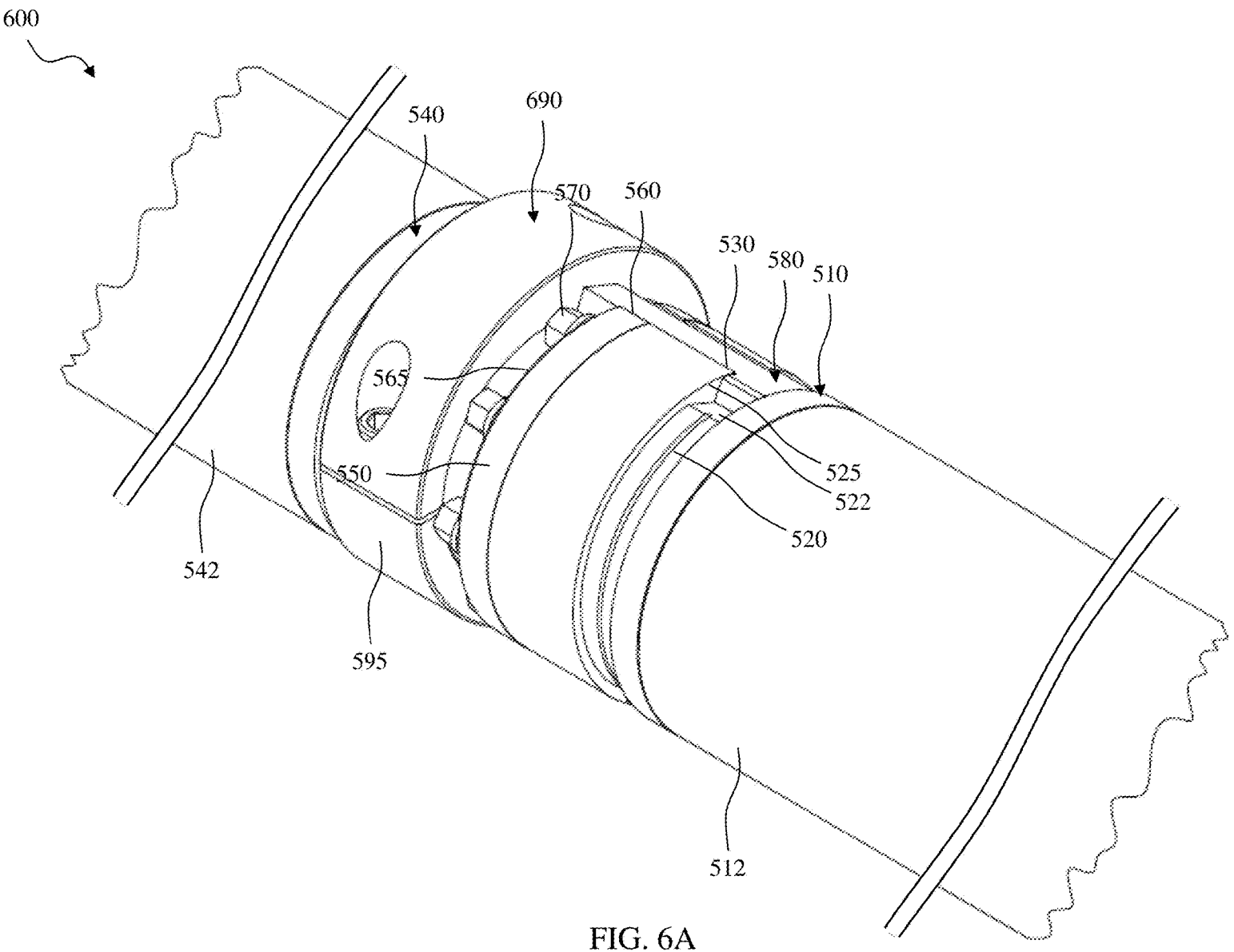
FIGS. 6A through 6J illustrate various different views of a downhole tool designed, manufactured and/or operated according to one or more alternative embodiments of the disclosure.
Figure 6B:
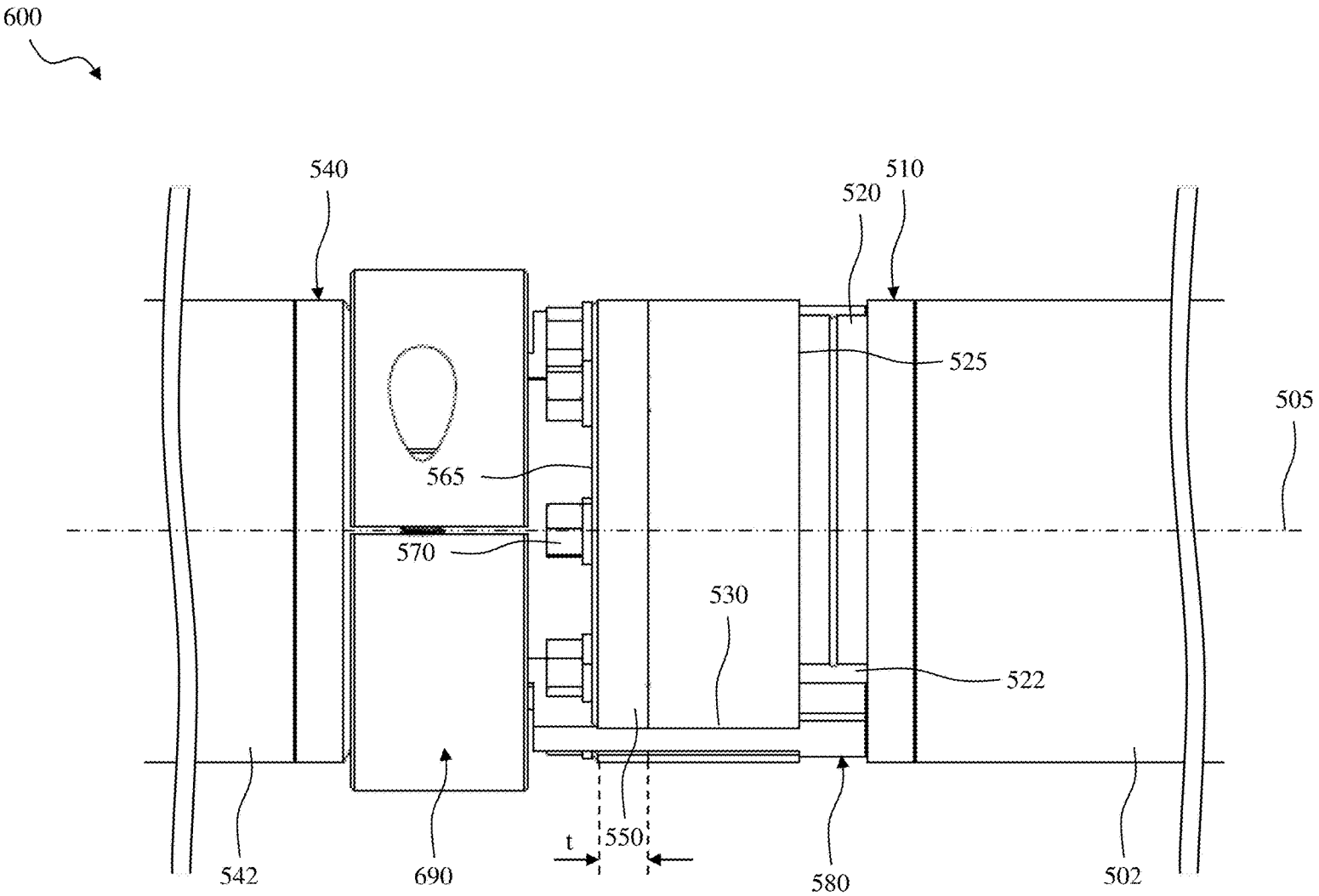
Figure 6C:
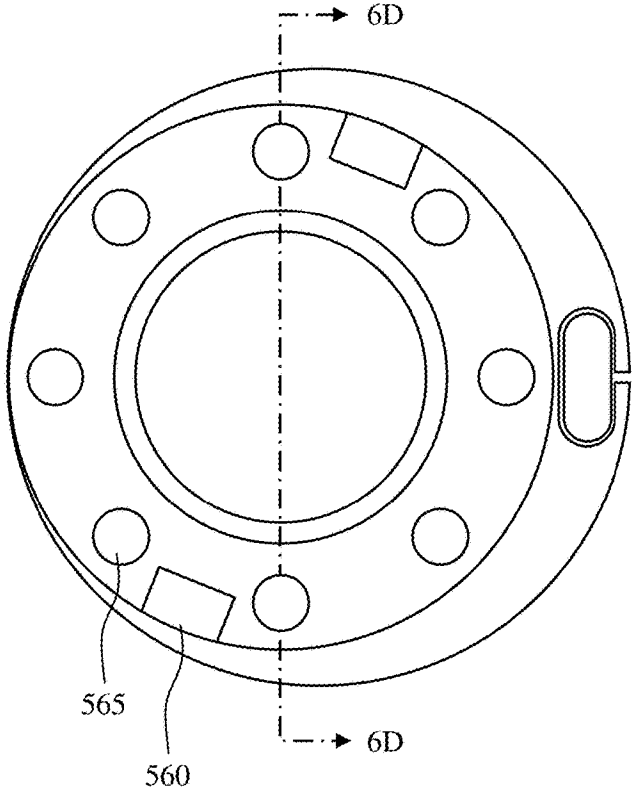
Figure 6D:
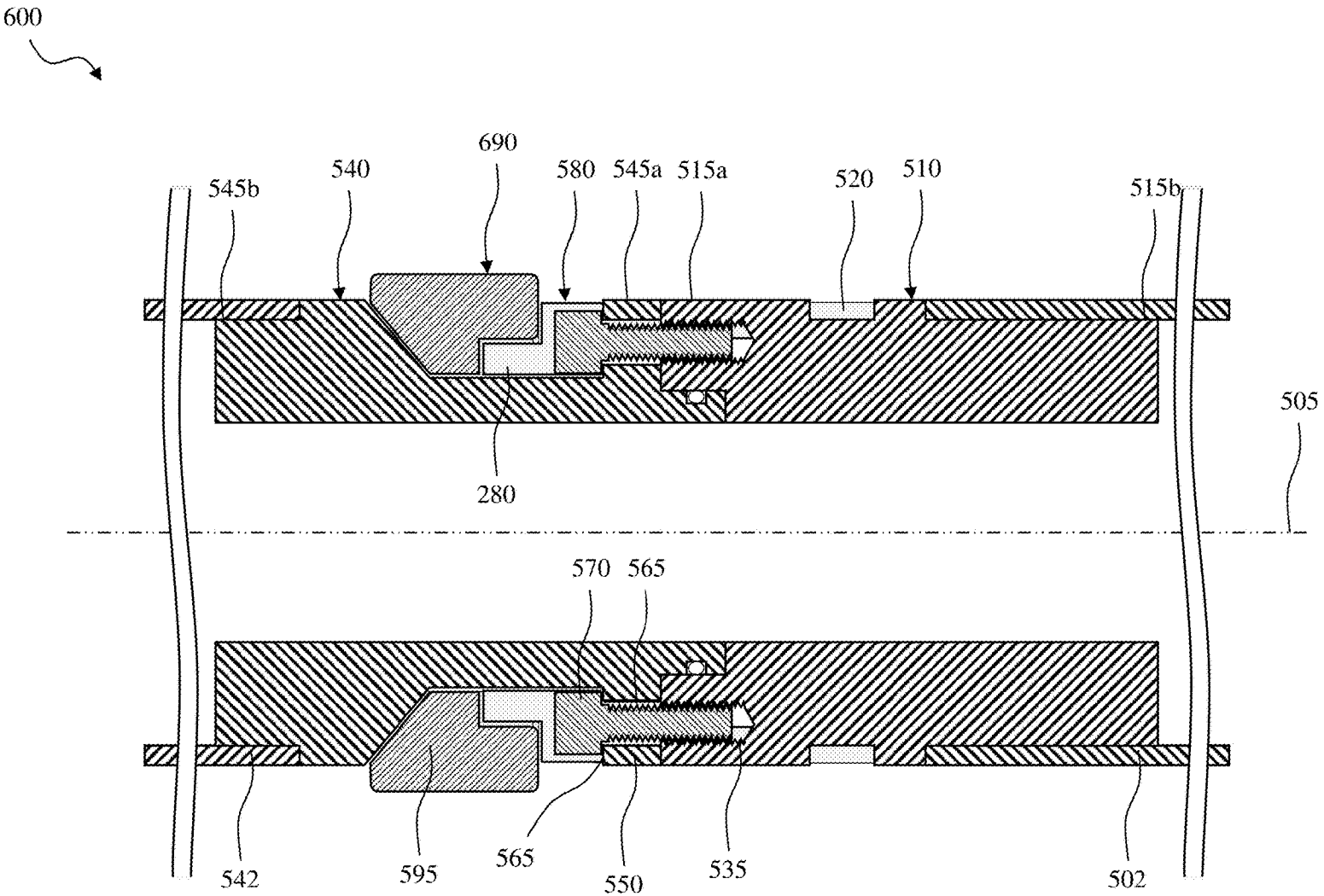
Figure 6E:
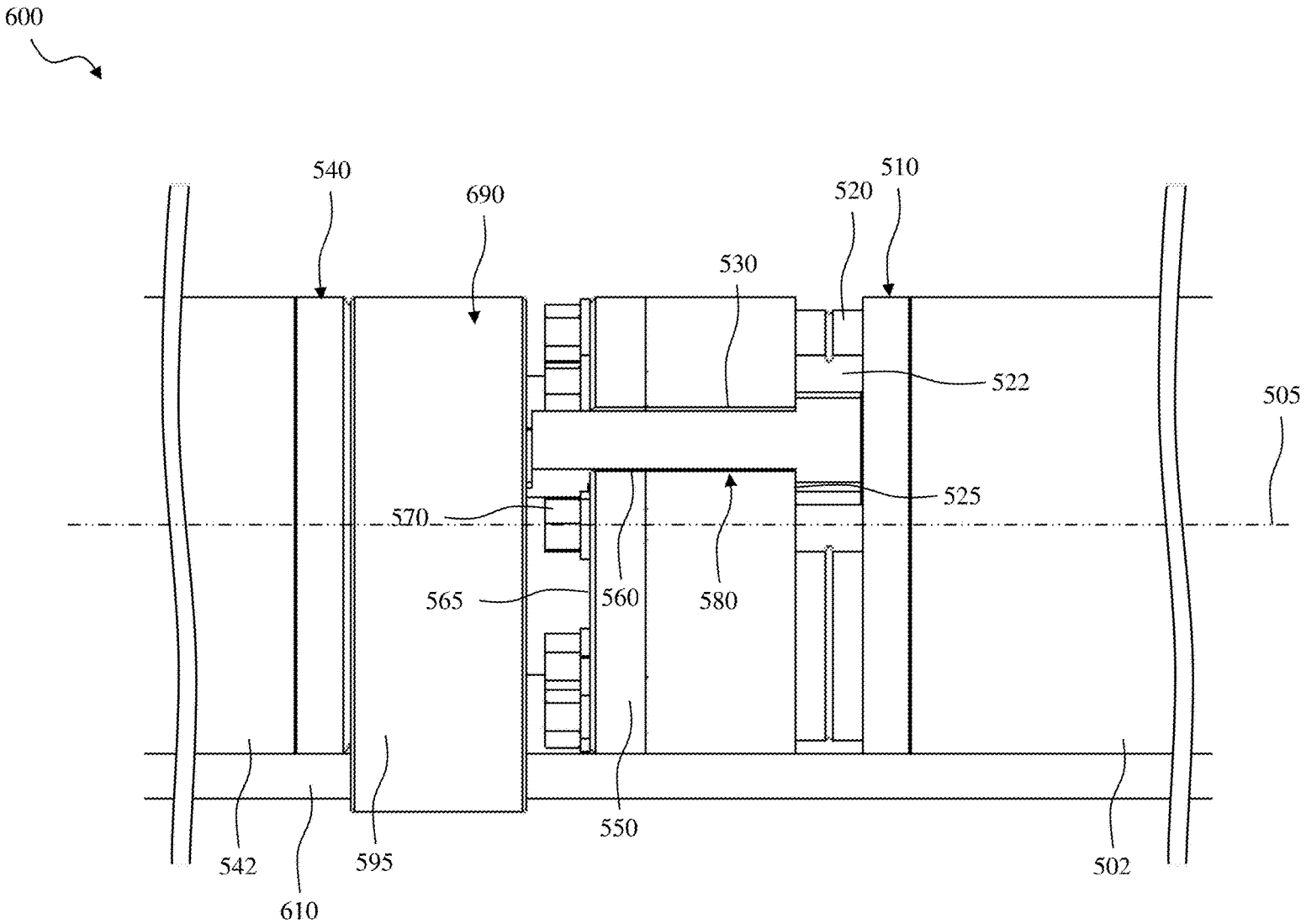
Figure 6F:
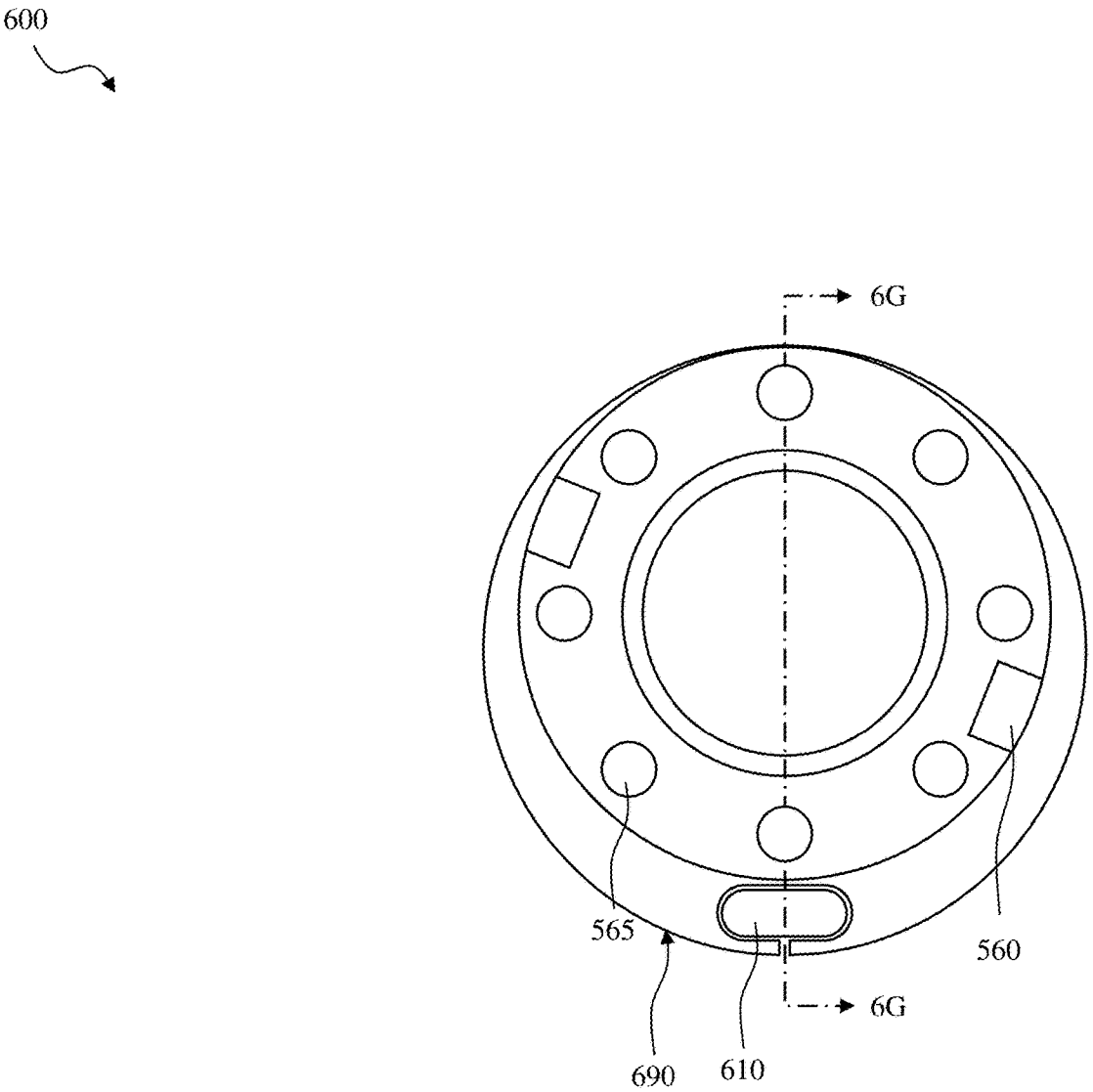
Figure 6G:
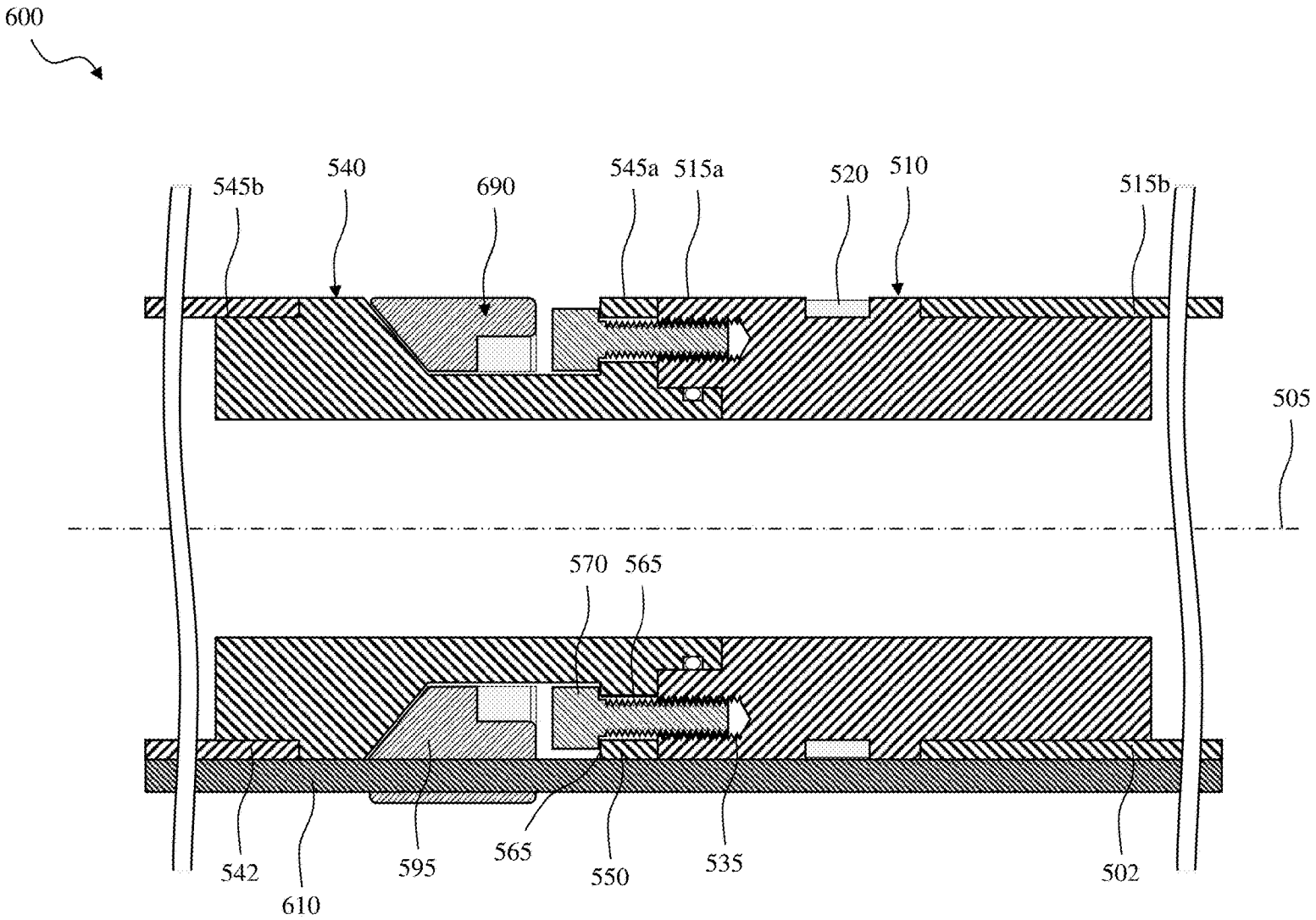
Figure 6H:
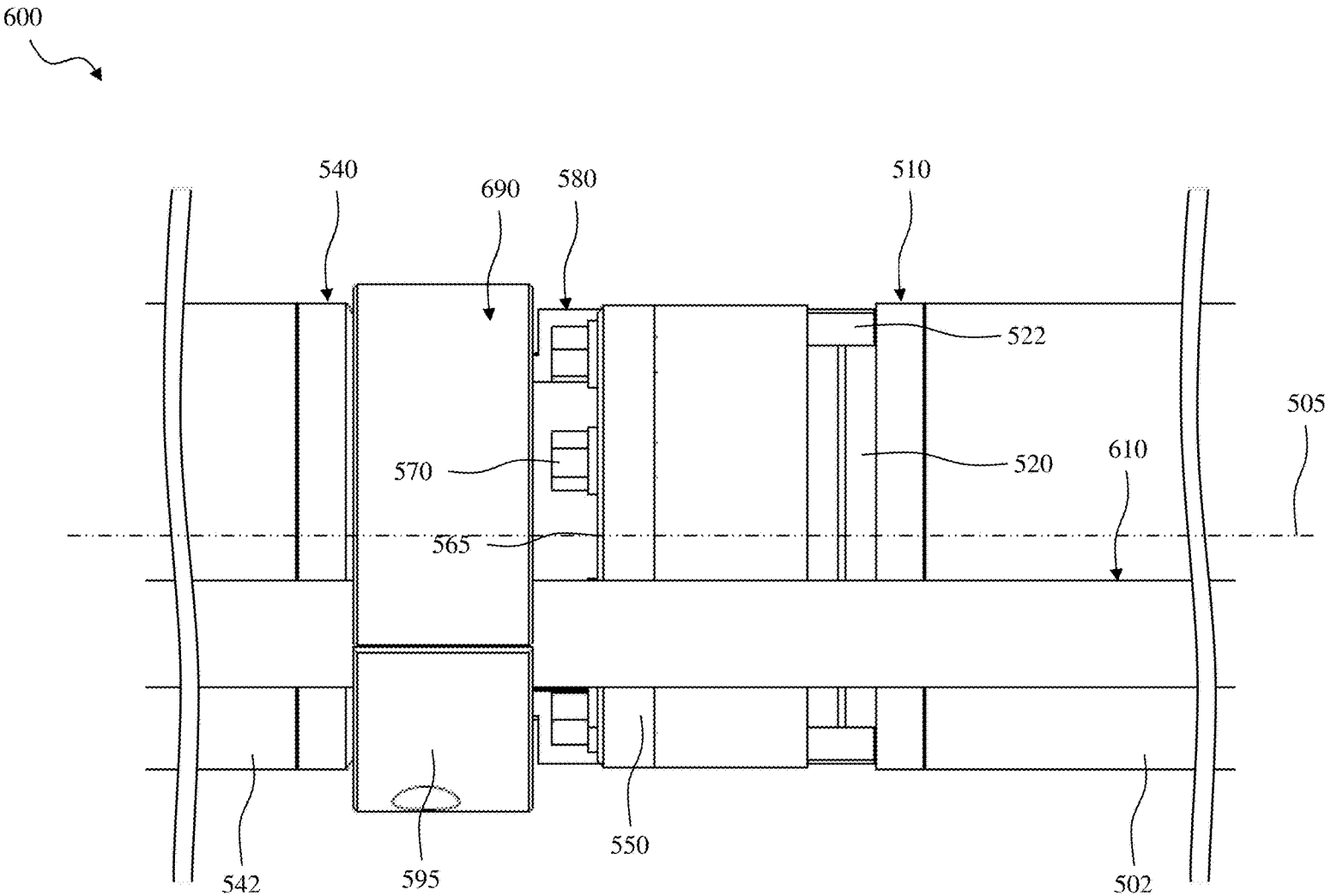
Figure 6I:
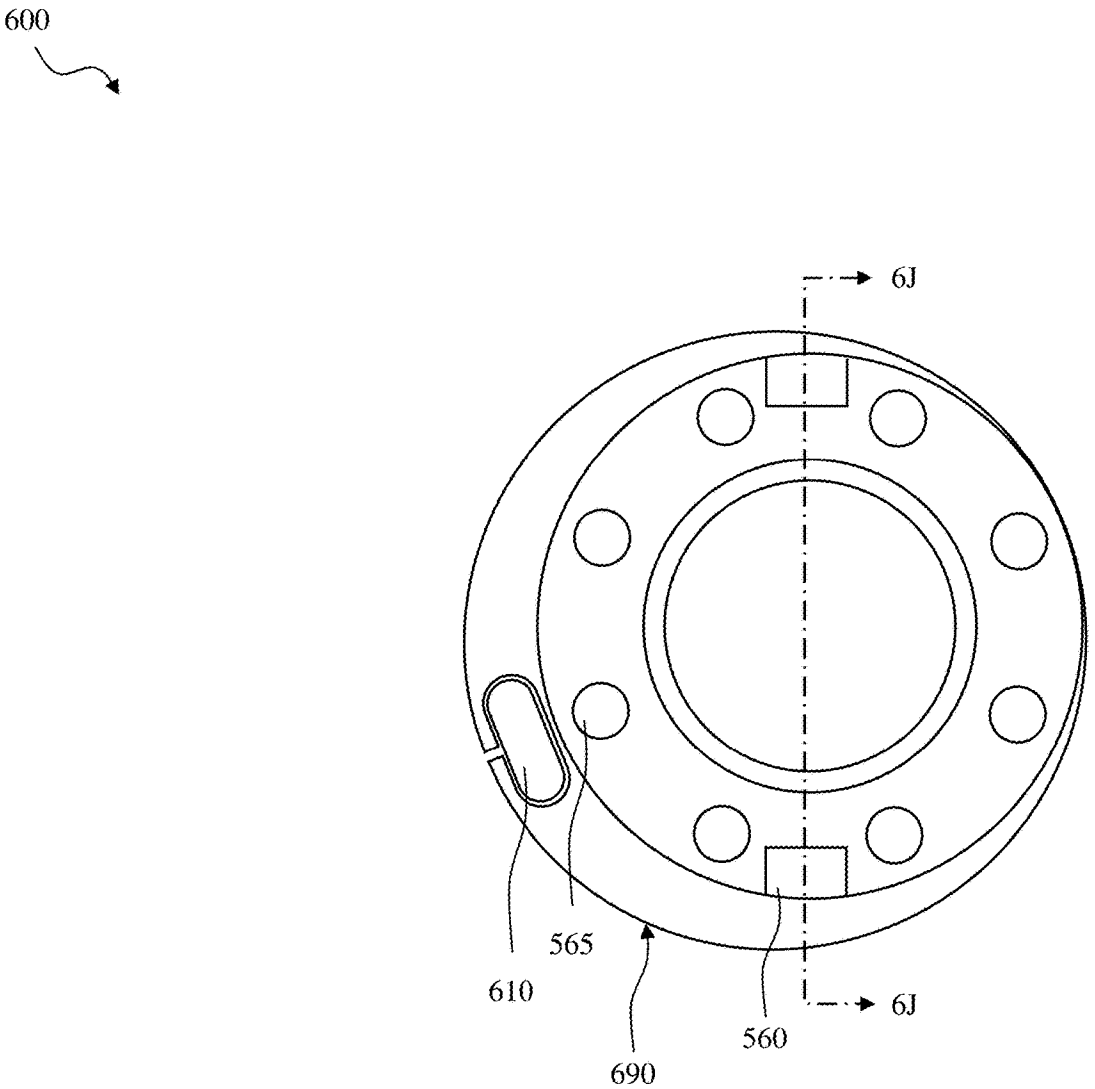
Figure 6J:
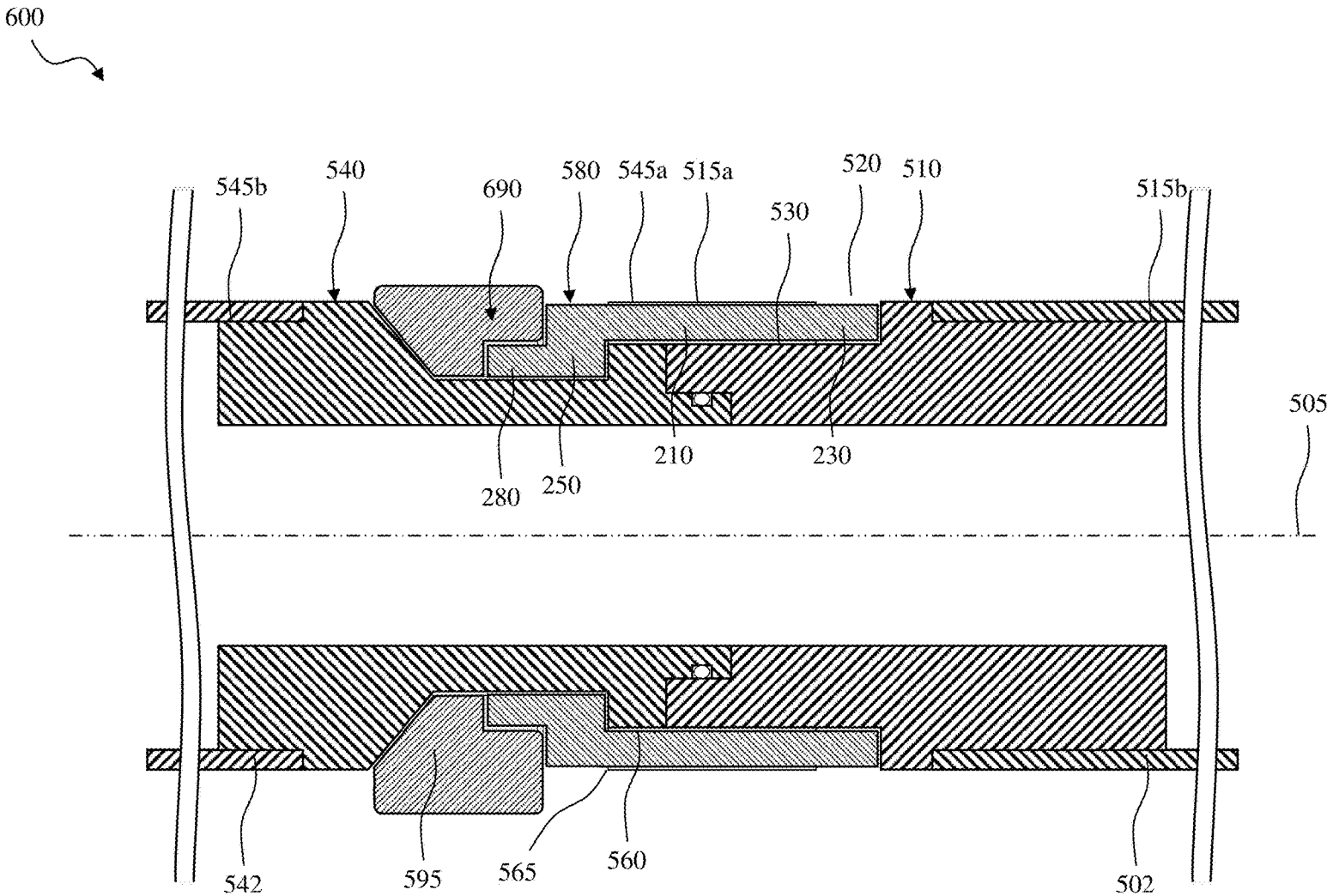
Figure 7A:
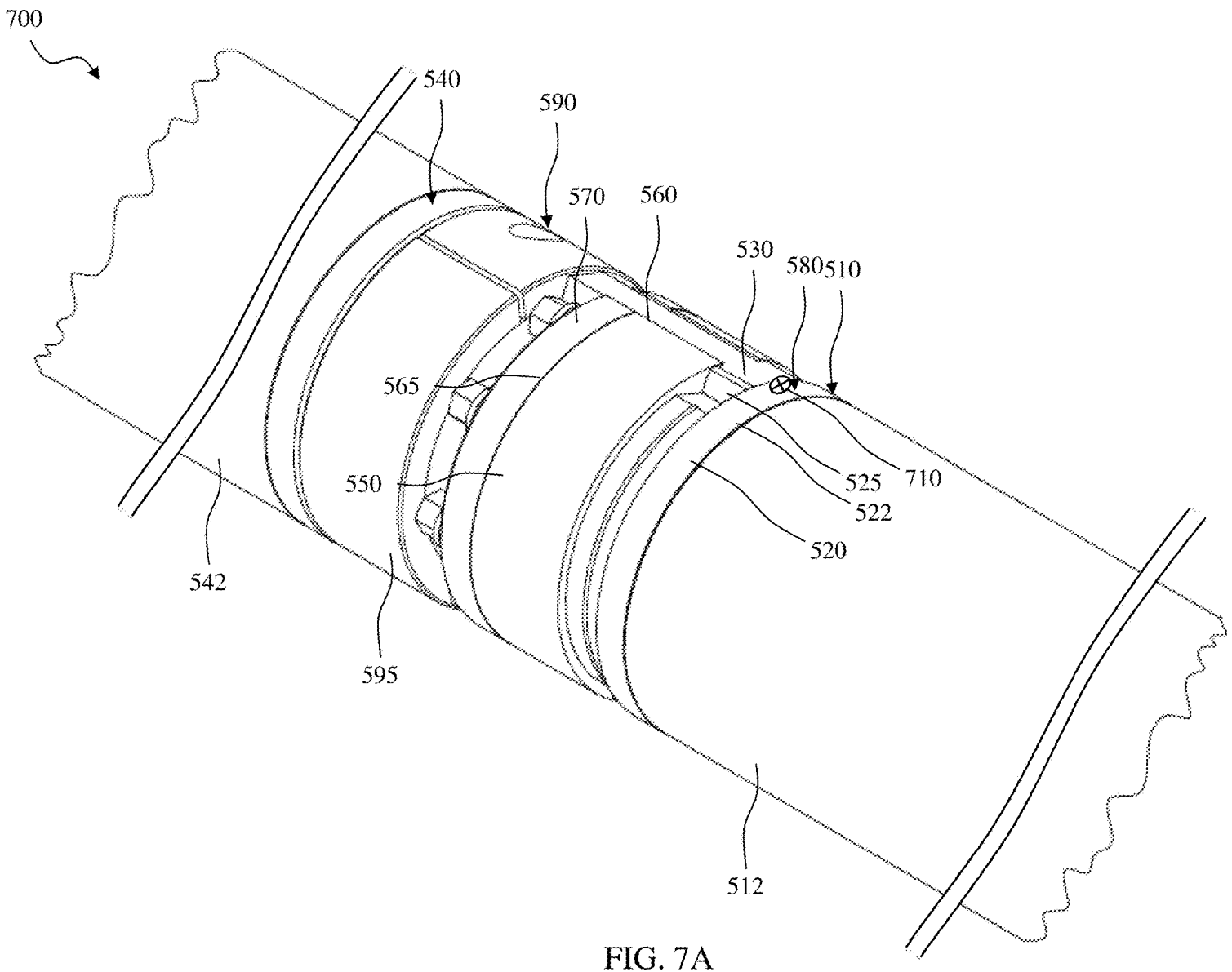
Figure 7B:
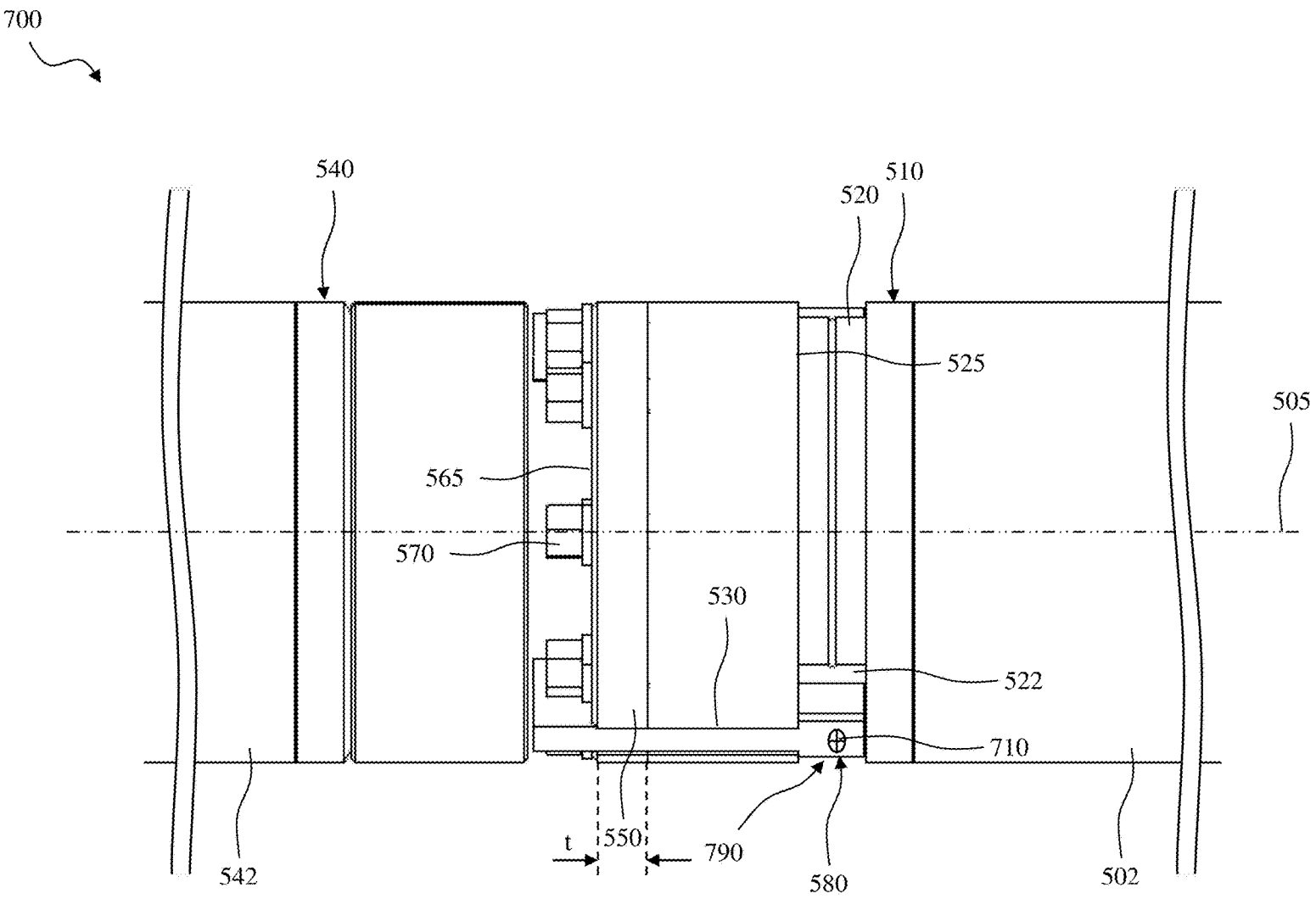
Figure 7C:
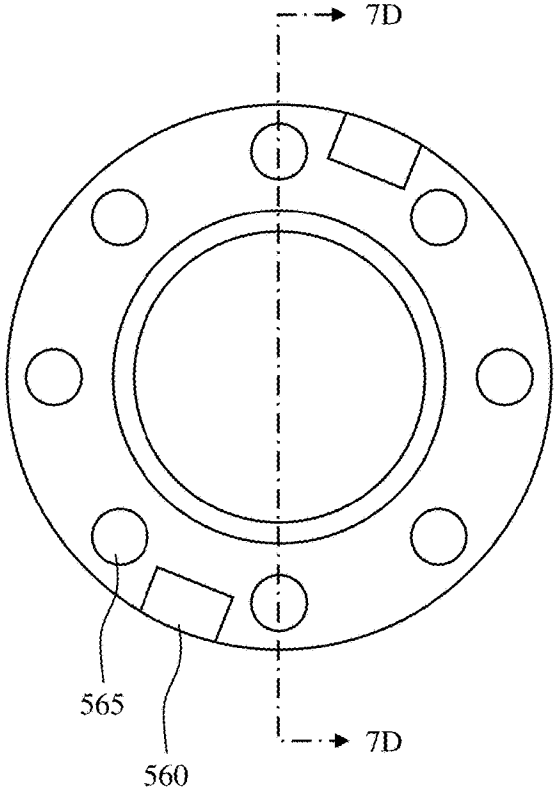
Figure 7D:
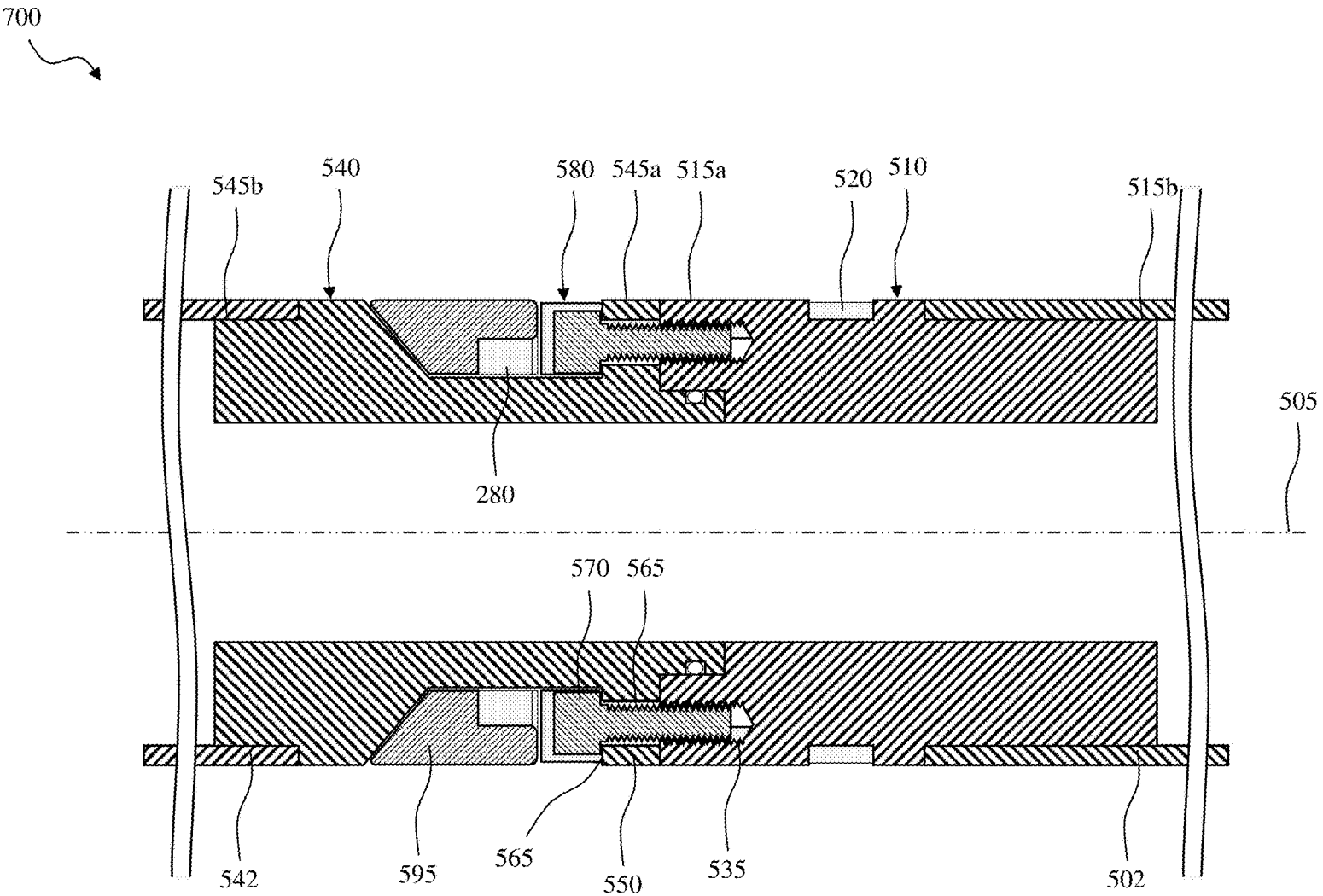
Figure 7E:
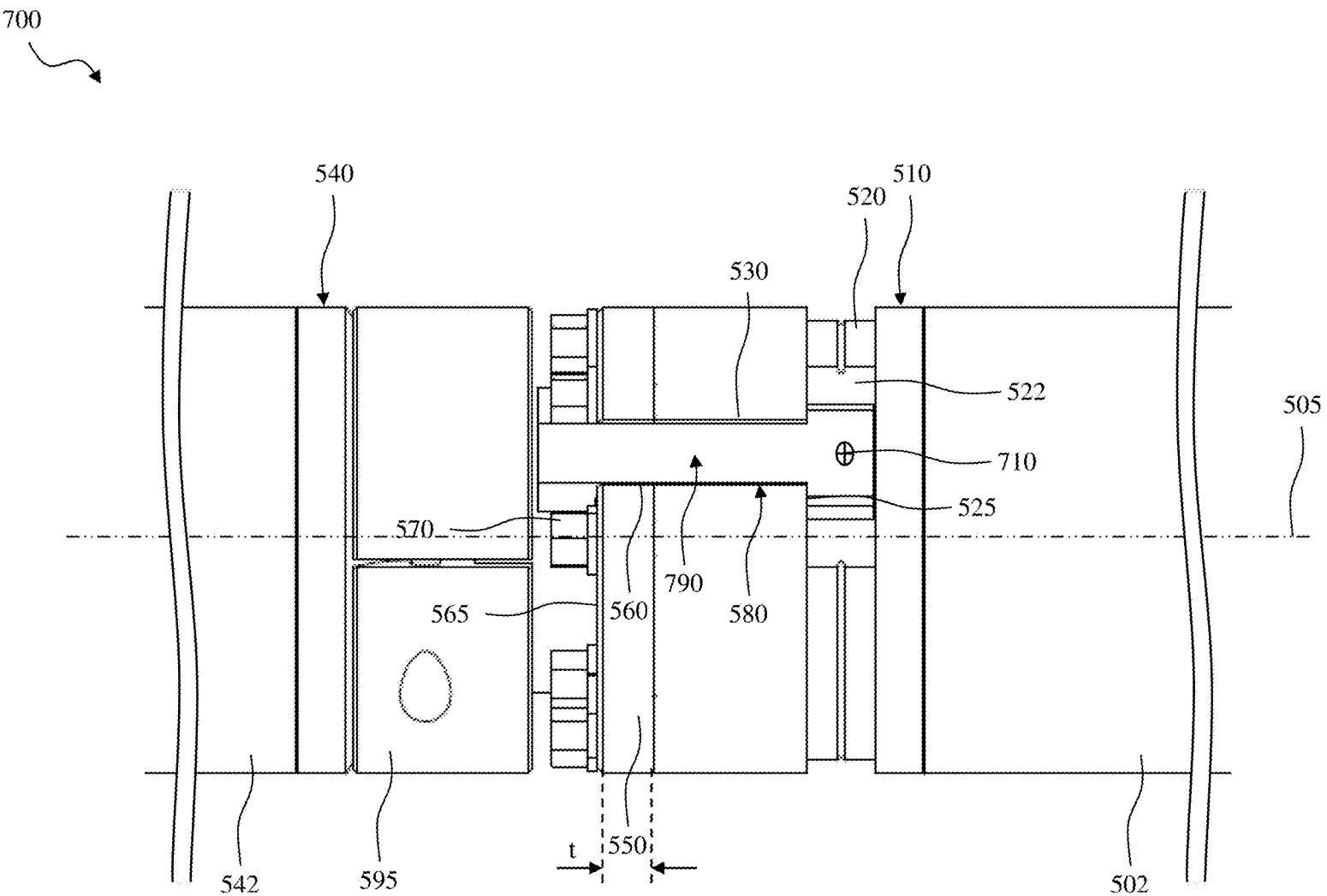
Figure 7F:
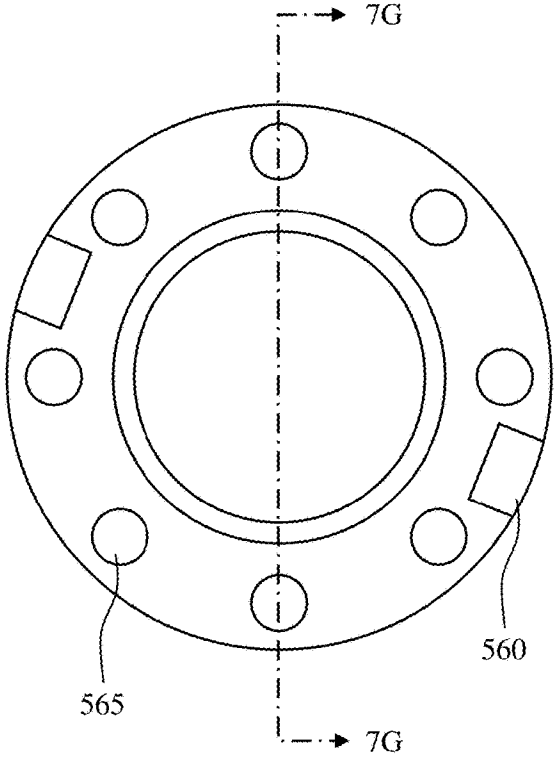
Figure 7G:
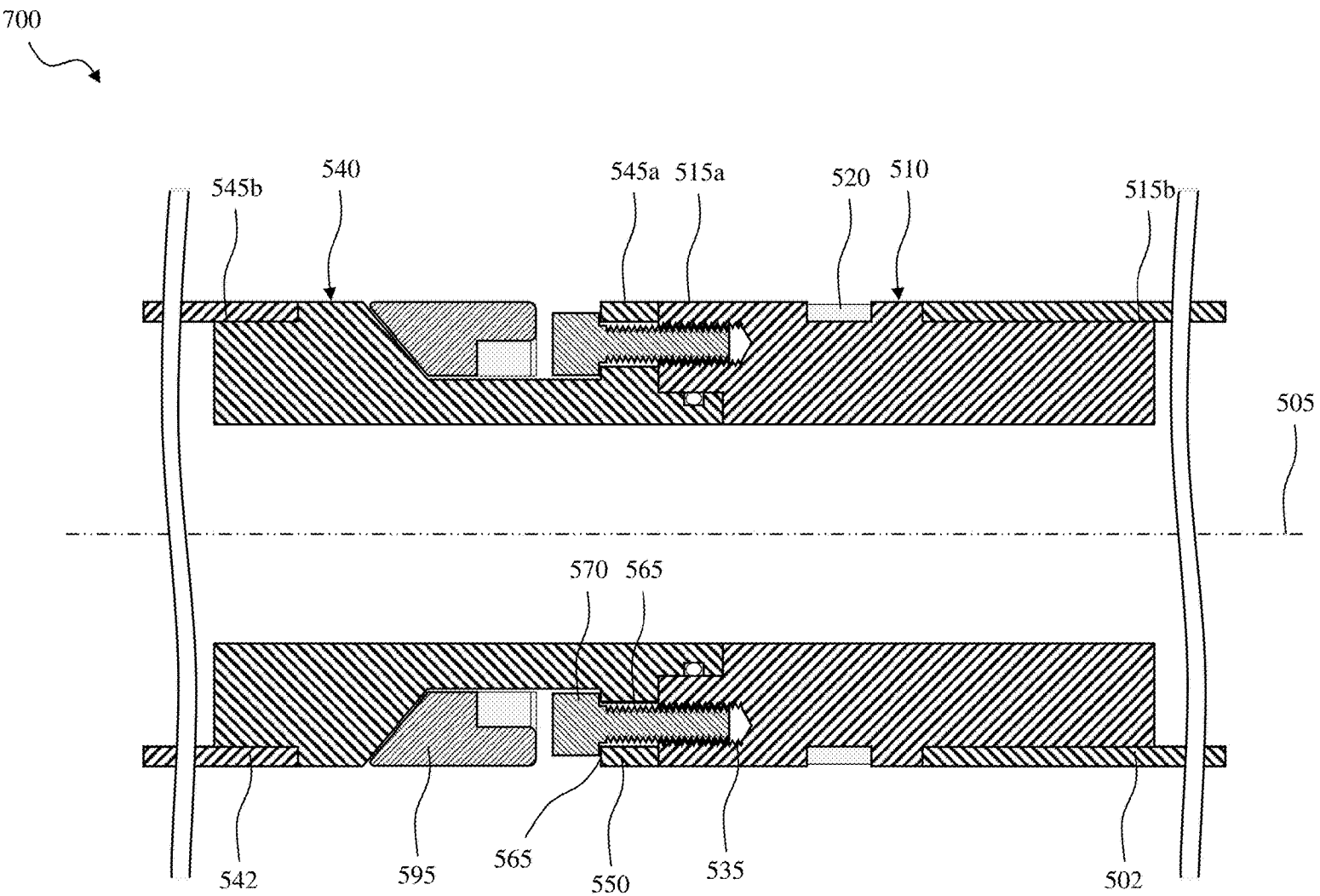
Figure 7H:
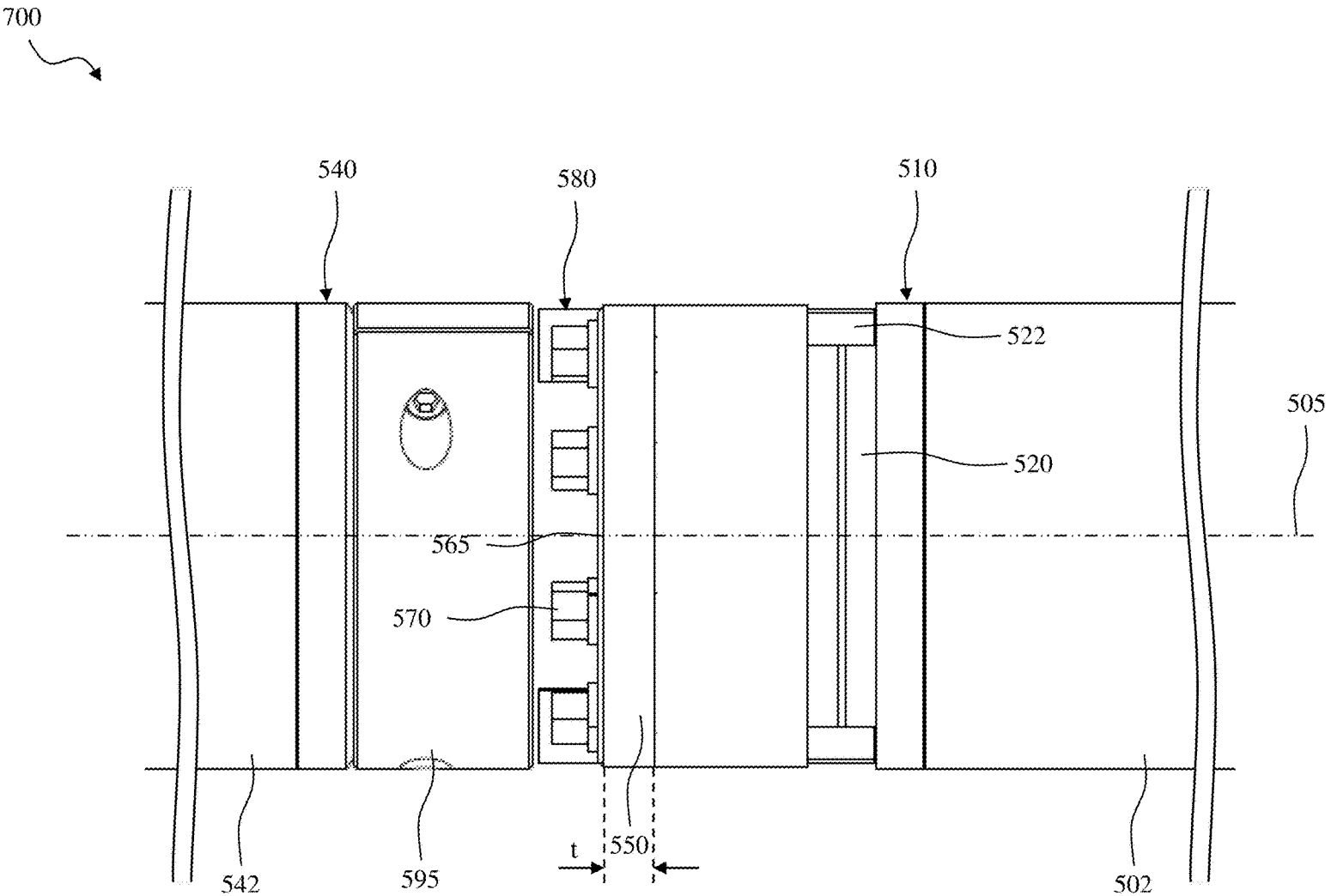
Figure 7I:
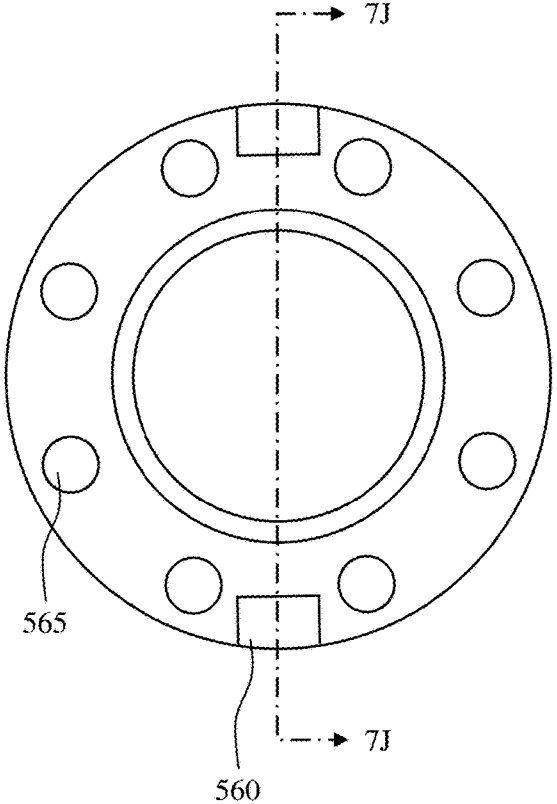
Figure 7J:
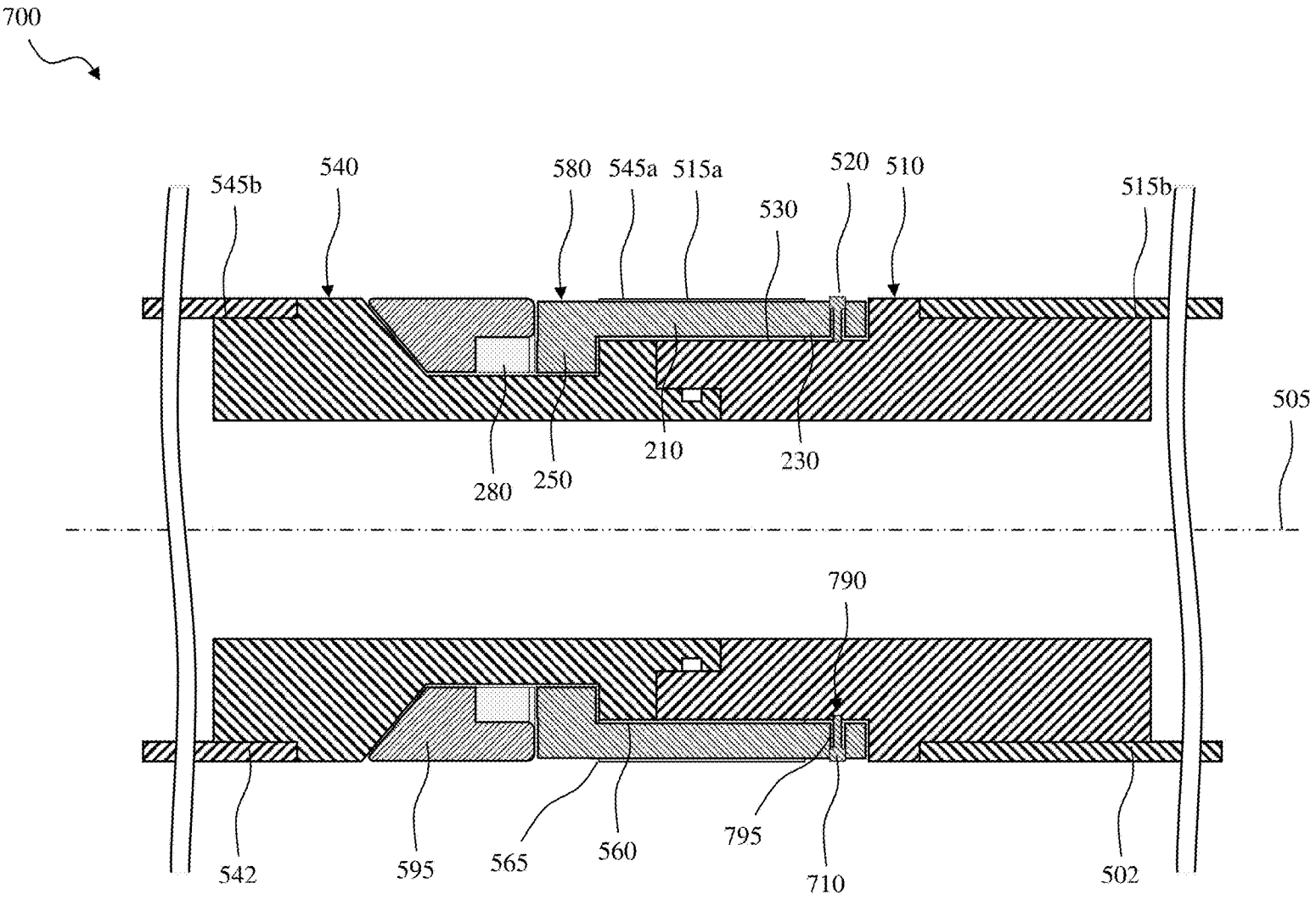

FIGS. 5A through 5J illustrate various different views of a downhole tool 500 designed, manufactured and/or operated according to one or more embodiments of the disclosure. FIG. 5A illustrates a perspective view of the downhole tool 500. FIGS. 5B, 5E and 5H illustrate various different side views of the downhole tool 500 at different rotational positions. FIGS. 5C, 5F, and 5I illustrate various different transverse cross-sectional views of the different side views of the downhole tool 500 of FIGS. 5B, 5E and 5H, respectively. FIGS. 5D, 5G and 5J illustrate various different axial cross-sectional views of the different transverse cross-sectional views of the downhole tool 500 of FIGS. 5C, 5F, and 5I, respectively. Each of the views illustrated in FIGS. 5A through 5J will be used to illustrate the various different features of the downhole tool 500.

The downhole tool 500, which in one embodiment may be a portion of a pump assembly (e.g., electric submersible pump assembly among other downhole tools), includes a head member 510 (e.g., downhole head member). The head member 510, in one or more embodiments, includes a first head member end 515*a* and a second head member end 515*b*. In at least one embodiment, the first head member end 515*a* is an uphole head member end, and the second head member end 515*b* is a downhole head member end.

The head member 510, in one or more embodiments, further includes a groove 520 located proximate the first head member end 515*a*. The term "proximate," as used herein, means that the groove 520 is located more proximate the first head member end 515*a* than the second head member end 515*b*. In at least one embodiment, however, the groove 520 is located less than 91 cm (e.g., approximately 36 inches) from the first head member end 515*a*. In yet another embodiment, the groove 520 is located from 2.54 cm (e.g., approximately 1 inch) to 30 cm (e.g., approximately 12 inches) from the first head member end 515*a*. In even yet another embodiment, the groove 520 is located from 5 cm (e.g., approximately 2 inches) to 15 cm (e.g., approximately 6 inches) from the first head member end 515*a*.

In the illustrated embodiment, the groove 520 extends at least partially around the head member 510 to form a head member shoulder 525. For example, in at least one embodiment, the groove 520 extends at least 90 degrees around the head member 510, if not at least 180 degrees around. For example, in at least one embodiment, the groove 520 is a 360 degree groove that exists in the head member for picking up, deploying, and retrieving the downhole tool. While the embodiment of FIGS. 5A through 5J employs a rectangular cross-sectional groove 520, other embodiments exist wherein the groove 520 has a non-rectangular cross-sectional shape (e.g., circular, oval, etc.). In one or more embodiments, the groove 520 has a flat section 522 proximate one or more locations where the coupling member is to be positioned. This flat section 522 may be used to increase the shear area of the head member shoulder 525 formed by the groove 520.

The head member 510, in one or more other embodiments, further includes a first axial slot 530 coupling the groove 520 and the first head member end 515*a*. As discussed above, the first axial slot 530, in one or more embodiments, is substantially parallel with a longitudinal axis 505 of the coupling member 500, if not significantly parallel with the longitudinal axis 505, if not ideally parallel with the longitudinal axis 505, if not perfectly parallel with the longitudinal axis 505. While the embodiment of FIGS. 5A through 5J employs a rectangular cross-sectional first axial slot 530, other embodiments exist wherein the first axial slot 530 has a non-rectangular cross-section (e.g., circular, oval, etc.). In at least one embodiment, the first axial slot 530 substantially aligns with the aforementioned flat section 522 of the groove 520.

The head member 510 has been discussed above as having a groove 520 (e.g., single groove) and a first axial slot 530 (e.g., single first axial slot 530). Yet in certain embodiments, the head member 510 might have a plurality of first axial slots 530 (e.g., two, three, four, five, six or more first axial slots 530) and a plurality of grooves 520. In yet another embodiment, the head member 510 might have a plurality of first axial slots 530 (e.g., two, three, four, five, six or more first axial slots 530) and a single groove 520 that extends 360 degrees around the head member 510, such as shown in FIGS. 5A through 5J. Further to this embodiment, the single groove 520 could have a similar number of flat sections 522 as the number of first axial slots 530.

The downhole tool 500, in one or more embodiments, further includes a base member 540 (e.g., uphole base member 540). The base member 540, in at least one embodiment, includes a first base member end 545*a* (e.g., downhole end) and a second base member end 545*b* (e.g., uphole end). The base member 540, in accordance with one or more embodiments, may further include a flange 550 having a flange thickness (t) located at the first base member end 545*a*.

The base member 540, in at least one embodiment, may further include a second axial slot 560 extending through the flange thickness (t) to form a base member shoulder 565. While the embodiment of FIGS. 5A through 5J employs a rectangular cross-sectional second axial slot 560, other embodiments exist wherein the second axial slot 560 has a non-rectangular cross-sectional shape (e.g., circular, oval, etc.).

The base member 540 has been discussed above as having a second axial slot 560 (e.g., single second axial slot 560). Yet in certain embodiments, the base member 540 might have a plurality of second axial slots 560 (e.g., two, three, four, five, six or more second axial slots 560). In most scenarios, the base member 540 would have the same number of second axial slots 560 as the head member 510 has first axial slots 530. Accordingly, when the head member 510 and the base member 540 are brought together to form a flanged connection, the first axial slot(s) 530 and the second axial slot(s) 560 are substantially aligned with one another.

It should be noted that in one or more embodiments, the groove 520, the first axial slot 530 and/or the second axial slot 560 may be formed using any suitable manufacturing technique. For example, in at least one embodiment, the groove 520, the first axial slot 530 and the second axial slot 560 may be formed using a suitable milling technique. In yet another embodiment, the head member 510 and the base member 540 are cast having the groove 520, the first axial slot 530 and the second axial slot 560.

In at least one embodiment, one or more threaded openings 535 are formed in the first head member end 515*a* of the head member 510. In at least this one embodiment, one or more corresponding holes 568 are formed through the flange thickness (t) of the flange 550 of the base member 540. In at least this one embodiment, one or more threaded fasteners 570 extend through the one or more holes 568 of the flange 550 and into the one or more threaded openings 535 in the head member 510, to fix the head member 510 and the base member 540 together to form the flanged connection. In at least one embodiment, four or more threaded openings 535, four or more corresponding holes 568, and four or more threaded fasteners 570 are employed to fix the head member 510 and the base member 540 together to form the flanged connection.

The downhole tool 500 of FIGS. 5A through 5J additionally includes a coupling member 580 positioned within the first axial slot 530 and the second axial slot 560 to provide a coupling (e.g., a redundant coupling) for the flanged connection. The coupling member 580 may be similar to any one of the coupling members disclosed herein, including the coupling members 200, 300, and 400 discussed above. Accordingly, like reference numbers have been used to indicate similar, if not identical, features. In the embodiment of FIGS. 5A through 5J, the coupling member 580 is similar to the coupling member 200.

In accordance with this embodiment, the axial tension member portion 210 is located in and spans the first axial slot 530 and the second axial slot 560. Furthermore, the first shear member portion 230 is located in the groove 520, such that the first shear member shoulder 235 engages with the head member shoulder 525. Likewise, the second shear member portion 250 extends past the flange 550 to engage with the base member shoulder 565. The coupling member 580, when positioned as discussed, prevents the head member 510 and the base member 540 from axially moving relative to one another.

The downhole tool 500, in the illustrated embodiment of FIGS. 5A through 5J, additionally includes a coupling member retention mechanism 590 coupled to one of the axial tension member portion 210, the first shear member portion 230, or the second shear member portion 250. In the illustrated embodiment, the coupling member retention mechanism 590 is a retaining clamp 595 (e.g., C-clamp) engaged with the lip member 280 of the coupling member 200. In this embodiment, the retaining clamp 595 fixes the axial tension member portion 210 in the first axial slot 530 and the second axial slot 560. In the illustrated embodiment, a diameter of the coupling member retention mechanism 590 is no greater than a diameter of the head member 510 or base member 540.

The downhole tool 500, in the illustrated embodiment of FIGS. 5A through 5J, additionally includes a head member tubular 512 coupled to the head member 510 (e.g., threadingly coupled) and a base member tubular 542 coupled (e.g., threadingly coupled) to the base member 540. In one or more embodiments, the head member tubular 512 and the base member tubular 542 are thin walled tubulars, at least as compared to the head member 510 and the base member 540.

FIGS. 6A through 6J illustrate various different views of a downhole tool 600 designed, manufactured and/or operated according to one or more alternative embodiments of the disclosure. The downhole tool 600 of FIGS. 6A through 6J is similar in many respects to the downhole tool 500 of FIGS. 5A through 5J. Accordingly, like reference numbers have been used to indicate similar, if not identical, features. The downhole tool 600 differs, for the most part, from the downhole tool 500, in that the downhole tool 600 additionally includes an electric conductor 610, such as the illustrated mother lead extension (MLE). The electric conductor 610, in the illustrated embodiment, runs along an outside edge of the head member 510 and the base member 540. The downhole tool 600 further differs from the downhole tool 500, in that its coupling member retention mechanism 690 radially surrounds is electric conductor 610. In the illustrated embodiment, a diameter of the coupling member retention mechanism 590 is greater than a diameter of the head member 510 or base member 540.

FIGS. 7A through 7J illustrate various different views of a downhole tool 700 designed, manufactured and/or operated according to one or more alternative embodiments of the disclosure. The downhole tool 700 of FIGS. 7A through 7J is similar in many respects to the downhole tool 500 of FIGS. 5A through 5J. Accordingly, like reference numbers have been used to indicate similar, if not identical, features. The downhole tool 700 differs, for the most part, from the downhole tool 500, in that the downhole tool 700 employs an opening 795 extending through the axial tension member portion 210, the first shear member portion 230, or the second shear member portion 250 as its coupling member retention mechanism 790. For example, in the illustrated embodiment, the opening 795 is located in the first shear member portion 230, and the downhole tool 700 additionally includes a fastener 710 extending through the opening 795 in the first shear member portion 230 and into the head member 510, the fastener 710 fixing the axial tension member portion 210 in the first axial slot 530 and the second axial slot 560.

FIGS. 8A through 80 illustrate various different views of a downhole tool 800 designed, manufactured and/or operated according to one or more alternative embodiments of the disclosure at various different states of installation. FIGS. 8A, 8D, 8G, 8J, and 8M illustrate various different side views of the downhole tool 800. FIGS. 8B, 8E, 8H, 8K, and 8N illustrate cross-sectional views of the downhole tool 800 taken through the transverse cross-sectional view of FIG. 5F. Similarly, FIGS. 8C, 8F, 8I, 8L, and 8O illustrate cross-sectional views of the downhole tool 800 taken through the transverse cross-sectional view of FIG. 5I. The downhole tool 800 of FIGS. 8A through 8O is similar in many respects to the downhole tool 500 of FIGS. 5A through 5J. Accordingly, like reference numbers have been used to indicate similar, if not identical, features.

Figure 8B:
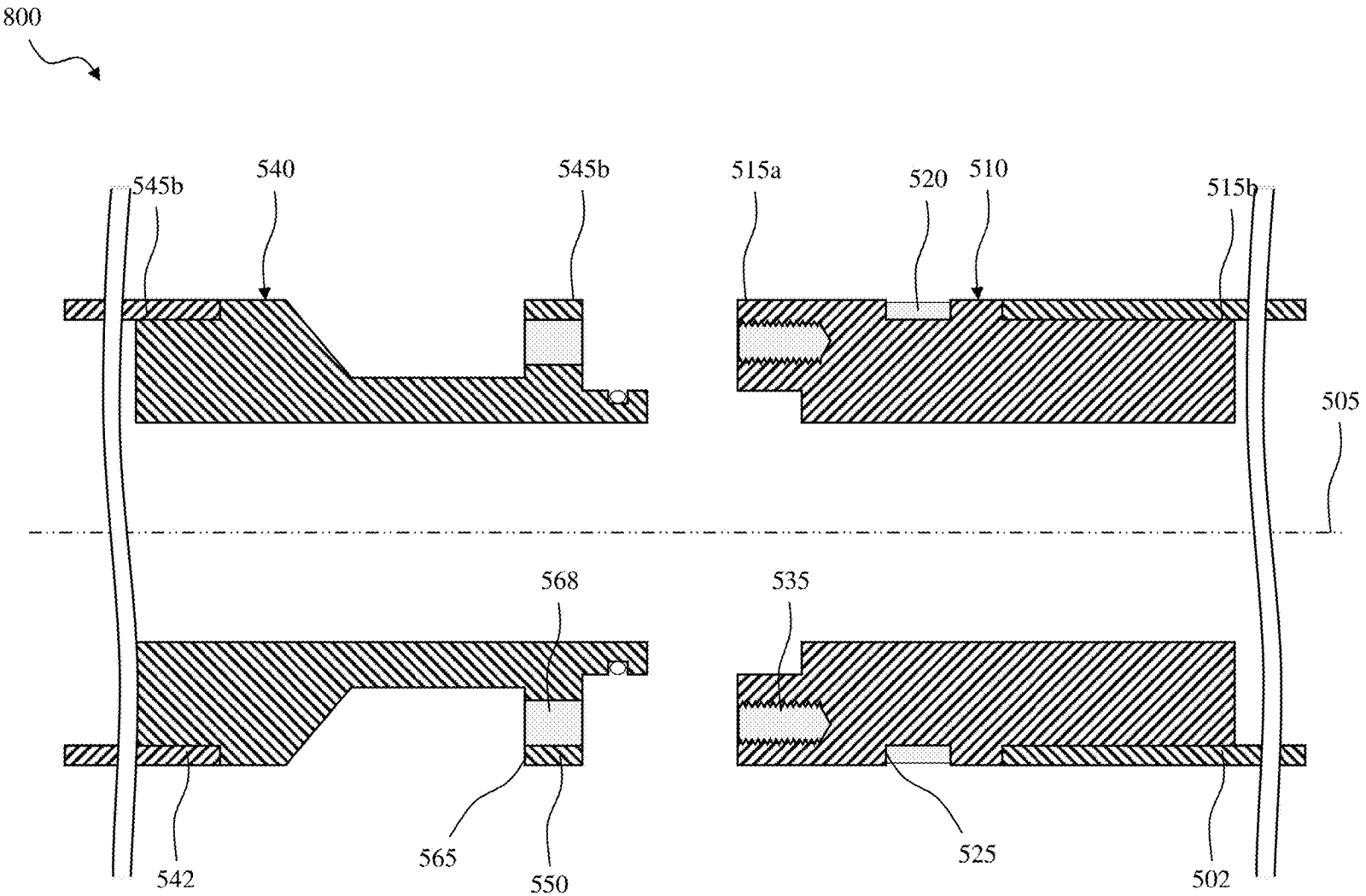
Figure 8C:
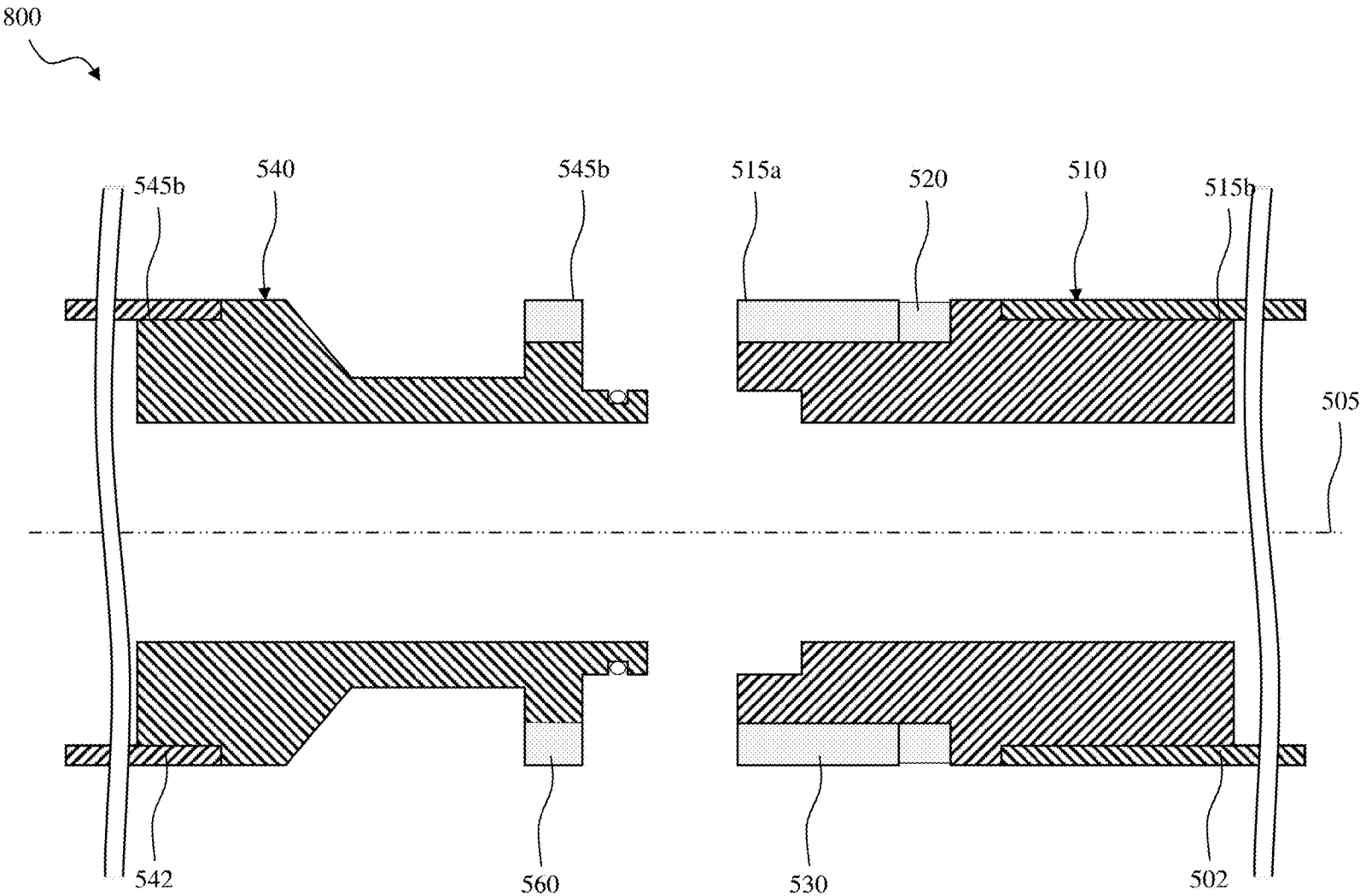

FIGS. 8A through 8C illustrate various different cross-sectional views of the downhole tool 800 at different rotational positions and at an initial stage of installation. In the illustrated embodiment of FIGS. 8A through 8C, the downhole tool 800 includes a head member 510 and a base member 540 that have yet to couple together. As shown, the head member 510 may have the first head member end 515*a* and the second head member end 515*b*, the groove 520, the head member shoulder 525, the first axial slot 530, and the one or more threaded openings 535. As shown, the base member 540 may have the first base member end 545*a* and the second base member end 545*b*, the flange 550, the second axial slot 560, the base member shoulder 565, and the one or more holes 568.

Figure 8D:
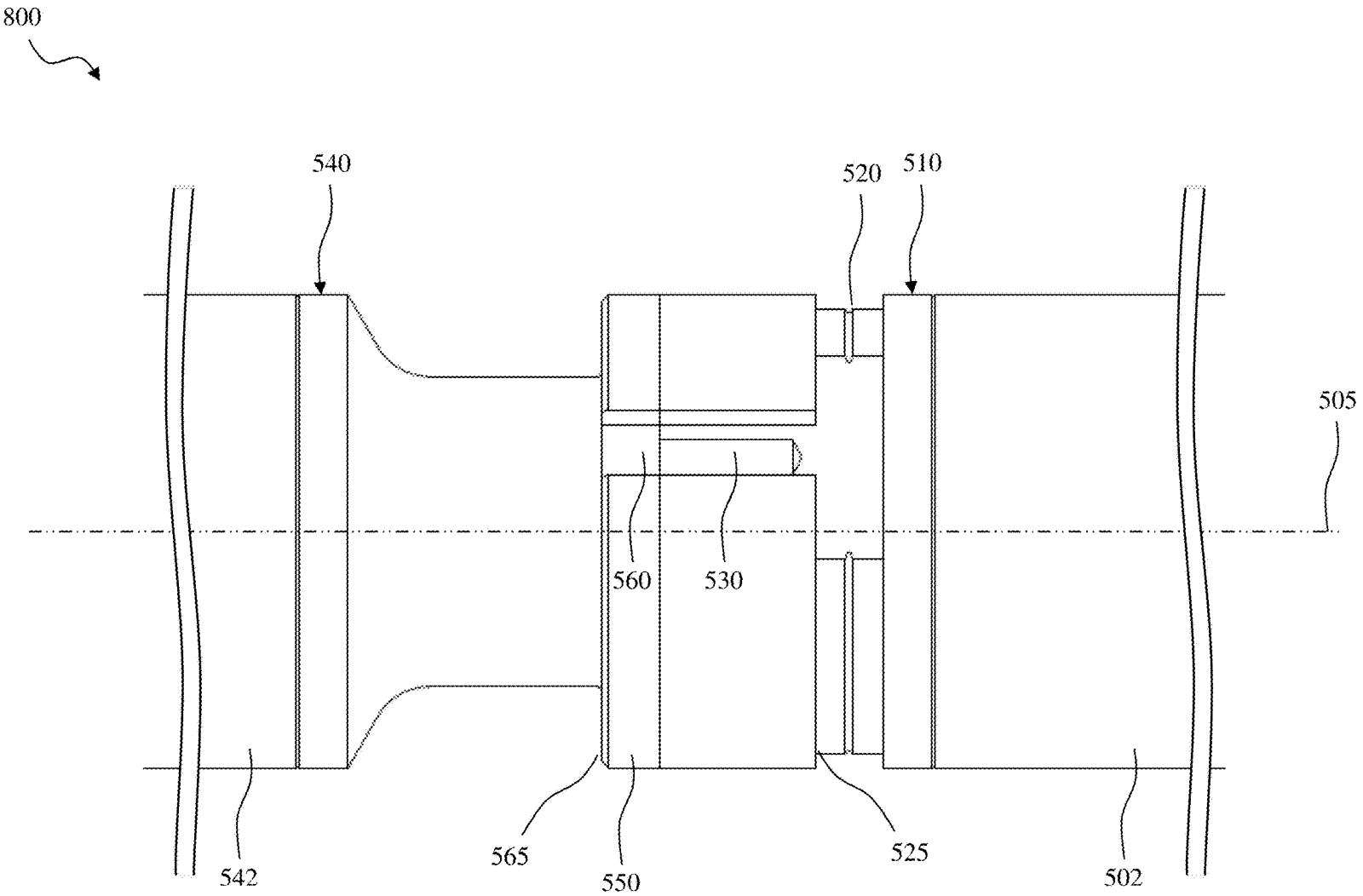
Figure 8E:
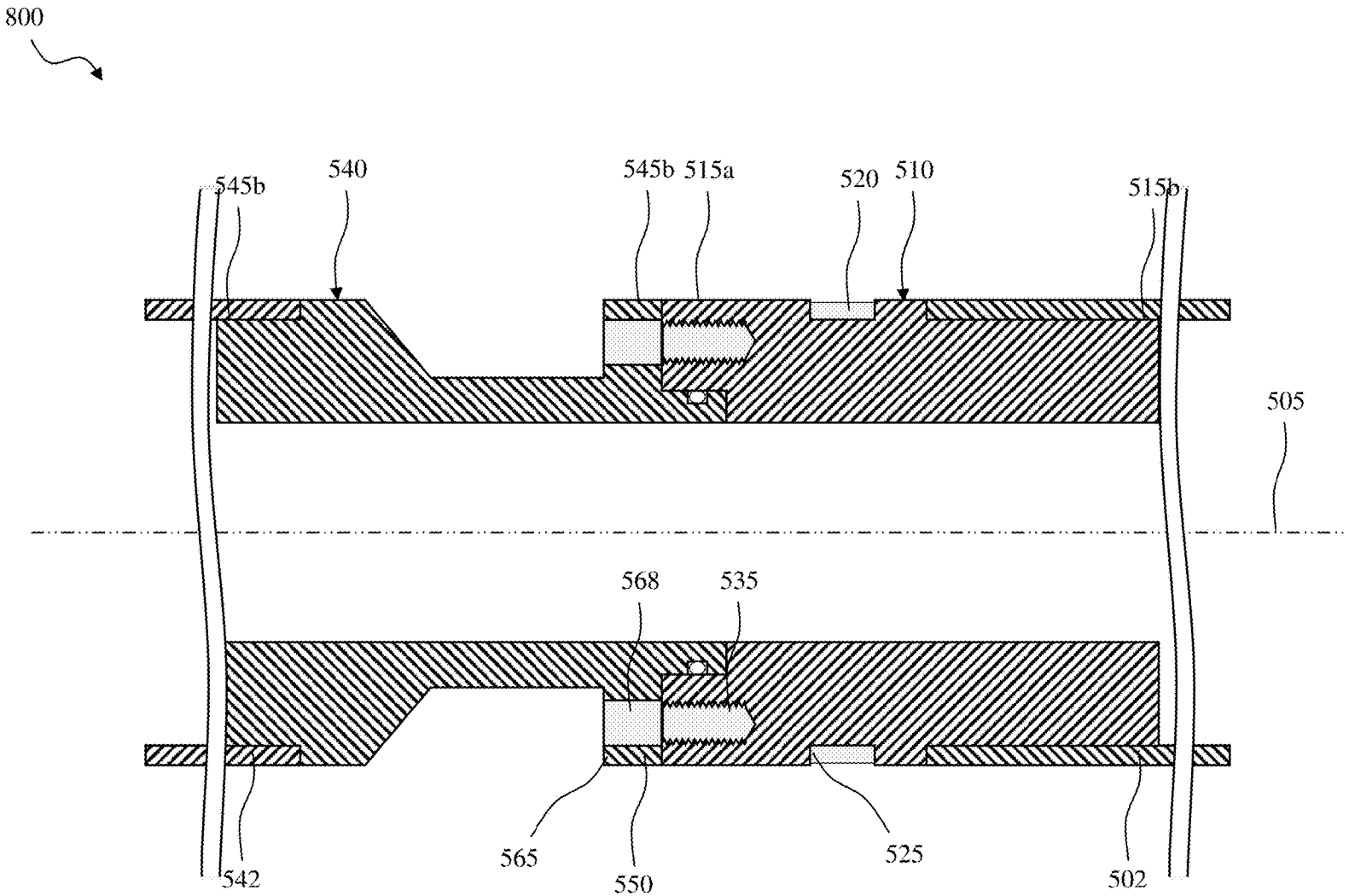
Figure 8F:
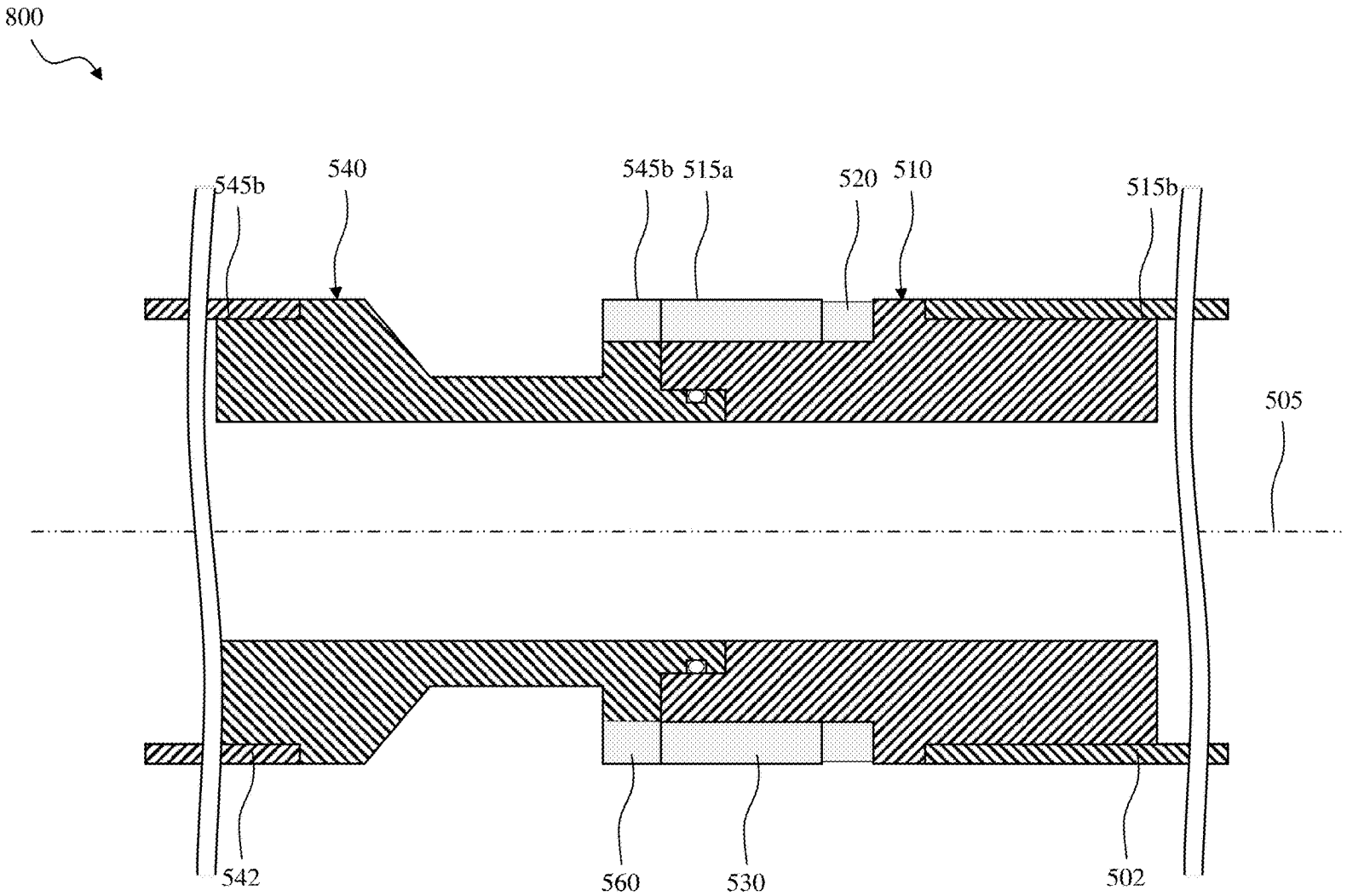

FIGS. 8D through 8F illustrate various different cross-sectional views of the downhole tool 800 of FIGS. 8A through 8C after the head member 510 and the base member 540 have been brought together to form an initial coupling. At this stage, the first axial slot 530 is substantially aligned with the second axial slot 560. Similarly, the one or more threaded openings 535 are substantially aligned with the one or more holes 568.

Figure 8G:
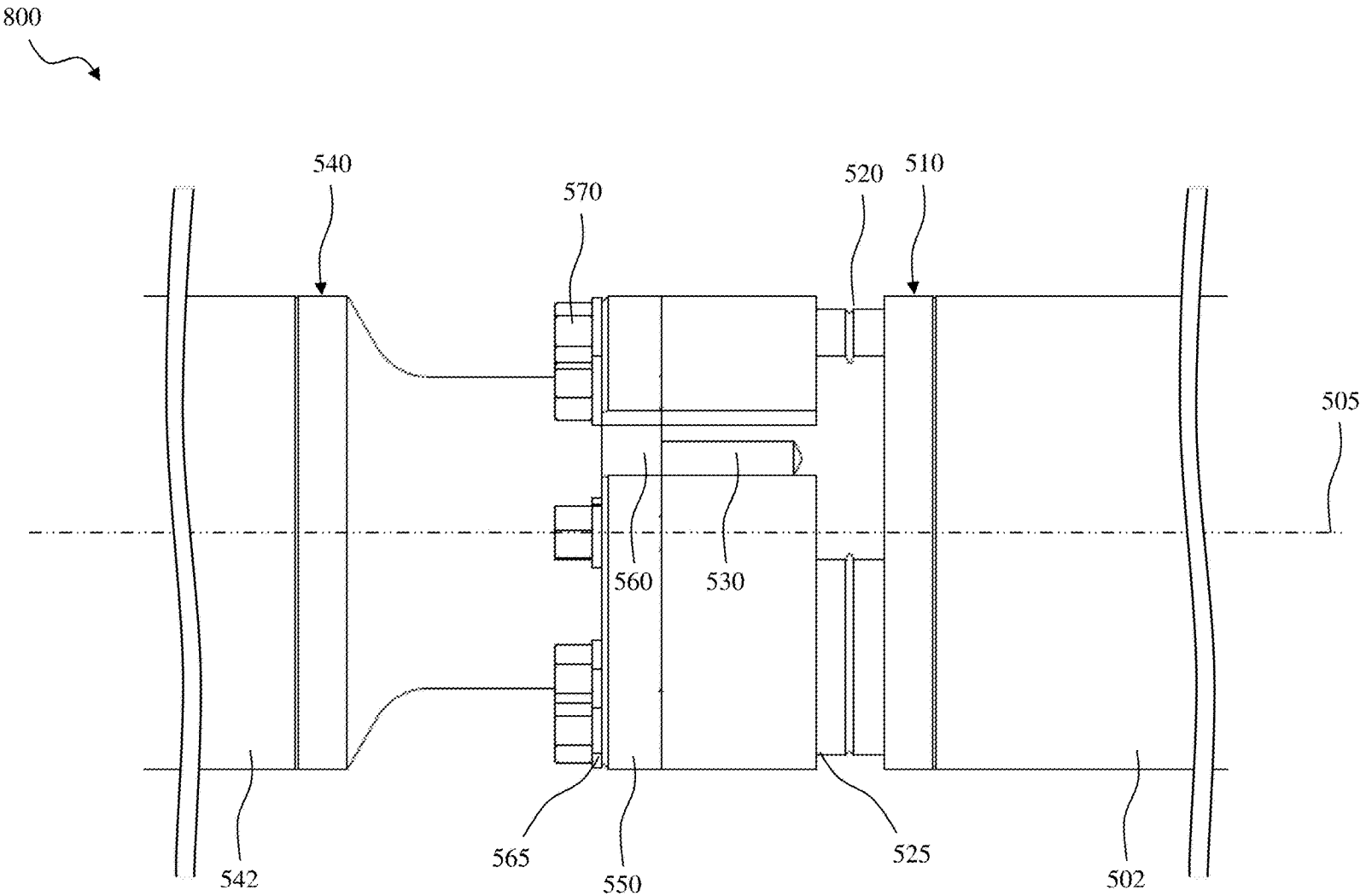
Figure 8H:
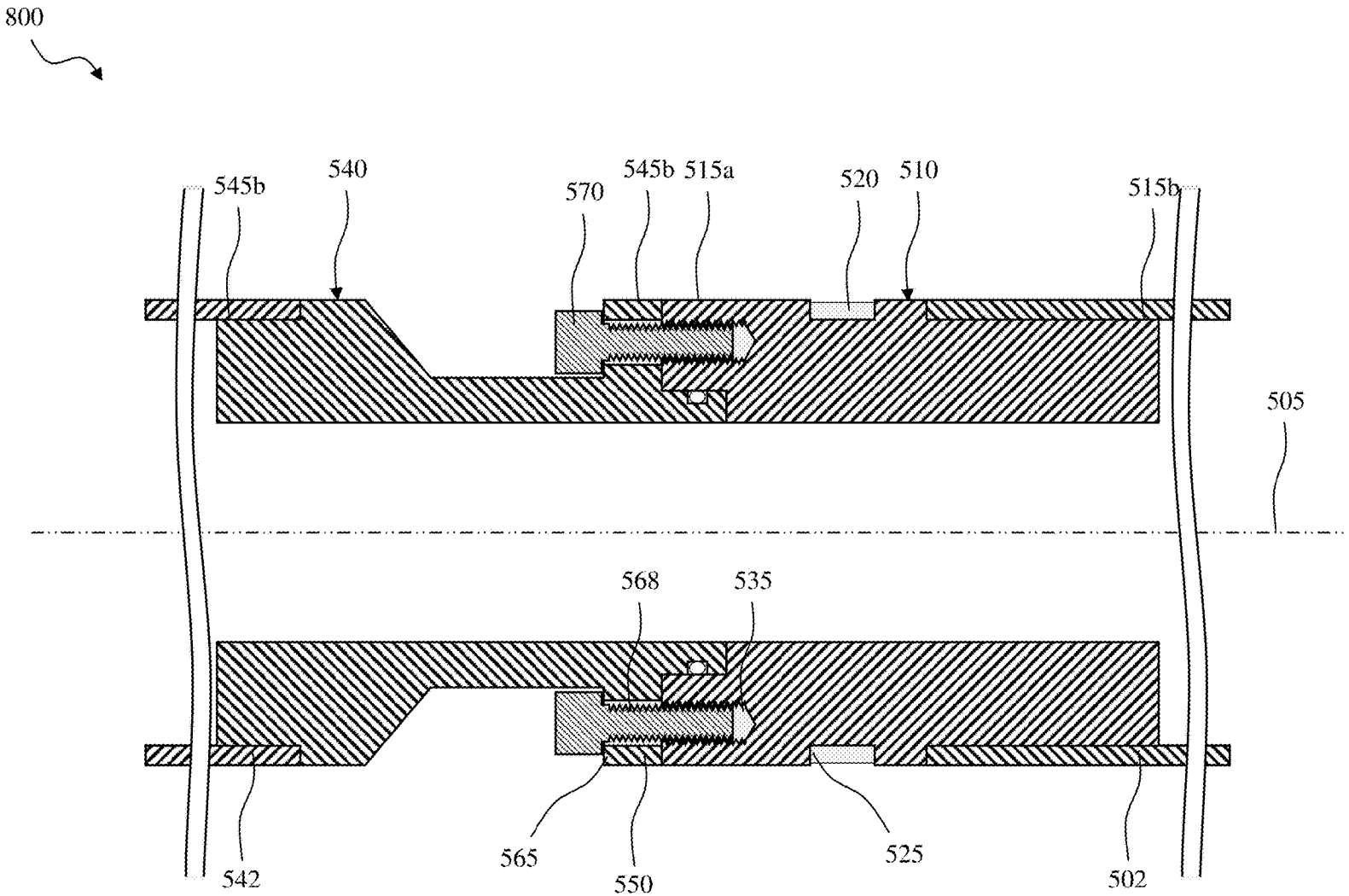
Figure 8I:
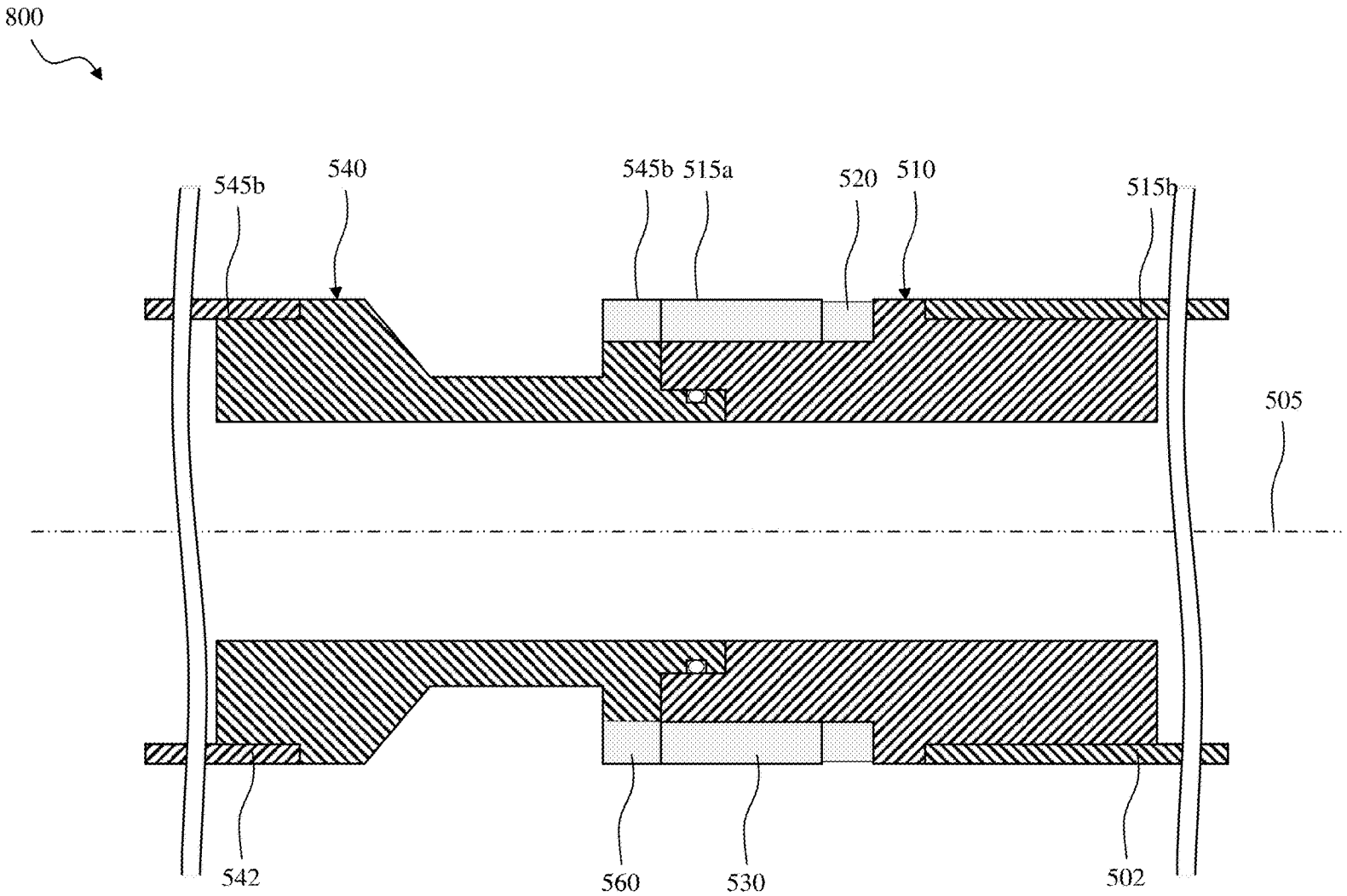

FIGS. 8G through 8I illustrate various different cross-sectional views of the downhole tool 800 of FIGS. 8D through 8F after threading the one or more threaded fasteners 570 through the one or more holes 568 and into the one or more threaded openings 535.

Figure 8J:
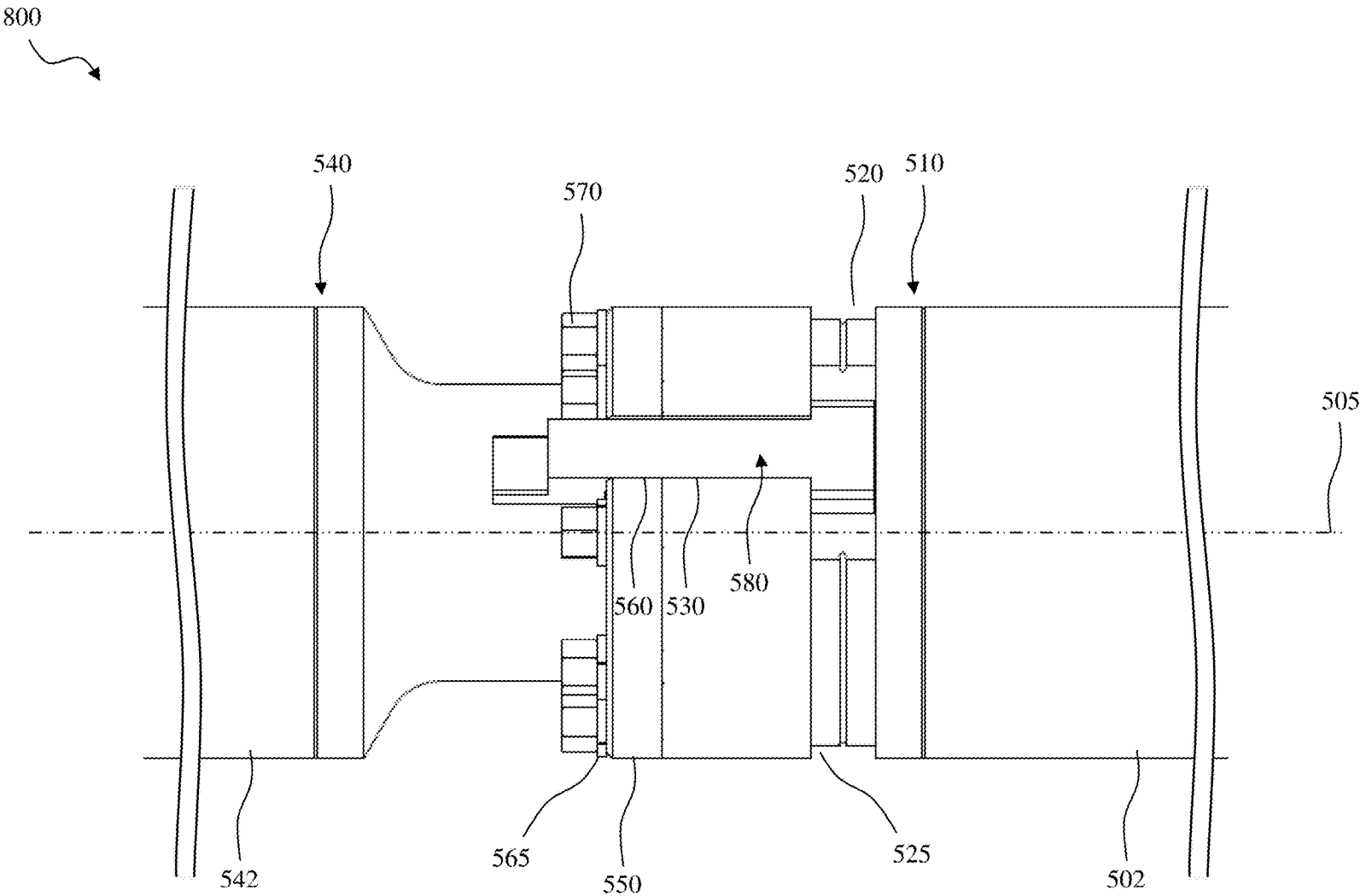
Figure 8K:
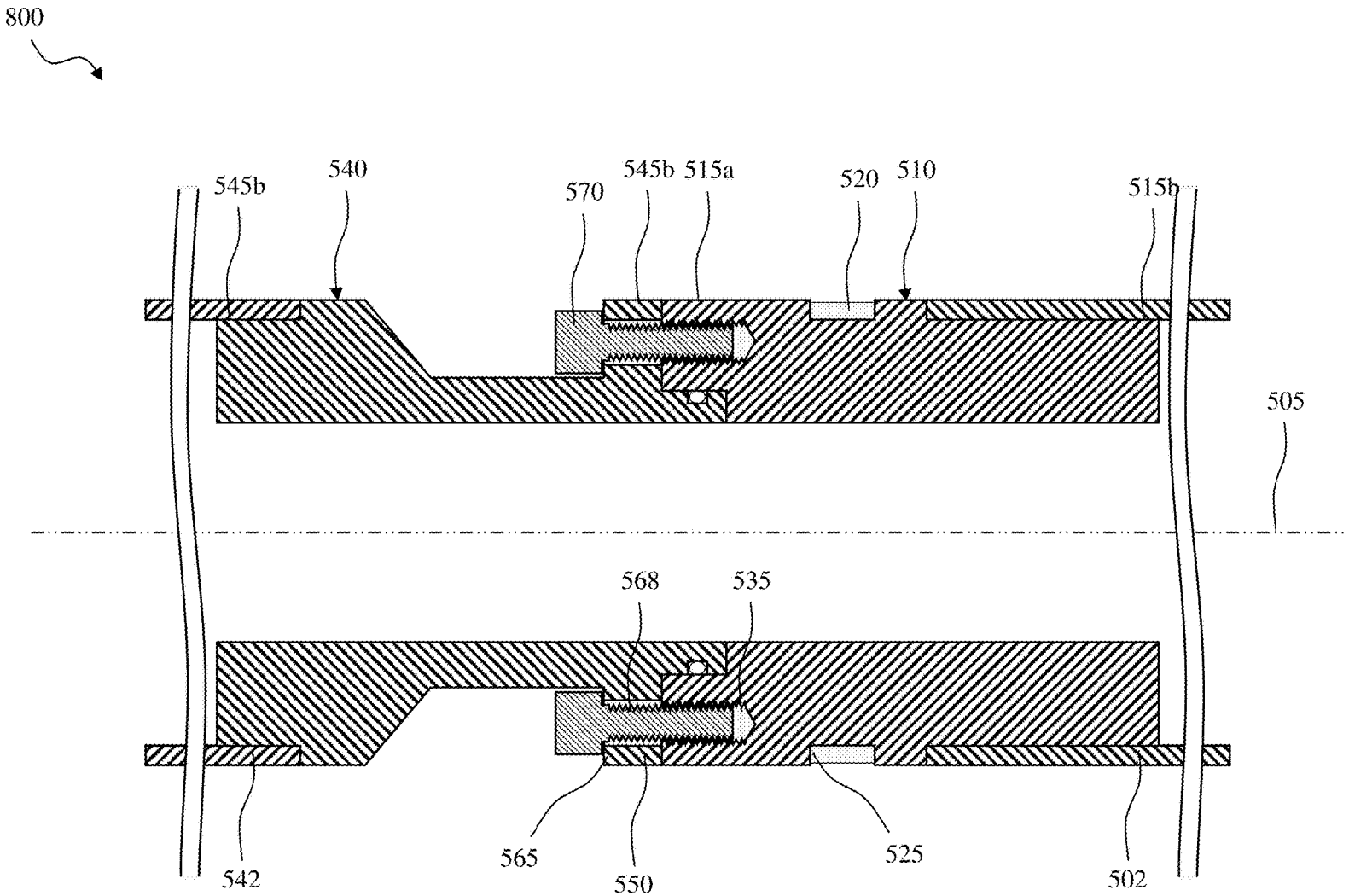
Figure 8L:
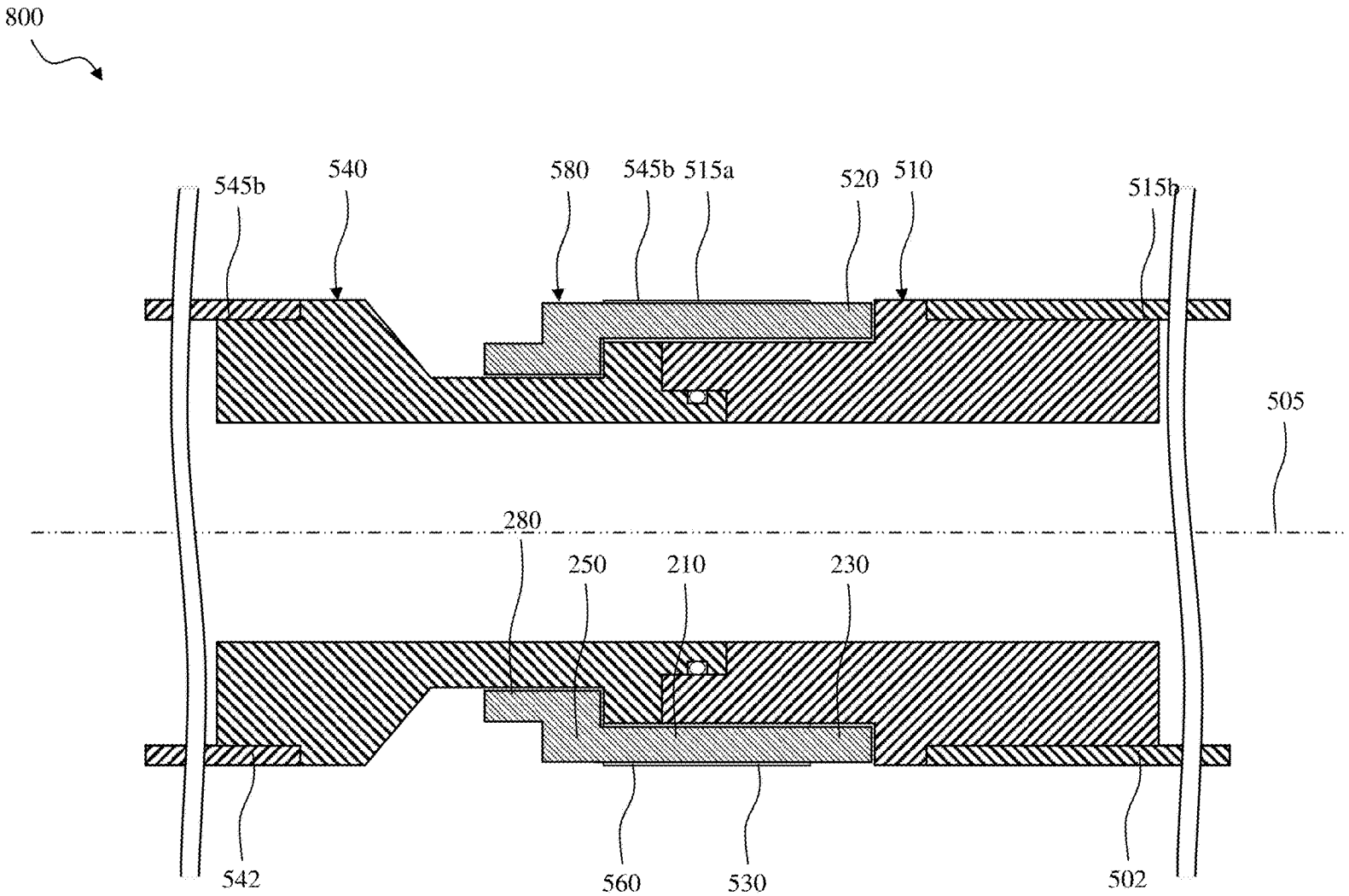

FIGS. 8J through 8L illustrate various different cross-sectional views of the downhole tool 800 of FIGS. 8G and 8I after positioning a coupling member 580 within the first axial slot 530 and the second axial slot 560 to provide a coupling for the flanged connection. In at least one embodiment, a first shear member shoulder 235 of the first shear member portion 230 engages with a head member shoulder 525 of the groove 520. Similarly, a second shear member shoulder 255 of the second shear member portion 250 engages with a base member shoulder 565 of the flange 550.

In one embodiment, the one or more threaded fasteners 570 are threaded through the one or more holes 568 and into the one or more threaded openings 535 prior to positioning the coupling member 580 within the first axial slot 530 and the second axial slot 560. In yet another embodiment, the one or more threaded fasteners 570 are threaded through the one or more holes 568 and into the one or more threaded openings 535 after positioning the coupling member 580 within the first axial slot 530 and the second axial slot 560. In this embodiment, the placement of the coupling member 580 within the first axial slot 530 and the second axial slot 560 will align the one or more threaded openings 535 and the one or more holes 568, thereby making the threading of the one or more threaded fasteners 570 easier to accomplish.

Figure 8M:
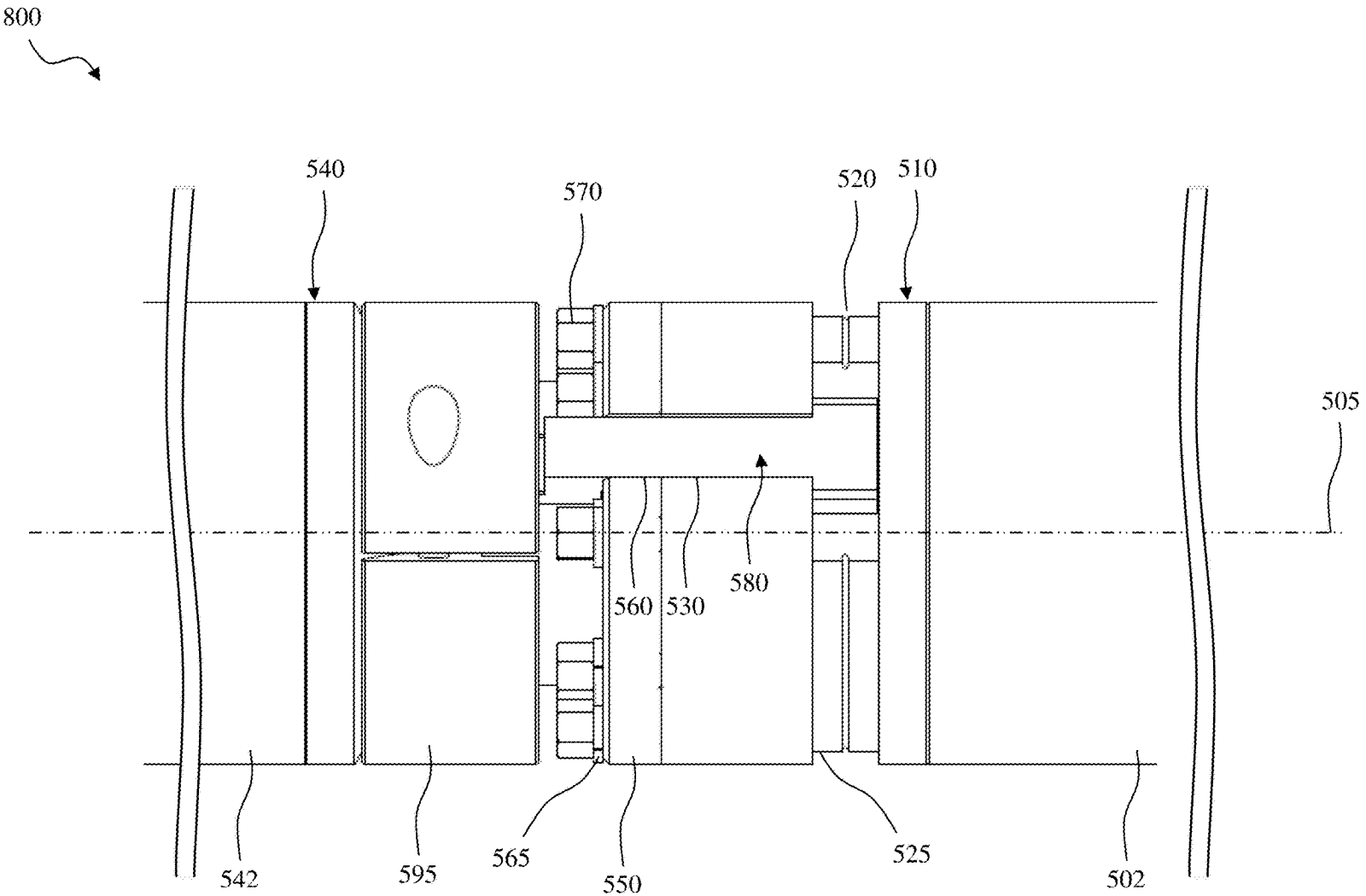
Figure 8N:
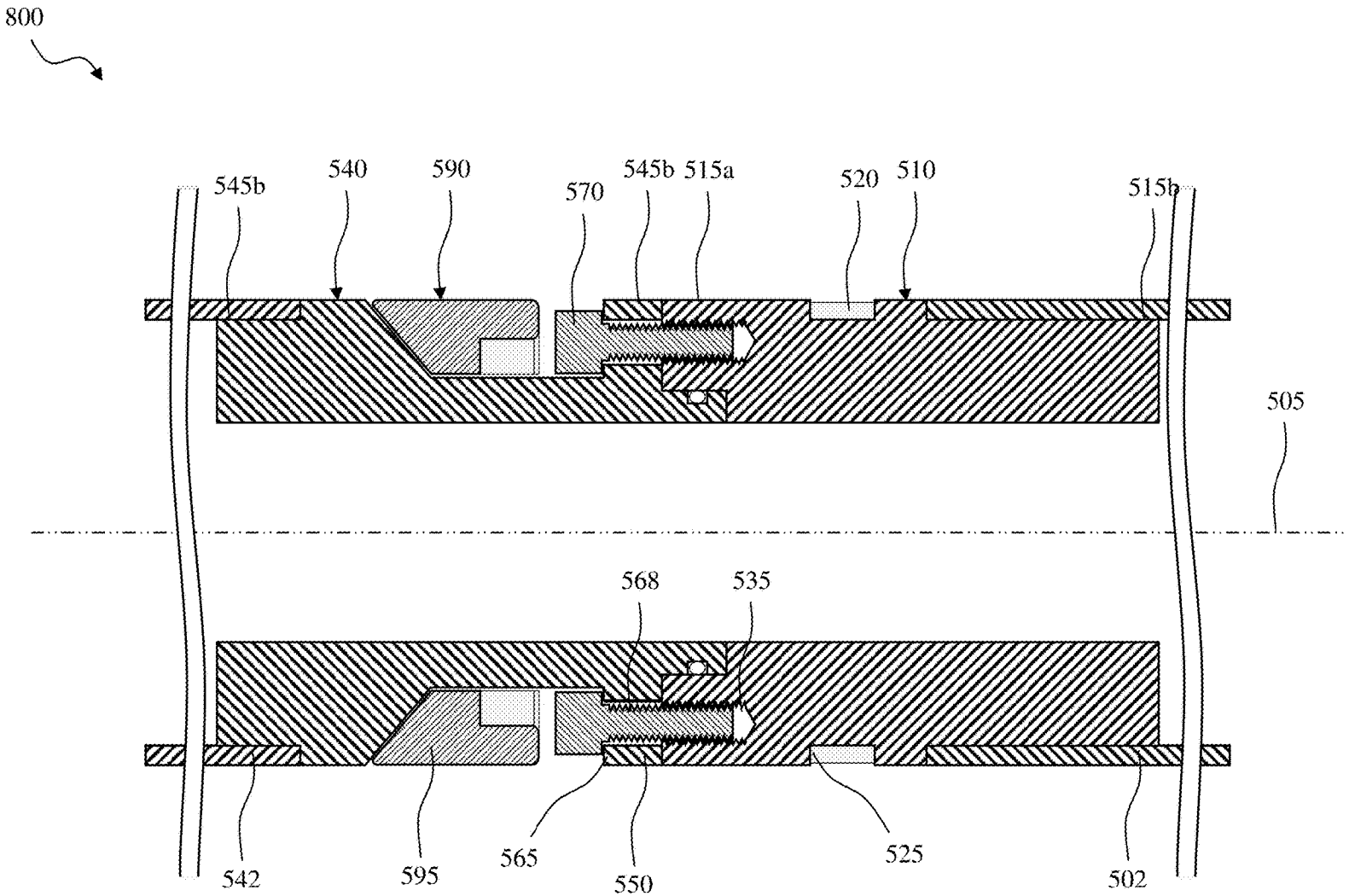
Figure 8O:
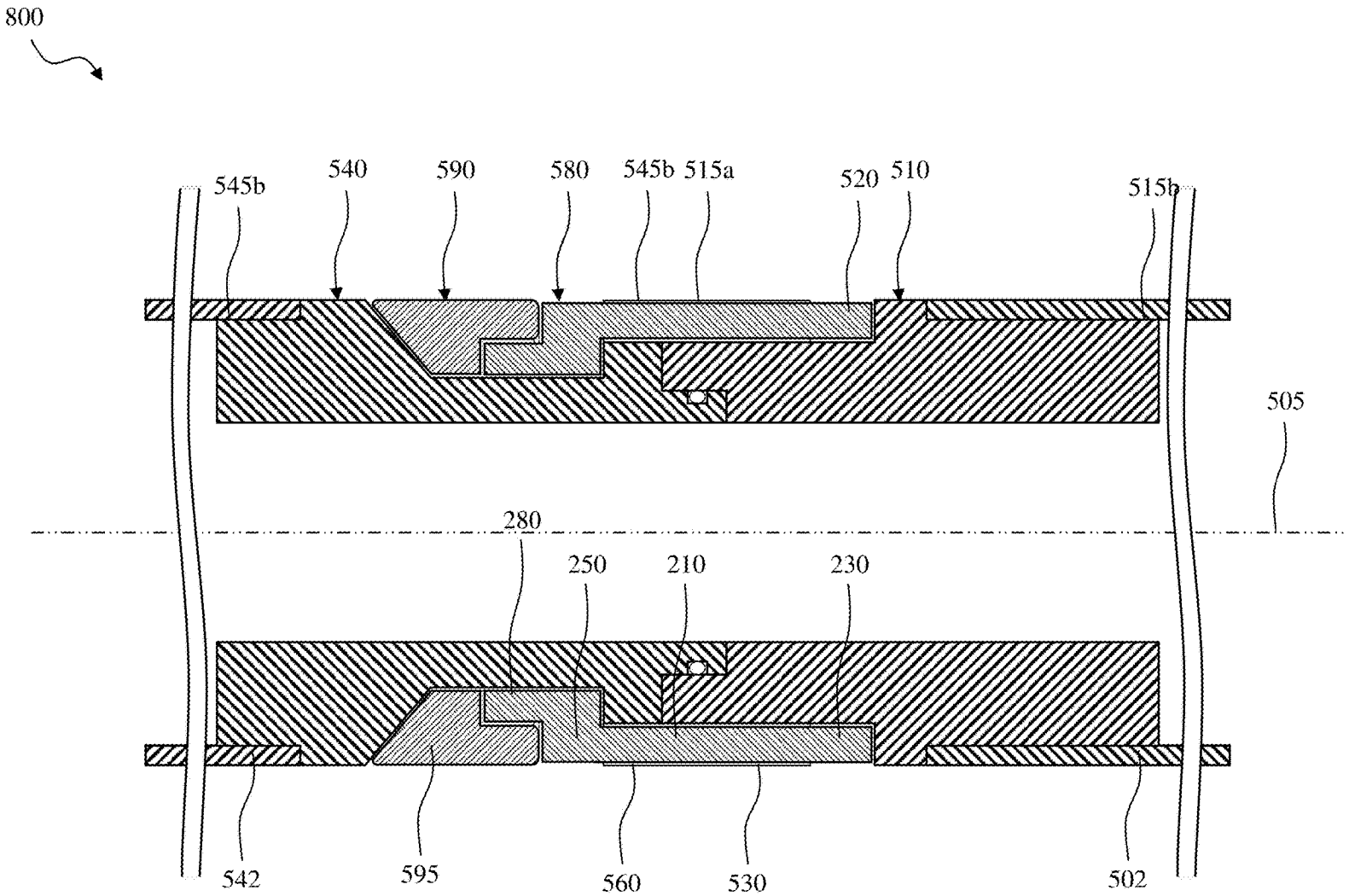

FIGS. 8M through 80 illustrate various different cross-sectional views of the downhole tool 800 of FIGS. 8J through 8L after positioning a retaining clamp 595 over the coupling member retention mechanism 590, which happens to be the lip member 280. Accordingly, the retaining clamp 595 fixes the axial tension member portion 210 in the first axial slot 530 and the second axial slot 560.

Aspects disclosed herein include:

A. A coupling member for use with a connection, the coupling member including: 1) an axial tension member portion, the axial tension member portion configured to span a first axial slot in a head member of a connection and a second axial slot in a base member of the connection; 2) a first shear member portion, the first shear member portion having a first shear member shoulder extending from a first end of the axial tension member portion, the first shear member shoulder configured to engage with an opposing head member shoulder to axially fix the axial tension member portion relative to the head member; and 3) a second shear member portion, the second shear member portion having a second shear member shoulder extending from a second opposing end of the axial tension member portion, the second shear member shoulder configured to engage with an opposing base member shoulder to axially fix the axial tension member portion relative to the base member, the axial tension member portion, the first shear member portion, and the second shear member portion configured to provide a coupling for the connection.

B. A downhole tool, the downhole including: 1) a head member, the head member including: a) a first head member end and a second head member end; b) a first groove located proximate the first head member end, the first groove extending at least partially around the head member to form a head member shoulder; and c) a first axial slot coupling the first groove and the first head member end; 2) a base member positioned proximate the head member to form a connection, the base member including: a) a first base member end and a second base member end; b) a second groove located proximate the first base member end, the second groove extending at least partially around the base member to form a base member shoulder; and c) a second axial slot coupling the second groove and the first base member end, wherein the first axial slot and the second axial slot are substantially aligned with one another; and 3) a coupling member positioned within the first axial slot and the second axial slot to provide a coupling for the connection, the coupling member including: a) an axial tension member portion, the axial tension member portion located in and spanning the first axial slot and the second axial slot; b) a first shear member portion located in the first groove, the first shear member portion having a first shear member shoulder extending from a first end of the axial tension member portion, the first shear member shoulder engaging with the opposing head member shoulder to axially fix the axial tension member portion relative to the head member; and c) a second shear member portion located in the second groove, the second shear member portion have a second shear member shoulder extending from a second opposing end of the axial tension member portion, the second shear member shoulder engaging with the opposing base member shoulder to axially fix the axial tension member portion relative to the base member.

C. A well system, the well system including: 1) a wellbore extending from the earth's surface through one or more subterranean formations; 2) a wellhead positioned over the wellbore and proximate the earth's surface; 3) production tubing extending from the wellhead through at least one of the one or more subterranean formations; and 4) a pump assembly coupled proximate a lower end of the production tubing, the pump assembly including: a) a head member, the head member including: i) a first head member end and a second head member end; ii) a first groove located proximate the first head member end, the first groove extending at least partially around the head member to form a head member shoulder; and iii) a first axial slot coupling the first groove and the first head member end; b) a base member positioned proximate the head member to form a connection, the base member including: i) a first base member end and a second base member end; ii) a second groove located proximate the first base member end, the second groove extending at least partially around the base member to form a base member shoulder; and iii) a second axial slot coupling the second groove and the first base member end, wherein the first axial slot and the second axial slot are substantially aligned with one another; and c) a coupling member positioned within the first axial slot and the second axial slot to provide a coupling for the connection, the coupling member including: i) an axial tension member portion, the axial tension member portion located in and spanning the first axial slot and the second axial slot; ii) a first shear member portion located in the first groove, the first shear member portion having a first shear member shoulder extending from a first end of the axial tension member portion, the first shear member shoulder engaging with the opposing head member shoulder to axially fix the axial tension member portion relative to the head member; and iii) a second shear member portion located in the second groove, the second shear member portion have a second shear member shoulder extending from a second opposing end of the axial tension member portion, the second shear member shoulder engaging with the opposing base member shoulder to axially fix the axial tension member portion relative to the base member.

Aspects A, B, and C may have one or more of the following additional elements in combination: Element 1: wherein the connection is a flanged connection, and further wherein the axial tension member portion is configured to span the first axial slot in the head member of the flanged connection and the second axial slot in a flange of the base member of the flanged connection. Element 2: wherein the first shear member portion is L-shaped to create one shear plane or T-shaped to create two shear planes. Element 3: wherein the first shear member portion creates a first shear plane and the second shear member portion creates a second shear plane, and further wherein the first shear plane and the second shear plane are substantially parallel with a longitudinal axis of the axial tension member portion. Element 4: wherein the first shear plane and the second shear plane are substantially perpendicular to one another. Element 5: wherein the first shear plane and the second shear plane are substantially parallel with one another. Element 6: further including a coupling member retention mechanism coupled to one of the axial tension member portion, the first shear member portion, or the second shear member portion length, the coupling member retention mechanism configured to fix the axial tension member portion in the first axial slot and the second axial slot. Element 7: wherein the coupling member retention mechanism is an opening extending through the axial tension member portion, the first shear member portion, or the second shear member portion, the opening configured to have a fastener extend therethrough to fix the coupling member in the first axial slot and the second axial slot. Element 8: wherein the coupling member retention mechanism is an opening extending through a thickness (t) of the first shear member portion, the opening configured to have a fastener extend therethrough to fix the coupling member in the first axial slot and the second axial slot. Element 9: wherein the coupling member retention mechanism is a lip member extending from the second shear member portion, the lip member configured to engage with and be held in place by a retaining clamp associated with the connection. Element 10: wherein the connection is a flanged connection, and further wherein a flange having a flange thickness (t) is located at the first base member end and forming the second groove, and further wherein the second axial slot extends through the flange thickness (t) to form a base member shoulder, wherein the first axial slot and the second axial slot are substantially aligned with one another. Element 11: wherein the first shear member portion is L-shaped to create one shear plane or T-shaped to create two shear planes. Element 12: wherein the first shear member portion creates a first shear plane and the second shear member portion creates a second shear plane, and further wherein the first shear plane and the second shear plane are substantially parallel with a longitudinal axis of the axial tension member portion. Element 13: wherein the first shear plane and the second shear plane are substantially perpendicular to one another. Element 14: wherein the first shear plane and the second shear plane are substantially parallel with one another. Element 15: further including a coupling member retention mechanism coupled to one of the axial tension member portion, the first shear member portion, or the second shear member portion length, the coupling member retention mechanism configured to fix the axial tension member portion in the first axial slot and the second axial slot. Element 16: wherein the coupling member retention mechanism is an opening extending through the axial tension member portion, the first shear member portion, or the second shear member portion, the opening configured to have a fastener extend therethrough to fix the coupling member in the first axial slot and the second axial slot. Element 17: wherein the coupling member retention mechanism is an opening extending through the first shear member portion, the opening configured to have a fastener extend therethrough to fix the coupling member in the first axial slot and the second axial slot. Element 18: further including a fastener extending through the opening in the first shear member portion and into the head member, the fastener fixing the axial tension member portion in the first axial slot and the second axial slot. Element 19: wherein the coupling member retention mechanism is a lip member extending from the second shear member portion. Element 20: further including a retaining clamp engaged with the lip member, the retaining clamp fixing the axial tension member portion in the first axial slot and the second axial slot. Element 21: wherein the head member and the base member are a pump assembly head member and a pump assembly base member, and further wherein one or more threaded fasteners extend through one or more holes formed through a flange thickness (t) and into one or more threaded openings in the head member. Element 22: wherein the one or more threaded fasteners, one or more holes, and one or more threaded openings are four or more threaded fasteners, four or more holes and four or more threaded openings, and further wherein the coupling member is a first coupling member, and further including a second coupling member positioned within another first axial slot in the head member and another second axial slot in the base member. Element 23: wherein the connection is a flanged connection, and further wherein a flange having a flange thickness (t) is located at the first base member end and forming the second groove, and further wherein the second axial slot extends through the flange thickness (t) to form a base member shoulder, wherein the first axial slot and the second axial slot are substantially aligned with one another.

Further additions, deletions, substitutions and modifications may be made to the described embodiments.

What is claimed is:

1. A coupling member for use with a connection of a downhole tool, comprising:

an axial tension member portion, the axial tension member portion configured to span a first axial slot in a head member of the connection and a second axial slot in a base member of the connection;

a first shear member portion, the first shear member portion having a first shear member shoulder extending from a first end of the axial tension member portion, the first shear member shoulder configured to engage with an opposing head member shoulder to axially fix the axial tension member portion relative to the head member; and a second shear member portion, the second shear member portion having a second shear member shoulder extending from a second opposing end of the axial tension member portion, the second shear member shoulder configured to engage with an opposing base member shoulder to axially fix the axial tension member portion relative to the base member, the axial tension member portion, the first shear member portion, and the second shear member portion configured to provide a coupling for the connection wherein the connection is a flanged connection, and further wherein the axial tension member portion is configured to span the first axial slot in the head member of the flanged connection and the second axial slot in a flange member of the base member of the flanged connection.

2. The coupling member as recited in claim 1, wherein the first shear member portion is L-shaped to create one shear plane or T-shaped to create two shear planes.

3. The coupling member as recited in claim 1, wherein the first shear member portion creates a first shear plane and the second shear member portion creates a second shear plane, and further wherein the first shear plane and the second shear plane are substantially parallel with a longitudinal axis of the axial tension member portion.

4. The coupling member as recited in claim 3, wherein the first shear plane and the second shear plane are substantially perpendicular to one another.

5. The coupling member as recited in claim 3, wherein the first shear plane and the second shear plane are substantially parallel with one another.

6. The coupling member as recited in claim 1, further including a coupling member retention mechanism coupled to one of the axial tension member portion, the first shear member portion, or the second shear member portion length, the coupling member retention mechanism configured to fix the axial tension member portion in the first axial slot and the second axial slot.

7. The coupling member as recited in claim 6, wherein the coupling member retention mechanism is an opening extending through the axial tension member portion, the first shear member portion, or the second shear member portion, the opening configured to have a fastener extend therethrough to fix the coupling member in the first axial slot and the second axial slot.

8. The coupling member as recited in claim 6, wherein the coupling member retention mechanism is an opening extending through a thickness (t) of the first shear member portion, the opening configured to have a fastener extend therethrough to fix the coupling member in the first axial slot and the second axial slot.

9. The coupling member as recited in claim 6, wherein the coupling member retention mechanism is a lip member extending from the second shear member portion, the lip member configured to engage with and be held in place by a retaining clamp associated with the connection.

10. A downhole tool, comprising:

a head member, the head member including:

a first head member end and a second head member end;

a first groove located proximate the first head member end, the first groove extending at least partially around the head member to form a head member shoulder; and a first axial slot coupling the first groove and the first head member end;

a base member positioned proximate the head member to form a connection, the base member including:

a first base member end and a second base member end;

a second groove located proximate the first base member end, the second groove extending at least partially around the base member to form a base member shoulder; and a second axial slot coupling the second groove and the first base member end, wherein the first axial slot and the second axial slot are substantially aligned with one another; and a coupling member positioned within the first axial slot and the second axial slot to provide a coupling for the connection, the coupling member including:

an axial tension member portion, the axial tension member portion located in and spanning the first axial slot and the second axial slot;

a first shear member portion located in the first groove, the first shear member portion having a first shear member shoulder extending from a first end of the axial tension member portion, the first shear member shoulder engaging with the opposing head member shoulder to axially fix the axial tension member portion relative to the head member; and a second shear member portion located in the second groove, the second shear member portion have a second shear member shoulder extending from a second opposing end of the axial tension member portion, the second shear member shoulder engaging with the opposing base member shoulder to axially fix the axial tension member portion relative to the base member wherein the connection is a flanged connection, and further wherein a flange having a flange thickness (t) is located at the first base member end and forming the second groove, and further wherein the second axial slot extends through the flange thickness (t) to form a base member shoulder, wherein the first axial slot and the second axial slot are substantially aligned with one another.

11. The downhole tool as recited in claim 10, wherein the first shear member portion is L-shaped to create one shear plane or T-shaped to create two shear planes.

12. The downhole tool as recited in claim 10, wherein the first shear member portion creates a first shear plane and the second shear member portion creates a second shear plane, and further wherein the first shear plane and the second shear plane are substantially parallel with a longitudinal axis of the axial tension member portion.

13. The downhole tool as recited in claim 12, wherein the first shear plane and the second shear plane are substantially perpendicular to one another.

14. The downhole tool as recited in claim 12, wherein the first shear plane and the second shear plane are substantially parallel with one another.

15. The downhole tool as recited in claim 10, wherein the head member and the base member are a pump assembly head member and a pump assembly base member, and further wherein one or more threaded fasteners extend through one or more holes formed through a flange thickness (t) and into one or more threaded openings in the head member.

16. The downhole tool as recited in claim 15, wherein the one or more threaded fasteners, one or more holes, and one or more threaded openings are four or more threaded fasteners, four or more holes and four or more threaded openings, and further wherein the coupling member is a first coupling member, and further including a second coupling member positioned within another first axial slot in the head member and another second axial slot in the base member.

17. A well system, comprising:

a wellbore extending from the earth's surface through one or more subterranean formations;

a wellhead positioned over the wellbore and proximate the earth's surface;

production tubing extending from the wellhead through at least one of the one or more subterranean formations; and a pump assembly coupled proximate a lower end of the production tubing, the pump assembly including:

a head member, the head member including:

a first head member end and a second head member end;

a first groove located proximate the first head member end, the first groove extending at least partially around the head member to form a head member shoulder; and a first axial slot coupling the first groove and the first head member end;

a base member positioned proximate the head member to form a connection, the base member including:

a first base member end and a second base member end;

a second groove located proximate the first base member end, the second groove extending at least partially around the base member to form a base member shoulder; and a second axial slot coupling the second groove and the first base member end, wherein the first axial slot and the second axial slot are substantially aligned with one another; and a coupling member positioned within the first axial slot and the second axial slot to provide a coupling for the connection, the coupling member including:

an axial tension member portion, the axial tension member portion located in and spanning the first axial slot and the second axial slot;

a first shear member portion located in the first groove, the first shear member portion having a first shear member shoulder extending from a first end of the axial tension member portion, the first shear member shoulder engaging with the opposing head member shoulder to axially fix the axial tension member portion relative to the head member; and a second shear member portion located in the second groove, the second shear member portion have a second shear member shoulder extending from a second opposing end of the axial tension member portion, the second shear member shoulder engaging with the opposing base member shoulder to axially fix the axial tension member portion relative to the base member.

18. The well system as recited in claim 17, wherein the connection is a flanged connection, and further wherein a flange having a flange thickness (t) is located at the first base member end and forming the second groove, and further wherein the second axial slot extends through the flange thickness (t) to form a base member shoulder, wherein the first axial slot and the second axial slot are substantially aligned with one another.

19. A coupling member for use with with a connection of a downhole tool, comprising:

an axial tension member portion, the axial tension member portion configured to span a first axial slot in a head member of the connection and a second axial slot in a base member of the connection;

a first shear member portion, the first shear member portion having a first shear member shoulder extending from a first end of the axial tension member portion, the first shear member shoulder configured to engage with an opposing head member shoulder to axially fix the axial tension member portion relative to the head member;

a second shear member portion, the second shear member portion having a second shear member shoulder extending from a second opposing end of the axial tension member portion, the second shear member shoulder configured to engage with an opposing base member shoulder to axially fix the axial tension member portion relative to the base member, the axial tension member portion, the first shear member portion, and the second shear member portion configured to provide a coupling for the connection; and a coupling member retention mechanism coupled to one of the axial tension member portion, the first shear member portion, or the second shear member portion length, the coupling member retention mechanism configured to fix the axial tension member portion in the first axial slot and the second axial slot, wherein the coupling member retention mechanism is a lip member extending from the second shear member portion, the lip member configured to engage with and be held in place by a retaining clamp associated with the connection.

20. A downhole tool, comprising:

a head member, the head member including:

a first head member end and a second head member end;

a first groove located proximate the first head member end, the first groove extending at least partially around the head member to form a head member shoulder; and a first axial slot coupling the first groove and the first head member end;

a base member positioned proximate the head member to form a connection, the base member including:

a first base member end and a second base member end;

a second groove located proximate the first base member end, the second groove extending at least partially around the base member to form a base member shoulder; and a second axial slot coupling the second groove and the first base member end, wherein the first axial slot and the second axial slot are substantially aligned with one another; and a coupling member positioned within the first axial slot and the second axial slot to provide a coupling for the connection, the coupling member including:

an axial tension member portion, the axial tension member portion located in and spanning the first axial slot and the second axial slot;

a first shear member portion located in the first groove, the first shear member portion having a first shear member shoulder extending from a first end of the axial tension member portion, the first shear member shoulder engaging with the opposing head member shoulder to axially fix the axial tension member portion relative to the head member; and a second shear member portion located in the second groove, the second shear member portion have a second shear member shoulder extending from a second opposing end of the axial tension member portion, the second shear member shoulder engaging with the opposing base member shoulder to axially fix the axial tension member portion relative to the base member; and a coupling member retention mechanism coupled to one of the axial tension member portion, the first shear member portion, or the second shear member portion length, the coupling member retention mechanism configured to fix the axial tension member portion in the first axial slot and the second axial slot, wherein the coupling member retention mechanism is a lip member extending from the second shear member portion, the lip member configured to engage with and be held in place by a retaining clamp associated with the connection.

21. A downhole tool, comprising:

a head member, the head member including:

a first head member end and a second head member end;

a first groove located proximate the first head member end, the first groove extending at least partially around the head member to form a head member shoulder; and a first axial slot coupling the first groove and the first head member end;

a base member positioned proximate the head member to form a connection, the base member including:

a first base member end and a second base member end;

a second groove located proximate the first base member end, the second groove extending at least partially around the base member to form a base member shoulder; and a second axial slot coupling the second groove and the first base member end, wherein the first axial slot and the second axial slot are substantially aligned with one another; and a coupling member positioned within the first axial slot and the second axial slot to provide a coupling for the connection, the coupling member including:

an axial tension member portion, the axial tension member portion located in and spanning the first axial slot and the second axial slot;

a first shear member portion located in the first groove, the first shear member portion having a first shear member shoulder extending from a first end of the axial tension member portion, the first shear member shoulder engaging with the opposing head member shoulder to axially fix the axial tension member portion relative to the head member; and a second shear member portion located in the second groove, the second shear member portion have a second shear member shoulder extending from a second opposing end of the axial tension member portion, the second shear member shoulder engaging with the opposing base member shoulder to axially fix the axial tension member portion relative to the base member; and a coupling member retention mechanism coupled to one of the axial tension member portion, the first shear member portion, or the second shear member portion length, the coupling member retention mechanism configured to fix the axial tension member portion in the first axial slot and the second axial slot, wherein:

the coupling member retention mechanism is an opening extending through the axial tension member portion, the first shear member portion, or the second shear member portion, the opening configured to have a fastener extend therethrough to fix the coupling member in the first axial slot and the second axial slot; or the coupling member retention mechanism is an opening extending through the first shear member portion, the opening configured to have a fastener extend therethrough to fix the coupling member in the first axial slot and the second axial slot.

22. The downhole tool as recited in claim 21, wherein the coupling member retention mechanism is an opening, and further including a fastener extending through the opening in the first shear member portion and into the head member, the fastener fixing the axial tension member portion in the first axial slot and the second axial slot.

* * * * *